US007664410B2

(12) United States Patent
Takagi

(10) Patent No.: US 7,664,410 B2
(45) Date of Patent: Feb. 16, 2010

(54) IMAGE FORMING APPARATUS WITH CONTROL OF POWER TO A FIXING UNIT

(75) Inventor: Hiromasa Takagi, Tokyo (JP)

(73) Assignee: Ricoh Company, Ltd., Tokyo (JP)

( * ) Notice: Subject to any disclaimer, the term of this patent is extended or adjusted under 35 U.S.C. 154(b) by 0 days.

(21) Appl. No.: 12/351,357

(22) Filed: Jan. 9, 2009

(65) Prior Publication Data

US 2009/0123172 A1 May 14, 2009

Related U.S. Application Data

(62) Division of application No. 11/004,885, filed on Dec. 7, 2004.

(30) Foreign Application Priority Data

| | | |
|---|---|---|
| Dec. 8, 2003 | (JP) | 2003-408710 |
| Jan. 30, 2004 | (JP) | 2004-024785 |
| Jan. 30, 2004 | (JP) | 2004-024794 |
| Feb. 5, 2004 | (JP) | 2004-028834 |

(51) Int. Cl.
*G03G 15/00* (2006.01)
*G03G 15/20* (2006.01)

(52) U.S. Cl. ..... 399/37; 399/69; 399/88

(58) Field of Classification Search ..... 399/33, 399/37, 69, 70, 88, 328, 330, 44; 219/216, 219/469, 470, 482, 483
See application file for complete search history.

(56) References Cited

U.S. PATENT DOCUMENTS

| | | | | |
|---|---|---|---|---|
| 4,771,312 | A * | 9/1988 | Yanase et al. | 399/88 |
| 6,542,705 | B2 * | 4/2003 | Fujita et al. | 399/69 |
| 6,847,792 | B2 | 1/2005 | Nakafuji et al. | |
| 6,941,088 | B2 | 9/2005 | Atsushi et al. | |
| 7,002,112 | B2 | 2/2006 | Kishi et al. | |
| 7,024,128 | B2 | 4/2006 | Hiroto | |
| 7,054,570 | B2 | 5/2006 | Kishi et al. | |
| 7,164,870 | B2 | 1/2007 | Satoh | |
| 7,196,286 | B2 * | 3/2007 | Kishi et al. | 219/216 |
| 7,277,651 | B2 * | 10/2007 | Hanamoto et al. | 399/69 |
| 2002/0043523 | A1 | 4/2002 | Fujita et al. | |
| 2002/0118977 | A1 | 8/2002 | Hasegawa et al. | |

(Continued)

FOREIGN PATENT DOCUMENTS

| | | |
|---|---|---|
| EP | 0 686 895 A2 | 12/1995 |

(Continued)

*Primary Examiner*—Robert Beatty
(74) *Attorney, Agent, or Firm*—Oblon, Spivak, McClelland, Maier & Neustadt, L.L.P.

(57) ABSTRACT

An image forming apparatus including a main power supply unit, a chargeable auxiliary power supply unit, a fixing unit including a heater configured to receive power from at least one of the main power supply unit and the auxiliary power supply unit, and a voltage or temperature detecting part configured to detect a voltage input to the main power supply unit from a commercial power supply or to detect a voltage of the auxiliary power supply unit or to detect an environment temperature. Energy accumulated in the auxiliary power supply unit can be controlled to not be supplied to the fixing unit at a time of starting the fixing unit if the voltage or temperatures detected are less than predetermined values.

19 Claims, 42 Drawing Sheets

U.S. PATENT DOCUMENTS

| | | | | |
|---|---|---|---|---|
| 2004/0108309 | A1* | 6/2004 | Dempsey | 219/484 |
| 2004/0202490 | A1 | 10/2004 | Okamoto | |
| 2005/0123315 | A1 | 6/2005 | Kishi et al. | |

FOREIGN PATENT DOCUMENTS

| | | | |
|---|---|---|---|
| EP | 1 376 261 | A1 | 1/2004 |
| JP | 57-73773 | | 5/1982 |
| JP | 60-17473 | | 1/1985 |
| JP | 63-113563 | | 5/1988 |
| JP | 03-036579 | | 2/1991 |
| JP | 3-174570 | | 7/1991 |
| JP | 06-342250 | | 12/1994 |
| JP | 9-230739 | | 9/1997 |
| JP | 10-10913 | | 1/1998 |
| JP | 10-282821 | | 10/1998 |
| JP | 2000-197277 | | 7/2000 |
| JP | 2000-315567 | | 11/2000 |
| JP | 2001-324892 | | 11/2001 |
| JP | 2002-174988 | | 6/2002 |
| JP | 2002-184554 | | 6/2002 |
| JP | 2002-280146 | | 9/2002 |
| JP | 2003-033003 | | 1/2003 |
| JP | 2003-66764 | | 3/2003 |
| JP | 2003-257590 | | 9/2003 |
| JP | 2003-297526 | | 10/2003 |

* cited by examiner

FIG.43

| | CELL CAPACITANCE (F) | TARGET VOLTAGE (RATIO TO CELL RATED VOLTAGE) | FIXING CHARACTERISTIC | |
|---|---|---|---|---|
| | | | EVALUATION | SERVICEABLE LIFE |
| SA1 | 300 | 80% | ○ | × |
| SA2 | 300 | 60% | × | ○ |
| SA3 | 500 | 80% | ○ | ○ |

IMAGE FORMING APPARATUS WITH CONTROL OF POWER TO A FIXING UNIT

This application is a divisional of U.S. application Ser. No. 11/004,885 filed Dec. 7, 2004, and claims the benefit of Japanese Patent Applications No. 2003-408710 filed Dec. 8, 2003, No. 2004-024785 filed Jan. 30, 2004, No. 2004-024794 filed Jan. 30, 2004, and No. 2004-028834 filed Feb. 5, 2004, in the Japanese Patent Office, the disclosures of each of which are hereby incorporated by reference.

BACKGROUND OF THE INVENTION

1. Field of the Invention

The present invention generally relates to heaters, fixing units and image forming apparatuses, and more particularly to a heater that is provided with a capacitor and is used to heat various materials or apparatuses, for example, a fixing unit that uses such a heater, and an image forming apparatus, such as a copying machine, a printer and a facsimile machine, that uses such a fixing unit and employs an electrophotography technique.

2. Description of the Related Art

In an image forming apparatus such as a copying machine, an image is formed on a recording medium that may be plain paper, OHP or the like. From the point of view of the high speed, image quality and cost of the image formation, the electrophotography technique is popularly employed by the image forming apparatus. According to the electrophotography technique, a toner image is formed on the recording medium, and the toner image is fixed on the recording medium by applying heat and pressure. From the point of view of safety and the like, a heat roller type fixing method which uses a heat roller is most popularly employed at present. The heat roller type fixing method forms a mutual pressing part called a nip part where a heat roller and a confronting pressure roller press against each other. The heat roller generates heat from a heating member such as a halogen heater. The recording medium bearing the toner image transferred thereon passes through this nip part, and thus, the toner image is fixed on the recording medium by being applied with the heat and the pressure.

Recently, environmental problems have become increasingly important, and proposals have been made to reduce the power (or energy) consumption of the image forming apparatuses such as copying machines and printers. When reducing the power consumption of the image forming apparatus, it is important to reduce the power consumption of the fixing unit which fixes the toner image on the recording medium. When reducing the power consumption of the fixing unit in a standby state of the image forming apparatus, a popularly employed method maintains a temperature of the heat roller to a constant temperature that is slightly lower than a fixing temperature in the standby state, and immediately raises the temperature of the heat roller to a usable temperature in an operating state where the image forming apparatus is used, so that a user (or operator) does not need to wait for the temperature of the heat roller to rise to the usable temperature. But according to this popularly employed method, a certain power must be supplied to the fixing unit even when the fixing unit is not in use, and surplus power is consumed thereby. It is said that this power consumption in the standby state amounts to approximately 70% to approximately 80% of the total power consumption of devices, units and the like forming the image forming apparatus.

Accordingly, there are demands to reduce the power consumption of the image forming apparatus in the standby state so as to reduce the overall power consumption of the image forming apparatus, and to ultimately make the power consumption zero when the image forming apparatus is not in use. However, if the power consumption of the image forming apparatus in the standby state is set to zero, it will take a long time on the order of several minutes to several tens of minutes to raise the temperature of the heat roller of the fixing unit to the usable temperature of approximately 180° C., because the heat roller is a metal roller mainly made of iron, aluminum or the like having a large heat capacity. Such a long waiting time required until the temperature of the heat roller reaches the usable temperature will make the image forming apparatus inconvenient to use for the user. Hence, there are demands to minimize the power consumption but also enable the temperature of the heat roller to be quickly raised to the usable temperature.

In order to reduce the time required to raise the temperature of the heat roller, it is evident that the input energy per unit time, that is, the rated power, should be set large. In some high-speed image forming apparatuses designed to realize a high printing speed, the power supply voltage is actually set to 200 V. However, in a general office environment in Japan, for example, the commercial power supply is 100 V and 15 A. For this reason, in order for the image forming apparatus to cope with the 200 V power supply, special engineering work needs to be made with respect to power supply related equipments at the setup location of the image forming apparatus. Consequently, the use of the 200 V power supply is not a generally applicable solution for reducing the time required to raise the temperature of the heat roller.

In other words, as long as the commercial power supply of 100 V and 15 A is used, it is difficult to raise the temperature of the heat roller within a short time since a maximum input energy is determined by the power supply. For example, a Japanese Laid-Open Patent Application No. 10-10913 proposes delaying a temperature decrease in the fixing unit during the standby state of the fixing unit by supplying to the heat roller a voltage which is a predetermined level lower than a voltage supplied to the heat roller during the normal operating state of the fixing unit. Further, a Japanese Laid-Open Patent Application No. 10-282821, for example, proposes charging a secondary battery which forms an auxiliary power supply during the standby state of the fixing unit, so that the time required to raise the temperature of the heat roller can be reduced by supplying the power from a main power supply unit, the secondary battery and a primary battery to the heat roller when the normal operating state of the fixing unit is started.

However, the method proposed in the Japanese Laid-Open Patent Application No. 10-10913 must supply to the heat roller the voltage which is the predetermined level lower than the voltage supplied to the heat roller during the normal operating state of the fixing unit, even during the standby state of the fixing unit. Consequently, the power consumption cannot be reduced sufficiently. In addition, making the maximum power supply at the time of starting the normal operating state of the fixing unit higher than the power supplied from the main power supply unit is not the main aim of this proposed method.

On the other hand, according to the method proposed in the Japanese Laid-Open Patent Application No. 10-282821, the power from the main power supply unit, the secondary battery and the primary battery is supplied to the heat roller when the normal operating state of the fixing unit is started. Generally, a lead battery, a nickel-cadmium batter or a nickel-hydrogen battery is used as the secondary battery. The capacity of such secondary batteries deteriorates when repeatedly charged and discharged, and for such secondary batteries, the larger the discharge current the shorter serviceable life. The capacity of such secondary batteries also deteriorate due to memory effect. In general, even a long-life secondary battery, which is designed to have a long serviceable life even when the discharge current is large, will die when the charging and discharging is repeated approximately 500 times to approximately 1000 times. This means that, if the charging and discharging of the secondary battery is repeated 20 times per day, the serviceable life of the secondary battery will expire in approximately 1 month. As a result, it becomes necessary to frequently replace the secondary battery, thereby requiring a troublesome operation of replacing the secondary battery, and also increasing the running cost of the image forming apparatus due to the frequently replaced secondary battery. Furthermore, in the case of the lead battery, it is unsuited for use in office equipments since the lead battery uses sulfuric acid solution as the electrolyte.

In addition, the load on a heater circuit that is built into the heat roller increases, and the making current flows to a peripheral circuit to generate noise, due to a sudden current change, input power and the like when the supply of the large power is started and stopped. For this reason, it is preferably not to frequently turn ON and turn OFF the power supply from the auxiliary power supply having a large capacity. Moreover, when the power from the auxiliary power supply having the large capacity is supplied at once, the excessive supply of power may cause an excessive temperature rise of the heater circuit.

For example, a Japanese Laid-Open Patent Application No. 2002-184554 proposes a method of suppressing the problems described above, that is, increasing the effect of reducing the power consumption, reducing the noise caused by the making current and the sudden current change when the large power is supplied, reducing the time required to raise the temperature of the heat roller, and preventing an excessive temperature rise of the heat roller. This proposed method uses a chargeable and dischargeable capacitor for the auxiliary power supply unit. A charger charges the capacitor of the auxiliary power supply unit by the power supplied from a main power supply unit, a switching unit switches between the charging of the auxiliary power supply unit and the power supply from the auxiliary power supply unit with respect to an auxiliary heater element, and an amount of power supplied from the auxiliary power supply unit to the auxiliary heater element is adjusted. Basic functions of the capacitor include supplying the power from the capacitor to the auxiliary heater element to generate heat therefrom, so that the generated heat can be used to shorten the time required to raise the temperature of the heat roller to the predetermined temperature, and to prevent a fixing temperature from decreasing when the recording medium passes through the fixing unit.

Even in the case of the image forming apparatus that uses the capacitor as the secondary battery to prevent the temperature of the heat roller from decreasing, it would be preferable to refrain from using the capacitor as much as possible when the serviceable life, the reduction of the charging time and the like of the capacitor are taken into consideration, so as to improve the utilization efficiency of the capacitor, particularly if the temperature decrease in the fixing unit will be small or zero without using the capacitor. However, no method has conventionally been proposed to judge if the temperature decrease in the fixing unit will be small or zero even when the capacitor is not used.

SUMMARY OF THE INVENTION

Accordingly, it is a general object of the present invention to provide a novel and useful heater, fixing unit and image forming apparatus, in which the problems described above are suppressed.

Another and more specific object of the present invention is to provide a heater, a fixing unit and an image forming apparatus, which can improve the utilization efficiency of a capacitor that is used as a secondary battery.

Still another and more specific object of the present invention is to provide an image forming apparatus including a main power supply unit, a chargeable auxiliary power supply unit, a fixing unit including a heater configured to receive power from at least one of the main power supply unit and the auxiliary power supply unit, and a voltage detecting part configured to detect a voltage input to the main power supply unit from a commercial power supply, and wherein energy accumulated in the auxiliary power supply unit is not supplied to the fixing unit at a time of starting the fixing unit if the voltage detected by the voltage detecting part is a predetermined voltage or less.

Still another and more specific object of the present invention is to provide an image forming apparatus including a main power supply unit, a chargeable auxiliary power supply unit, a fixing unit including a heater part configured to receive power from at least one of the main power supply unit and the auxiliary power supply unit, and a temperature detecting part configured to detect an environment temperature, and wherein energy accumulated in the auxiliary power supply unit is not supplied to the fixing unit at a time of starting the fixing unit if the environment temperature detected by the temperature detecting part is a predetermined temperature or less.

Still another and more specific and more specific object of the present invention is to provide an image forming apparatus including a main power supply unit, a chargeable auxiliary power supply unit, a fixing unit including a heater part configured to receive power from at least one of the main power supply unit and the auxiliary power supply unit, and a voltage detecting part configured to detect a voltage of the auxiliary power supply unit, wherein energy accumulated in the auxiliary power supply unit is not supplied to the fixing unit at a time of starting the fixing unit if the voltage detected by the voltage detecting part is a predetermined voltage or less, and wherein energy accumulated in the auxiliary power supply unit is supplied to the fixing unit at a time of carrying out an image forming process with respect to successively supplied recording media if the voltage detected by the voltage detecting part is the predetermined voltage or less.

BRIEF DESCRIPTION OF THE DRAWINGS

FIG. 43 is a diagram showing the evaluation result for samples SA1 through SA3 of the image forming apparatus of the second modification of the fourth embodiment.

DESCRIPTION OF THE PREFERRED EMBODIMENTS

First Embodiment

Figure 1:
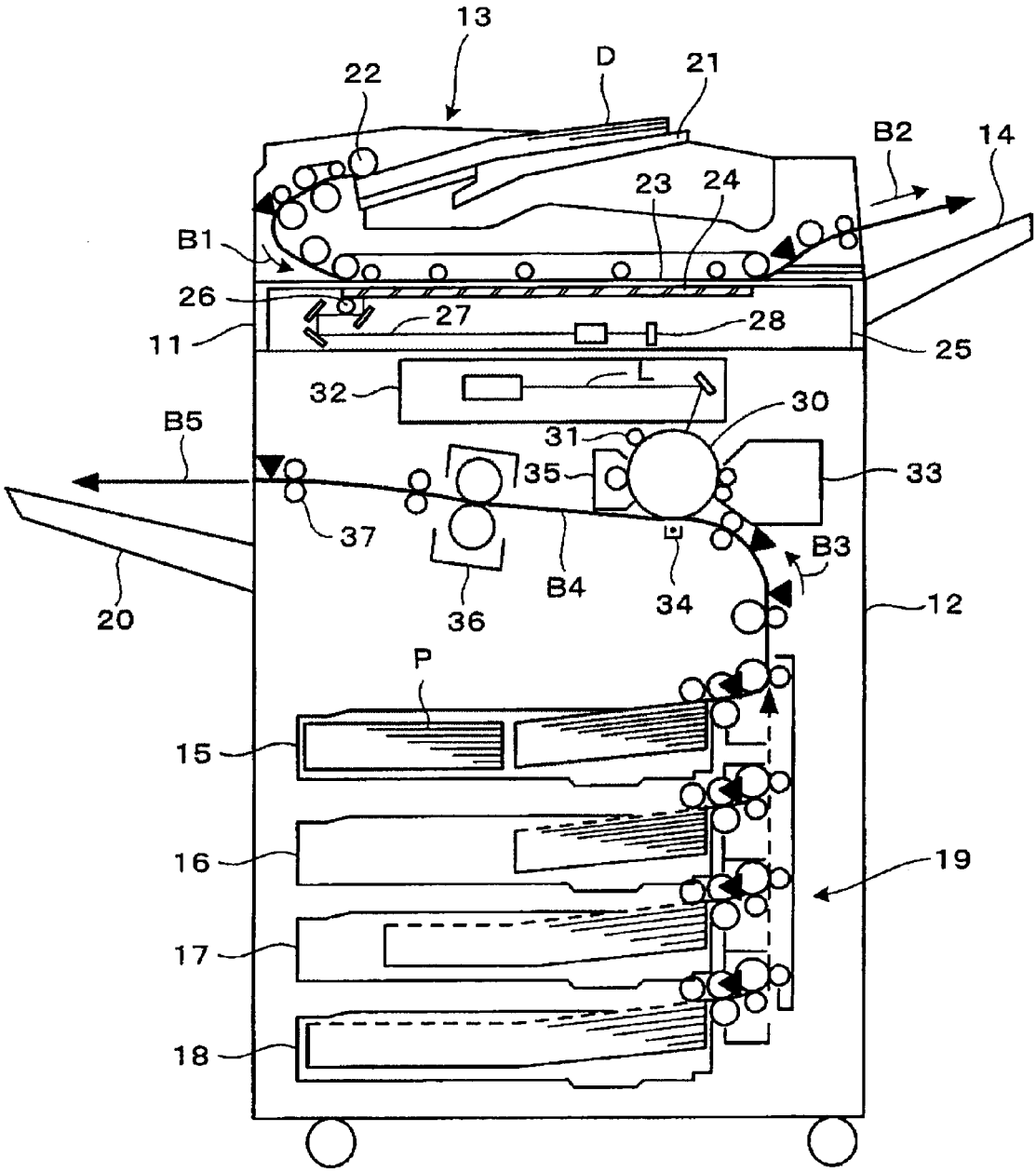
FIG. 1 is a cross sectional view conceptually showing a first embodiment of an image forming apparatus according to the present invention.

FIG. 1 is a cross sectional view conceptually showing a first embodiment of an image forming apparatus according to the present invention. In this embodiment, the image forming apparatus includes a document reading unit 11 which reads a document, an image forming unit 12 which forms an image on a recording medium (or recording sheet) P such as paper, an automatic document feeder (ADF) 13, a document eject tray 14 on which documents fed by the ADF 13 are stacked, a media supply unit 19 which is provided with media supply cassettes 15 through 18, and a media eject unit or media eject tray 20 on which recording media P are stacked. In this embodiment of the image forming apparatus, the present invention is applied to a copying machine employing the electrophotography technique. However, the present invention is similarly applicable to other image forming apparatuses such as printers, facsimile machines, and composite apparatuses having at least functions selected from a group consisting of copying functions, printer functions and facsimile functions.

When documents D are set on a document base 21 of the ADF 13 and a copy key of an operation part (not shown) is pushed, for example, the top document D is transported in a direction of an arrow B1 by the rotation of a pickup roller 22. This document D is supplied to and stops at a predetermined position on a contact glass 24 that is fixed on the image reading unit 11 by the rotation of a document transport belt 23. An image of the document D that is placed on the contact glass 24 is read by a read unit 25 that is arranged between the image forming unit 12 and the contact glass 24. The read unit 25 includes a light source 26 which illuminates the document D on the contact glass 24, an optical system 27, and a photoelectric conversion element 28 such as a charge coupled device (CCD). The photoelectric conversion element 28 receives the reflected light from the document D that is imaged thereon by the optical system 27, and the image of the document D is scanned and read by moving the light source 26 and a portion of the optical system 27, for example. After the image of the document D is read, the document D is transported in a direction of an arrow B2 by the rotation of the transport belt 23, and ejected onto the media eject tray 14. The documents D are successively supplied onto the contact glass 14 one by one, and the document image of each document D is read by the image reading unit 11.

On the other hand, a photoconductive body 30 is provided within the image forming unit 12 as an image bearing member. The photoconductive body 30 has a drum shape, for example. The photoconductive body 30 is driven by a driving unit (not shown) and is rotated clockwise in FIG. 1, and an outer peripheral surface of the photoconductive body 30 is charged to a predetermined potential by a charging unit 31. In addition, a write unit 32 irradiates a laser beam L that has been modulated depending on image information of the document image read by the read unit 25 by driving a laser light source within the write unit 32 by the image information. This laser beam L exposes the charged surface of the photoconductive body 30 so as to form an electrostatic latent image on the surface of the photoconductive body 30. The electrostatic latent image is developed into a toner image by a developing unit 33. The toner image on the surface of the photoconductive body 30 is transferred by a transfer unit 34 onto a recording medium P such as paper that is supplied between the photoconductive body 30 and the transfer unit 34. The surface of the photoconductive body 30 after the toner image transfer is cleaned by a cleaning unit 35.

The recording media P such as paper are accommodated within the media supply cassettes 15 through 18 that are arranged in a lower art of the image forming unit 12. The recording medium P is supplied in a direction of an arrow B3 by one of the media supply cassettes 15 through 18, and the toner image on the photoconductive body 30 is transferred onto the recording medium P as the recording medium P passes between the photoconductive body 30 and the transfer unit 34. The recording medium P is then passes through a fixing unit 36 within the image forming unit 12 as indicated by an arrow B4, and the toner image is fixed on the recording medium P by the heat and pressured applied from the fixing unit 36. The recording medium P which passes through the fixing unit 36 is transported by an eject roller pair 37 and is ejected in a direction of an arrow B, to be stacked on the media eject tray 20.

Figure 2:
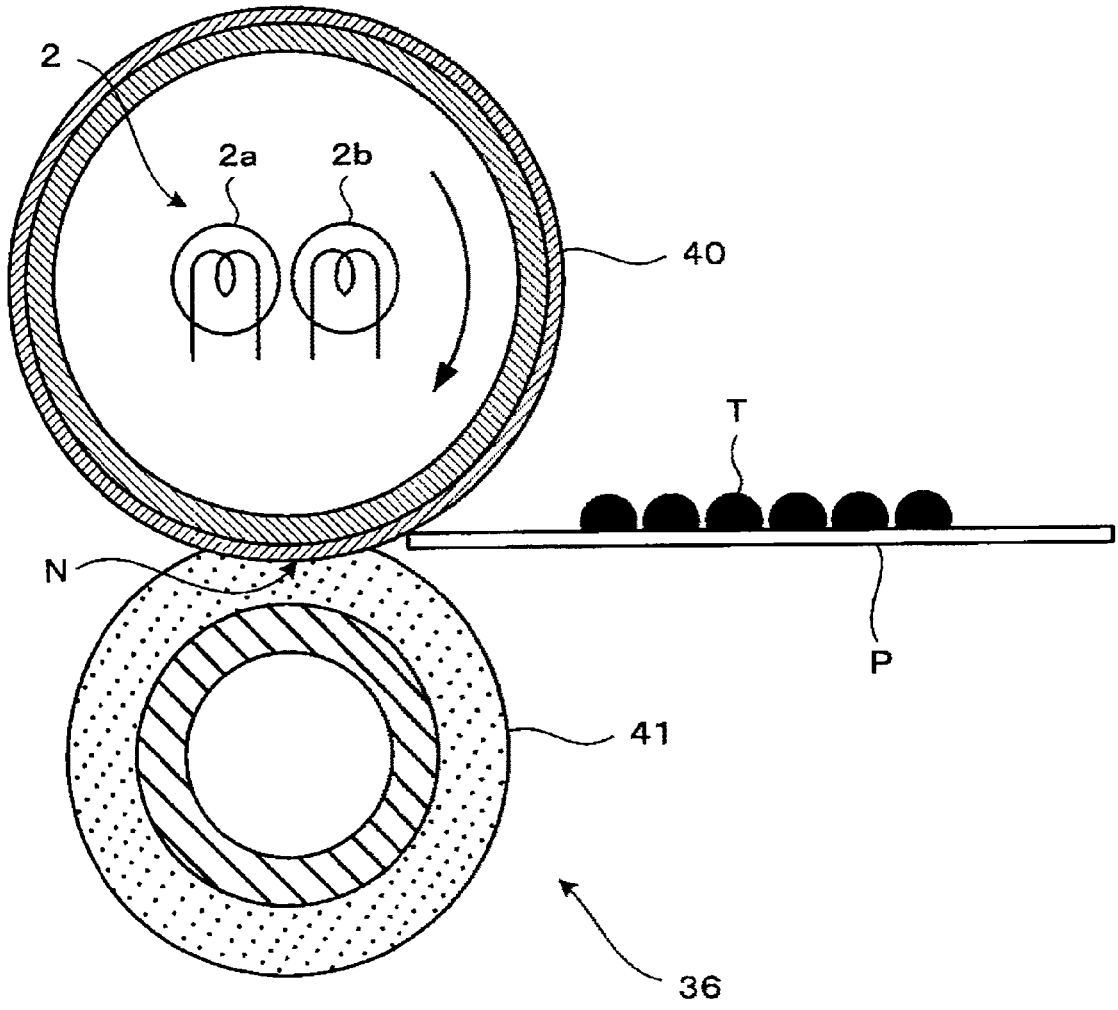
FIG. 2 is a cross sectional view conceptually showing a structure of a first embodiment of a fixing unit according to the present invention that is used in the image forming apparatus shown in FIG. 1.
Figure 3:
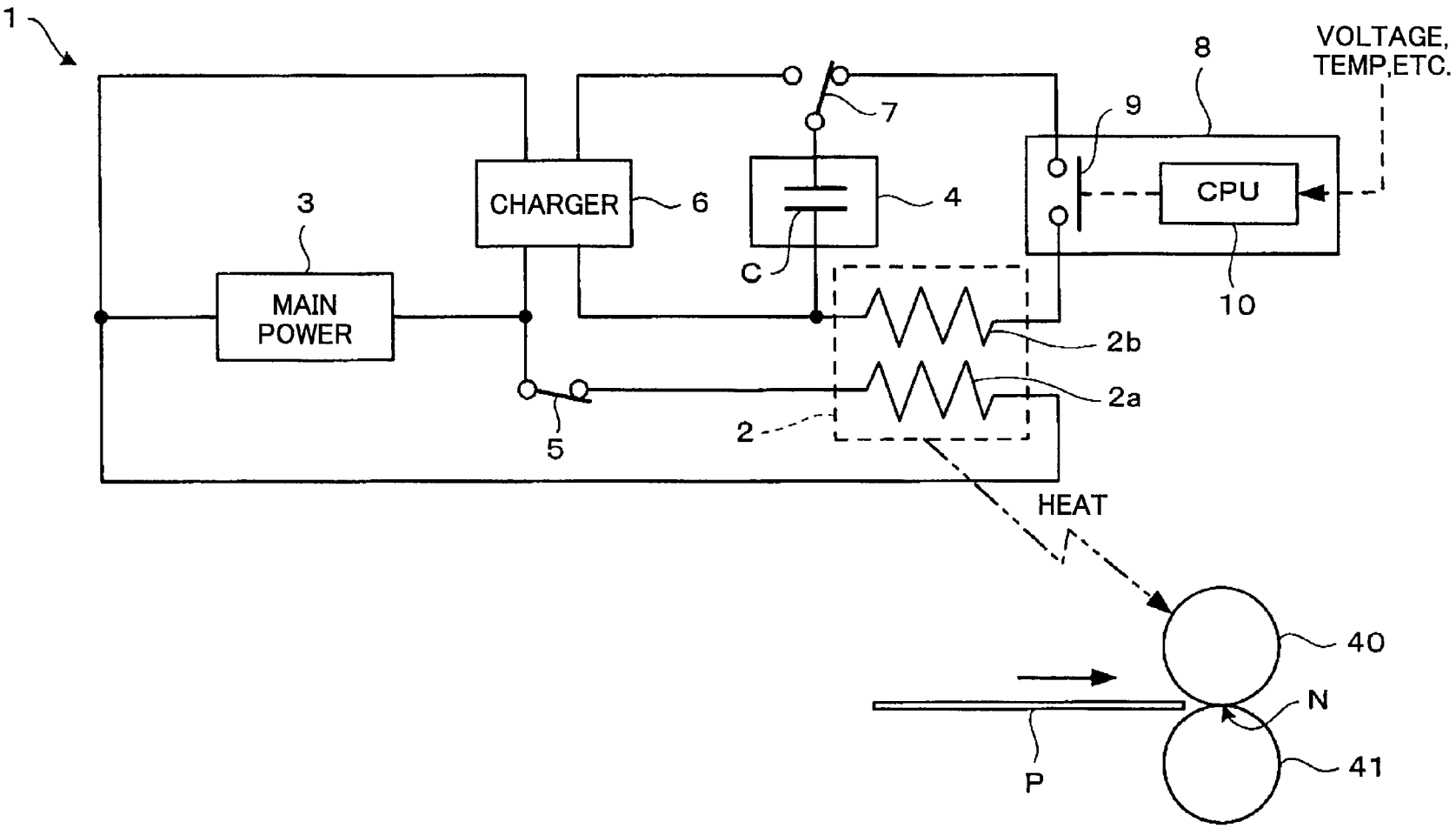
FIG. 3 is a circuit diagram showing a structure of a first embodiment of a heater according to the present invention.

FIG. 2 is a cross sectional view conceptually showing a structure of a first embodiment of a fixing unit according to the present invention that is used in the image forming apparatus shown in FIG. 1. FIG. 2 shows the fixing unit 36 which applies heat and pressure on the toner image that is transferred onto the recording medium P. In addition, FIG. 3 is a circuit diagram showing a structure of a first embodiment of a heater according to the present invention that is provided in the fixing unit 36.

The fixing unit 36 shown in FIG. 2 includes a fixing roller 40 and a pressure roller 41 which is urged to press against the fixing roller 40 by a pressure applying member or means (not shown). A heater part 2 is provided within the fixing roller 40. The heater part 2 is made up of a main heater element 2*a* and an auxiliary heater element 2*b* that are formed by halogen heaters, for example. The fixing roller 40 and the pressure roller 41 form a nip part N which applies pressure and heat on a toner T that is on the recording medium P passing between the fixing roller 40 and the pressure roller 41.

For example, in the case of a copying machine having a linear velocity of 75 cpm, the fixing roller 40 may be made of an aluminum roller having an outer diameter Ø of 40 mm and a thickness t of 0.7 mm. This thickness t of the fixing roller 40 enables the temperature of the fixing roller 40 to be raised within 30 seconds to a temperature capable of carrying out a fixing process, and also prevents the fixing roller 40 from breaking when a load or pressure necessary for forming the nip part N to carry out the fixing process is applied on the fixing roller 40. In the case of the conventional copying machine having the linear velocity of 75 cpm and not using an auxiliary power supply unit, the thickness t of the fixing roller 40 was on the order of approximately 5.0 mm to 10 mm and thick. But when the thickness t of the fixing roller 40 is small as in the case of this embodiment and an auxiliary power supply unit 4 shown in FIG. 3 is used as will be described hereunder, it becomes possible to considerably shorten the time required to raise the temperature of the fixing roller 40 to the temperature capable of carrying out the fixing process.

A separation or release layer made of FPA, PTFE or the like is desirably provided on an outermost layer of the fixing roller 40.

The heater 1 of this embodiment shown in FIG. 3 includes the heater part 2, a main power supply unit 3, the auxiliary power supply unit 4, a main switch 5, a charger 6, a switching unit 7 and a controller 8. In FIG. 3, the heater part 2 made up of the main heater element 2*a* and the auxiliary heater element 2*b* is illustrated outside the fixing roller 40 for the sake of convenience, but the heater elements 2*a* and 2*b* are actually provided within the fixing roller 40 as described above in conjunction with FIG. 2.

In the heater part 2, the main heater element 2*a* generates heat by being supplied with the power from the main power supply unit 3, and the auxiliary heater element 2*b* generates heat by being supplied with the power from the auxiliary power supply unit 4. The fixing roller 40 is heated by these heater elements 2*a* and 2*b*. The main power supply unit 3 receives the power supplied from a commercial power supply within the image forming apparatus in which the heater 1 is provided. The main power supply unit 3 has a function of adjusting the power supplied from an electric outlet into a voltage suited for the heater part 2, for example, but a power supply unit having such a function is known and an illustration and description thereof will be omitted.

The auxiliary power supply unit 4 includes a chargeable and dischargeable capacitor C. The capacitor C desirably has a module structure for obtaining a predetermined rated voltage and capacitance by connecting in series 15 to 40 cells having a rated voltage of 2.5 V and an electrostatic capacitance on the order of approximately 400 F to approximately 1000 F. Furthermore, in order to prevent the fixing temperature from decreasing when the recording media P are successively supplied, the capacitor C desirably has a module structure in which 18 to 22 cells having an electrostatic capacitance on the order of approximately 500 F to approximately 700 F are connected in series for use with the auxiliary heater element 2*b* having a rated power of approximately 300 W to approximately 600 W. The capacitor C having such module structures have a capacitance that is sufficient for making a power supply for approximately 1 minute to approximately 2 minutes. In addition, even when all of the stored power is supplied from the capacitor C in a high temperature state due to runaway of a control system, the power decreases as the voltage decreases and the danger of fire is positively suppressed. Moreover, the danger of electrification is also suppressed because the voltage is on the order of approximately 50 V for the capacitor C.

For the purpose of supplying power to the heater part 2 at the time of starting the heater 1, the capacitor C desirably has a module structure in which 36 to 44 cells having an electrostatic capacitance on the order of approximately 500 F to approximately 700 F are connected in series since the auxiliary heater element 2*b* having a rated power of approximately 800 W to approximately 1000 W is connected in parallel to the auxiliary power supply unit 4 to supply a total power on the order of approximately 1600 W to approximately 2000 W. The capacitor C having such a module structure has a capacitance that is sufficient for making a power supply for approximately 10 seconds. In addition, even when the mode of the image forming apparatus changes to the mode in which the recording media P are successively supplied, it is possible to present the fixing temperature from decreasing by using only one of the heater elements 2*a* and 2*b*.

In the normal operating state of the fixing unit 36, a target charging voltage of the capacitor is set lower than the rated voltage by taking into consideration the inconsistencies in a voltage circuit and the durability of the capacitor cells, so as to improve the reliability of the capacitor C. The capacitor C may have a module structure having cells with an electrostatic capacitance lower than approximately 100 F connected in parallel, however, from the point of view of reducing electronic circuits required with respect to each cell and facilitating detection of abnormal cells, it is desirable that all of the cells are connected in series.

The capacitor C desirably has the module structures described above, because capacitors such as electric double layer capacitors are superior compared to general secondary batteries in that no chemical reactions are involved, unlike secondary batteries.

As described above, the general secondary battery is formed by a nickel-cadmium battery, for example, and an auxiliary power supply unit which uses such a secondary battery requires a long time on the order of approximately several tens of minutes to several hours to charge even when a rapid charge is made. On the other hand, the auxiliary power supply unit 4 which uses the capacitor C only requires a short time on the order of several minutes to charge, and the capacitor C can be charged quickly. When the standby state and the heating state are repeated within a given time, the auxiliary power supply unit 4 using the capacitor C can positively supply the power at the time when the heater 1 is started and the temperature of the heater part 2 can be raised to the predetermined temperature within a short time, compared to the auxiliary power supply unit using the general secondary battery such as the nickel-cadmium battery.

The tolerable number of times the nickel-cadmium battery may be charged and discharged is on the order of approximately 500 times to approximately 100 times. Hence, the nickel-cadmium battery has a short serviceable life for use as the auxiliary power supply unit for the heater 1, and it would be troublesome and expensive to frequently replace the nickel-cadmium battery. On the other hand, the tolerable number of times the electric double layer capacitor may be charged and discharged is on the order of approximately several million times or greater. In addition, the deterioration of the electric double layer capacitor due to the repeated charging and discharging is small, and there is no need to supply or replace the electrolyte such as the sulfuric acid solution used by the lead battery. Therefore, the electric double layer capacitor requires virtually no maintenance, and can be used stably for a long period of time, thereby making it suitable for use as the auxiliary power supply unit 4 for the heater 1.

The electric double layer capacitor has no dielectric, and utilizes adsorption and desorption reactions (charging and discharging) of an individual electrode and an ion adsorption layer of an electric double layer where charges of solvent molecules or ions formed at a solution interface are concentrated. Hence, the electric double layer capacitor can strongly withstand repeated charging and discharging to realize a long serviceable life, and does not require maintenance. The electric double layer capacitor is also gentle on the environment, and has a short charging time compared to other types of batteries. The charging and discharging efficiency of the electric double layer capacitor is also high. In addition, it is easy to know the remaining power of the electric double layer capacitor by making a voltage detection. Because of these advantageous features of the electric double layer capacitor, electric double layer capacitors having a high electrostatic capacitance on the order of approximately several ten thousand F and an energy density on the order of approximately several tens of Wh/kg have been developed, and active research is being made to realize electric double layer capacitors with an even higher electrostatic capacitance.

The main switch 5 turns ON and OFF the supply of the power from the main power supply unit 3 to the main heater element 2*a*. The charger 6 charges the capacitor C. This charger 6 has a function of adjusting the power supplied from the main power supply unit 3 into a voltage suited for the auxiliary power supply unit 4 and rectifying the voltage from AC to DC voltage. The switching unit 7 switches between the charging of the auxiliary power supply unit 4 and the supplying of the power from the auxiliary power supply unit 4 to the auxiliary heater element 2*b*.

The controller 8 includes a switch 9 and a CPU 10, and carries out a control to turn ON and OFF the supply of the power from the auxiliary power supply unit 4 to the auxiliary heater element 2*v* depending on predetermined conditions that will be described later. Only the part of the controller 8 related to the control of the heater part 2 is shown in FIG. 3. However, the structure of the controller 8 is not limited to that shown in FIG. 3, and the controller 8 may have various other structures such as a structure which is used in common for the control of the heater part 2 and the control of the entire image forming apparatus, for example. In addition, the connection of the controller 8 for varying out the control with respect to the auxiliary power supply unit 4 is not limited to that shown in FIG. 3. For example, the controller 8 may have a structure for carrying out a control to turn the switching unit 7 ON and OFF. The controller 8 may also carry out a control to turn the main switch 5 ON and OFF based on a detection signal from a temperature sensor (not shown) which detects a surface temperature of the fixing roller 40, so as to maintain the surface temperature of the fixing roller 40 to the predetermined temperature.

Next, a description will be given of a basic operation of the heater 1. First, in the standby state where the image forming process is not carried out, the switching unit 7 is switched to connect the auxiliary power supply unit 4 to the charger 6, so that the charger charges the capacitor C of the auxiliary power supply unit 4 by the power supplied from the main power supply unit 3. The main switch 5 is turned ON and OFF so that the surface temperature of the fixing roller 40 is maintained at a standby temperature that is lower than the fixing temperature.

When generating heat in the heater part 2 by starting the heater 1, the main switch 5 is turned ON to supply the power from the main power supply unit 3 to the main heater element 2*a* via the main switch 5. At the same time, the switching unit 7 is switched to supply the power from the auxiliary power supply unit 4 to the auxiliary heater element 2*b*, so that a large power is supplied to the heater part 2. Since this large power is supplied to the heater part 2 from both the main power supply unit 3 and the auxiliary power supply unit 4, the temperature of the fixing roller 40 within the heater part 2 can be raised to the predetermined temperature within a short time.

After a predetermined time elapses from a time when the heating is started by supplying the power from the auxiliary power supply unit 4 to the auxiliary heater element 2*b* of the heater part 2, the controller 8 turns the switch 9 OFF to block the supply of the power from the auxiliary power supply unit 4 to the auxiliary heater element 2*b*, so as to prevent overheating of the heater part 2 and maintain the heater part 2 at the predetermined temperature. The power supplied from the auxiliary power supply unit 4 to the auxiliary heater element 2*b* decreases with time from the time when the supply of the power is started. If the time when the supply of the power from the auxiliary power supply unit 4 to the auxiliary heater element 2*b* is to be blocked is determined depending on the amount of decrease of the power supplied from the auxiliary power supply unit 4 with time, and the supply of the power from the auxiliary power supply unit 4 to the auxiliary heater element 2*b* is blocked when the power from the auxiliary power supply unit 4 decreases to a certain extent, it is possible to prevent deterioration of parts of peripheral circuits and electromagnetic noise that are otherwise generated when the supply is blocked in a state where large power is supplied from the auxiliary power supply unit 4.

Figure 4A:
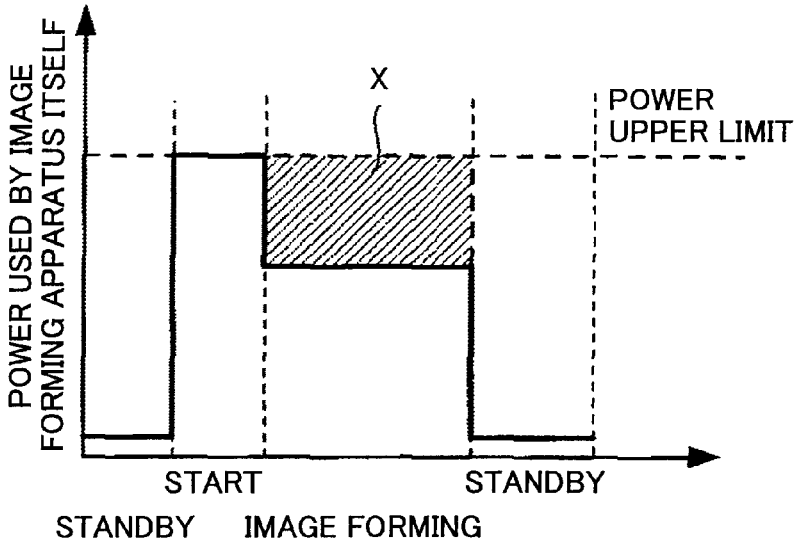
FIG. 4A is a diagram showing a change in power used by the image forming apparatus shown in FIG. 1.
Figure 4B:
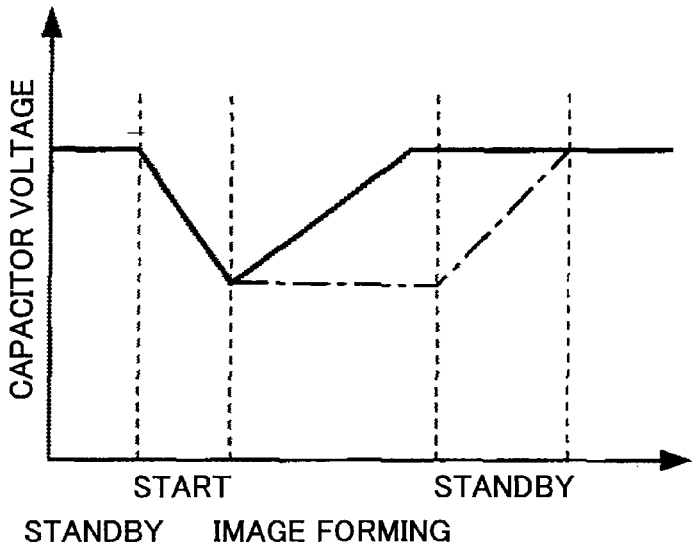
FIGS. 4B and 4C are diagrams showing voltage changes of a capacitor.
Figure 4C:
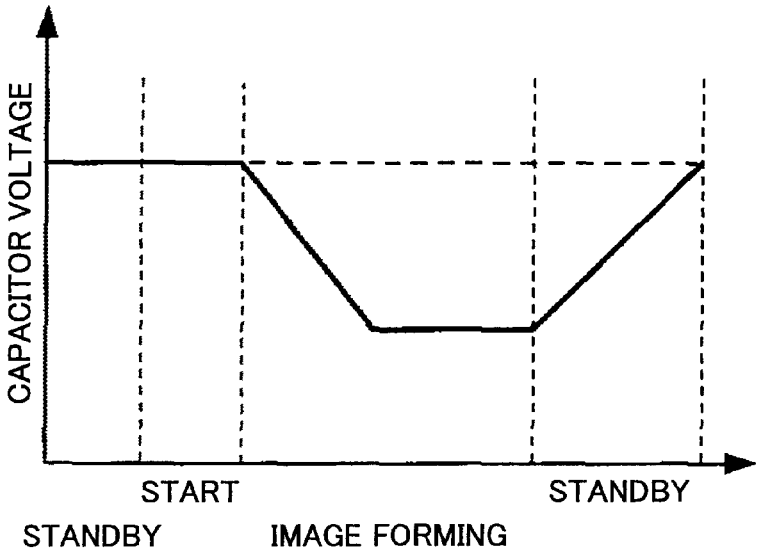

FIG. 4A is a diagram showing a change in power used by the image forming apparatus shown in FIG. 1, and FIGS. 4B and 4C are diagrams showing voltage changes of the capacitor C. In the standby state, the image forming apparatus does not consume much power. However, when the image forming process is started, the power used increases to an upper limit value. The power used by the image forming apparatus decreases slightly from the upper limit value while the image forming process is being carried out, and the image forming apparatus thereafter returns to the standby state after the image forming process is carried out. Generally, there is a power margin, that is, surplus power, while the image forming process is being carried out, as indicated by "X" in FIG. 4A. Hence, the capacitor C of the auxiliary power supply unit 4 is charged by using this surplus power. An output voltage of the capacitor C shows a maximum value in the standby state, and decreases when starting the heater 1 due to the power supplied to the heater part 2 in order to heat the fixing roller 40. While the image forming process is carried out, the capacitor C is charged, and the output voltage of the capacitor C thus returns to the original voltage at the time of the standby state.

In FIG. 4B, a solid line indicates the output voltage of the capacitor C when the auxiliary power supply unit 4 is charged during the image forming process, and a one-dot chain line indicates the output voltage of the capacitor when the auxiliary power supply unit 4 is charged immediately after the image forming process. Generally, the auxiliary power supply unit 4 is charged immediately after the image forming process, because if the charging of the capacitor C is not completed when an image forming process is started immediately after the previous image forming process, the cpm (copying speed) deteriorates and a charge waiting time is generated to thereby deteriorate the functions of the image forming apparatus as a whole. In other words, when the supply of the power from the auxiliary power supply unit 4 to the auxiliary heater element 2*b* is blocked, the auxiliary power supply unit 4 is in an insufficiently charged state. Hence, when the temperature of the fixing roller 40 or the heater part 2 is stable and the power consumption is relatively small, the switching unit 7 is switched to connect the auxiliary power supply unit 4 to the charger 6, so as to charge the auxiliary power supply unit 4 by the power supplied from the main power supply unit 3. If a large power needs to be supplied to the heater part 2 again, a large amount of energy is supplied to the heater part 2 by supplying not only the power from the main power supply unit 3 but also the power from the auxiliary power supply unit 4 to the heater part 2.

FIG. 4C shows the output voltage of the capacitor C for a case where the capacitor C is used for the purpose of preventing the surface temperature of the fixing roller 40 from decreasing due to the lack of power supplied to the heater part 2 when the recording media P are successively supplied to the fixing unit 36. Generally, the entire image forming apparatus is cold immediately after it is started, and the power tends to lack. Hence, when the recording media P are successively supplied to the fixing unit 36, the switching unit 7 is switched to connect the auxiliary power supply unit 4 to the auxiliary heater element 2*b*, so as to supply the power from the capacitor C to the auxiliary heater element 2*b* of the heater part 2. As a result, it is possible to prevent the cpm (copying speed) from deteriorating or the copying (image forming process) from being stopped until the surface temperature of the fixing roller 40 returns to the predetermined fixing temperature while the recording media P are successively supplied to the fixing unit 36, which would otherwise deteriorate the productivity.

Figure 5:
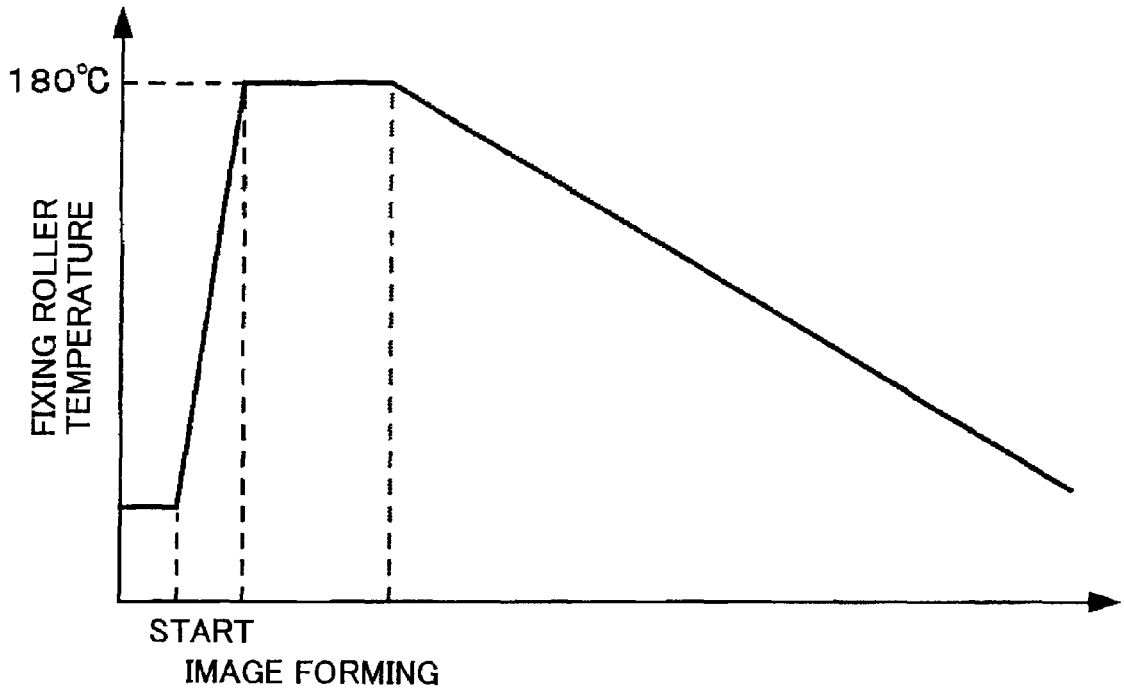
FIG. 5 is a diagram showing a temperature change of a fixing roller.

FIG. 5 is a diagram showing a temperature change of the fixing roller 40. The surface temperature of the fixing roller 40 is low in the standby state, and rises to the predetermined fixing temperature when the heater 1 is started due to the heat generated by both the main and auxiliary heater elements 2*a* and 2*b*, as described above. FIG. 5 shows a case where the predetermined fixing temperature is 180° C. During the image forming process, the surface temperature of the fixing roller 40 is maintained approximately to the predetermined fixing temperature, and gradually decreases after the image forming process ends. Depending on environmental conditions of the image forming apparatus, the surface temperature of the fixing roller 40 decreases to room temperature (temperature of a site where the image forming apparatus is set up) or to a temperature inside the image forming apparatus.

When using the capacitor C in the above described structure, in most cases, a PID control or the like is employed to control the operation of the heater 1, that is, both the main and auxiliary power supply units 3 and 4 are driven and controlled. But depending on the control that is employed, the auxiliary heater element 2*b* may mainly bear the burden of heating of the fixing roller 40.

Figure 6:
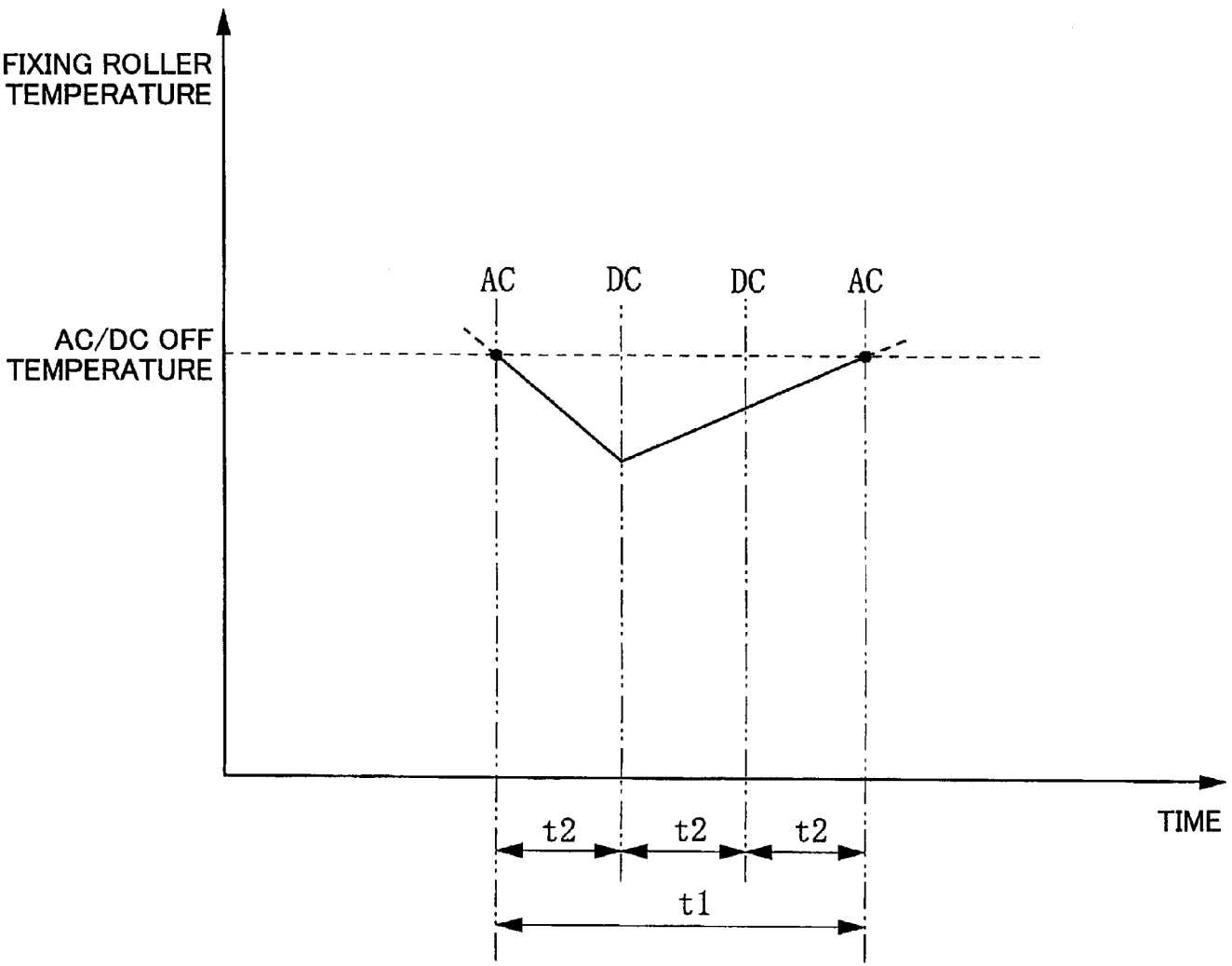
FIG. 6 is a diagram showing a relationship of a control of power supply from a main power supply unit to a main heater element and a control of power supply from an auxiliary power supply unit to an auxiliary heater element.

FIG. 6 is a diagram showing a relationship of the control of the power supply from the main power supply unit 3 to the main heater element 2*a* and the control of the power supply from the auxiliary power supply unit 4 to the auxiliary heater element 2*b*. In FIG. 6, it is assumed, for example, that a sampling time of the control of the power supply from the main power supply unit 3 to the main heater element 2*a* is 1 second (t1: between AC and AC), a sampling time of the control of the power supply from the auxiliary power supply unit 4 to the auxiliary heater element 2*b* is 0.3 second or ⅓ second to be more accurate (t2: between AC and DC, between DC and DC, and between DC and AC), the surface temperature of the fixing roller 40 reaches the predetermined fixing temperature by first supplying the power from the main power supply unit 3 to the main heater element 2*a*, and the heat is thereafter not applied to the fixing roller 40. In this case, the surface temperature of the fixing roller 40 begins to decrease. In addition, until the next sampling time of the control of the power supply from the main power supply unit 3 that occurs after 1 second, no power is supplied to the main heater element 2*a* and no heat is applied from the main heater element 2*a* to the fixing roller 40. In this state, the sampling time of the control of the power supply from the auxiliary power supply unit 4 to the auxiliary heater element 2*b* occurs after 0.3 second, and if the surface temperature of the fixing roller 40 has decreased to a certain temperature, the capacitor C of the auxiliary power supply unit 4 discharges to supply the power to the auxiliary heater element 2*b*, and a similar heat applying process may further be carried out after another 0.3 second. In this case, when the next sampling time of the control of the power supply from the main power supply unit 3 to the main heater element 2*a* occurs after 1 second, the surface temperature of the fixing roller 40 may have returned to the predetermined fixing temperature that is indicated as an "AC/DC OFF temperature" in FIG. 6, and it may be judged unnecessary to apply the heat from the main heater element 2*a* to the fixing roller 40. If such a situation occurs repeatedly, the main power supply unit 3 and the main heater element 2*a*, which should mainly operate originally, may remain OFF, and instead, only the auxiliary power supply unit 4 and the auxiliary heater element 2*b* may contribute to the heating and the temperature maintenance of the fixing roller 40. But if the surface temperature of the fixing roller 40 is mainly controlled by the auxiliary power supply unit 4 and the auxiliary heater element 2*b*, the wear or deterioration of the capacitor C is accelerated to thereby shorten the serviceable life of the auxiliary power supply unit 4. Even if the electric double layer capacitor having the relatively long serviceable life is used for the auxiliary power supply unit 4, the shortening of the serviceable life of the auxiliary power supply unit 4 cannot be avoided in this situation.

Therefore, in this embodiment, if it can be judged that the decrease in the surface temperature of the fixing roller 40 is tolerably small or zero when the recording medium P is supplied to the fixing unit 36 and the use of the capacitor C is not required, the operation of supplying the power from the main power supply unit 3 to the main heater element 2*a* and the operation of supplying the power from the auxiliary power supply unit 4 to the auxiliary heater element 2*b* are linked based on information that is related to the heater 1 (or heater part 2), so as to minimize the use of the capacitor C and thus prevent premature wear or deterioration of the capacitor C.

First Modification of First Embodiment

In a first modification of the first embodiment, the amount of power supplied from the main power supply unit 3 is used for the information that is related to the heater 1 (or heater part 2), as the conditions used to vary the amount of power supplied from the capacitor C. A known detecting unit or means (not shown) may be used to detect the amount of power supplied from the main power supply unit 3. In this case, the controller 8 varies the amount of power supplied from the capacitor C per unit time depending on the change in the detected amount of power supplied from the main power supply unit 3, where the unit time is an arbitrary length of time.

More particularly, it is judged that the decrease in the surface temperature of the fixing roller 40 is tolerably small or zero if the main heater element 2*a* is not constantly turned ON, and the ON time (or a ratio or percentage of the ON time with respect to the OFF time) of the auxiliary heater element 2*b* is varied so as to reduce the amount of power used from the capacitor C. For example, if the amount of power supplied from the main power supply unit 3 per unit time is smaller than a predetermined value, the controller 8 functions as an amount varying unit or means for reducing the amount of power supplied from the auxiliary power supply unit 4 per unit time. For example, the amount of power supplied from the auxiliary power supply unit 4 per unit time may be reduced by reducing the ON time of the auxiliary heater element 2*b*. Hence, when the operation of the main power supply unit 3, formed by the AC power supply, is stopped, the auxiliary power supply unit 4, formed by the DC power supply, is prevented from operating and discharging the capacitor C to turn ON the auxiliary heater element 2*b*. In addition, when the discharge of the capacitor C is suppressed, it is possible to shorten the charging time of the capacitor C.

In order to vary the ON time of the auxiliary heater element 2*b*, it is possible to make the ON time controllable in DC by subjecting the discharge power from the capacitor C to a DC-to-AC conversion or by use of a switching element. Various known control methods, such as a PWM control, may be used to control the ON time of the auxiliary heater element 2*b*. Moreover, such control methods may be employed regardless of whether the main power supply unit 3 is formed by an AC power supply or a DC power supply. Furthermore, the predetermined value which is used as a threshold value for determining whether or not to reduce the amount of power supplied from the auxiliary power supply unit 4 per unit time may be appropriately determined based on experiments or the like. Predetermined values used similarly as threshold values in the subsequent modifications of the first embodiment may also be determined appropriately based on experiments or the like.

Similarly, the amount of power supplied to the main power supply unit 3 from the commercial power supply may be used for the information that is related to the heater 1 (or heater part 2), as the conditions used to vary the amount of power supplied from the capacitor C.

Second Modification of First Embodiment

In a second modification of the first embodiment, the voltage supplied from the main power supply unit 3 is used for the information that is related to the heater 1 (or heater part 2), as the conditions used to vary the amount of power supplied from the capacitor C. A known detecting unit or means (not shown) may be used to detect the voltage supplied from the main power supply unit 3. In this case, the controller 8 varies the amount of power supplied from the capacitor C per unit time depending on the change in the detected voltage supplied from the main power supply unit 3, where the unit time is an arbitrary length of time.

For example, if the voltage supplied from the main power supply unit 3 is higher than a predetermined value, the controller 8 functions as an amount varying unit or means for reducing the amount of power supplied from the auxiliary power supply unit 4 per unit time. If the voltage supplied from the main power supply unit 3 is higher than the predetermined value, it may be judged that a large mount of power is supplied from the main power supply unit 3. In this case, the amount of power supplied to the auxiliary heater element 2*b* by discharging the capacitor C may be small. Hence, the ON time of the auxiliary heater element 2*b* is reduced in this case, so as to suppress the discharge of the capacitor C and to shorten the charging time of the capacitor C.

If the voltage supplied from the main power supply unit 3 is lower than or equal to the predetermined value, the amount of power supplied from the capacitor C per unit time is increased. If the voltage supplied from the main power supply unit 3 is lower than or equal to the predetermined value, it may be judged that a small amount of power is supplied from the main power supply unit 3. Accordingly, the ON time of the auxiliary heater element 2*b* by the discharge of the capacitor C is increased in this case, so as to sufficiently raise the surface temperature of the fixing roller 40. Otherwise, an incomplete fixing of the image may occur at the fixing unit 36.

Similarly, an input voltage that is input to the main power supply unit 3 from the commercial power supply may be used for the information that is related to the heater 1 (or heater part 2), as the conditions used to vary the amount of power supplied from the capacitor C.

Third Modification of First Embodiment

In a third modification of the first embodiment, the temperature of the pressure roller 41 which functions as a pressure applying member with respect to the fixing roller 40 is used for the information that is related to the heater 1 (or heater part 2), as the conditions used to vary the amount of power supplied from the capacitor C. A known temperature sensor or temperature detecting means (not shown) may be used to detect the temperature of the pressure roller 41. In this case, the controller 8 varies the amount of power supplied from the capacitor C per unit time depending on the change in the detected temperature of the pressure roller 41, where the unit time is an arbitrary length of time.

For example, if the temperature of the pressure roller 41 is higher than a predetermined value, the controller 8 functions as an amount varying unit or means for reducing the amount of power supplied from the auxiliary power supply unit 4 per unit time. For example, when the recording media P are successively supplied in the image forming apparatus and the image forming process is carried out continuously, the temperature of the pressure roller 41 remains sufficiently high. In this case, the amount of heat absorbed from the fixing roller 40 by the pressure roller 41 is small, and thus, the amount of power supplied to the auxiliary heater element 2*b* by the discharge of the capacitor C may be small. Hence, the ON time of the auxiliary heater element 2*b* is reduced in this case, so as to suppress the discharge of the capacitor C and to shorten the charging time of the capacitor C.

If the temperature of the pressure roller 41 is lower than or equal to the predetermined value, the amount of power supplied from the capacitor C per unit time is increased. If the temperature of the pressure roller 41 is lower than or equal to the predetermined value, the heat of the fixing roller 40 will be absorbed by the pressure roller 41 to raise the temperature of the pressure roller 41 unless the amount of power supplied to the auxiliary heater element 2*b* by the discharge of the capacitor C is increased. Accordingly, the ON time of the auxiliary heater element 2*b* by the discharge of the capacitor C is increased in this case, so as to sufficiently raise the surface temperature of the fixing roller 40. Otherwise, an incomplete fixing of the image may occur at the fixing unit 36.

Fourth Modification of First Embodiment

In a fourth modification of the first embodiment, the environment temperature is used for the information that is related to the heater 1 (or heater part 2), as the conditions used to vary the amount of power supplied from the capacitor C. The environment temperature may be the temperature of the heater 1, the temperature of the fixing unit 36 or the temperature of the image forming apparatus. For example, a nip temperature of the nip part N between the fixing roller 40 and the pressure roller 41 may be used as the environment temperature. In a case where it is difficult to measure the nip temperature, the environment temperature may be selected from the internal or external temperature of the heater 1, the internal or external temperature of the fixing unit 36, and the internal or external temperature of the image forming apparatus. In other words, any temperature information which affects (or is believed to affect) the fixing of the image in the fixing unit 36 may be used as the environment temperature. A known temperature sensor or temperature detecting means (not shown) may be used to detect the environment temperature. In this case, the controller 8 varies the amount of power supplied from the capacitor C per unit time depending on the change in the detected environment temperature, where the unit time is an arbitrary length of time.

For example, if the environment temperature is higher than a predetermined value, the controller 8 functions as an amount varying unit or means for reducing the amount of power supplied from the auxiliary power supply unit 4 per unit time. Hence, the ON time of the auxiliary heater element 2*b* is reduced in this case, so as to suppress the discharge of the capacitor C and to shorten the charging time of the capacitor C.

If the environment temperature is lower than or equal to the predetermined value, the amount of power supplied from the capacitor C per unit time is increased. If the environment temperature is lower than or equal to the predetermined value, the surface temperature of the fixing roller 40 will be lower than the predetermined fixing temperature unless the amount of power supplied to the auxiliary heater element 2*b* by the discharge of the capacitor C is increased. Accordingly, the ON time of the auxiliary heater element 2*b* by the discharge of the capacitor C is increased in this case, so as to sufficiently raise the surface temperature of the fixing roller 40. Otherwise, an incomplete fixing of the image may occur at the fixing unit 36.

Fifth Modification of First Embodiment

In a fifth modification of the first embodiment, the number of recording media P that passed through the fixing unit 36 during a previous job is used for the information that is related to the heater 1 (or heater part 2), as the conditions used to vary the amount of power supplied from the capacitor C. A known counter or counting means (not shown) may be used to count the number of recording media P that passed through the fixing unit 36 during the previous job. In this case, the controller 8 varies the amount of power supplied from the capacitor C per unit time depending on the counted number of recording media P for the previous job, where the unit time is an arbitrary length of time.

For example, if the number of recording media P for the previous job is higher than a predetermined value, the controller 8 functions as an amount varying unit or means for reducing the amount of power supplied from the auxiliary power supply unit 4 per unit time. In other words, if the number of recording media P for the previous job is high, the temperature of the pressure roller 41 remains sufficiently high. In this case, the amount of heat absorbed from the fixing roller 40 by the pressure roller 41 is small, and thus, the amount of power supplied to the auxiliary heater element 2*b* by the discharge of the capacitor C may be small. Hence, the ON time of the auxiliary heater element 2*b* is reduced in this case, so as to suppress the discharge of the capacitor C and to shorten the charging time of the capacitor C, similarly to the third modification of the first embodiment described above.

If the number of recording media P for the previous job is lower than or equal to the predetermined value, the amount of power supplied from the capacitor C per unit time is increased. If the number of recording media P for the previous job is lower than or equal to the predetermined value, the temperature of the pressure roller 41 will be low, and the heat of the fixing roller 40 will be absorbed by the pressure roller 41 to raise the temperature of the pressure roller 41 unless the amount of power supplied to the auxiliary heater element 2*b* by the discharge of the capacitor C is increased. Accordingly, the ON time of the auxiliary heater element 2*b* by the discharge of the capacitor C is increased in this case, so as to sufficiently raise the surface temperature of the fixing roller 40. Otherwise, an incomplete fixing of the image may occur at the fixing unit 36.

Of course, the number of recording media P subjected to the image forming process during the previous job may be used in place of the number of recording media P that passed through the fixing unit 36 during the previous job.

Sixth Modification of First Embodiment

In a sixth modification of the first embodiment, the time interval between a previous job and a present job is used for the information that is related to the heater 1 (or heater part 2), as the conditions used to vary the amount of power supplied from the capacitor C. A known timer or time measuring means (not shown) may be used to measure the time interval between the previous job and the present job. In this case, the controller 8 varies the amount of power supplied from the capacitor C per unit time depending on the time interval between the previous job and the present job, where the unit time is an arbitrary length of time.

For example, if the time interval between the previous job and the present job is shorter than a predetermined value, the controller 8 functions as an amount varying unit or means for reducing the amount of power supplied from the auxiliary power supply unit 4 per unit time. In other words, if the time interval between the previous job and the present job is short, the temperature of the pressure roller 41 remains sufficiently high. In this case, the amount of heat absorbed from the fixing roller 40 by the pressure roller 41 is small, and thus, the amount of power supplied to the auxiliary heater element 2*b* by the discharge of the capacitor C may be small. Hence, the ON time of the auxiliary heater element 2*b* is reduced in this case, so as to suppress the discharge of the capacitor C and to shorten the charging time of the capacitor C, similarly to the third modification of the first embodiment described above.

If the time interval between the previous job and the present job is longer than or equal to the predetermined value, the amount of power supplied from the capacitor C per unit time is increased. If the time interval between the previous job and the present job is longer than or equal to the predetermined value, the temperature of the pressure roller 41 will be low, and the heat of the fixing roller 40 will be absorbed by the pressure roller 41 to raise the temperature of the pressure roller 41 unless the amount of power supplied to the auxiliary heater element 2*b* by the discharge of the capacitor C is increased. Accordingly, the ON time of the auxiliary heater element 2*b* by the discharge of the capacitor C is increased in this case, so as to sufficiently raise the surface temperature of the fixing roller 40. Otherwise, an incomplete fixing of the image may occur at the fixing unit 36.

Seventh Modification of First Embodiment

In a seventh modification of the first embodiment, the work time of a previous job is used for the information that is related to the heater 1 (or heater part 2), as the conditions used to vary the amount of power supplied from the capacitor C. A known timer or time measuring means (not shown) may be used to measure the work time of the previous job. In this case, the controller 8 varies the amount of power supplied from the capacitor C per unit time depending on the work time of the previous job, where the unit time is an arbitrary length of time.

For example, if the work time of the previous job is longer than a predetermined value, the controller 8 functions as an amount varying unit or means for reducing the amount of power supplied from the auxiliary power supply unit 4 per unit time. In other words, if the work time of the previous job is long, the temperature of the pressure roller 41 remains sufficiently high. In this case, the amount of heat absorbed from the fixing roller 40 by the pressure roller 41 is small, and thus, the amount of power supplied to the auxiliary heater element 2*b* by the discharge of the capacitor C may be small. Hence, the ON time of the auxiliary heater element 2*b* is reduced in this case, so as to suppress the discharge of the capacitor C and to shorten the charging time of the capacitor C, similarly to the third modification of the first embodiment described above.

If the work time of the previous job is shorter than or equal to the predetermined value, the amount of power supplied from the capacitor C per unit time is increased. If the work time of the previous job is shorter than or equal to the predetermined value, the temperature of the pressure roller 41 will be low, and the heat of the fixing roller 40 will be absorbed by the pressure roller 41 to raise the temperature of the pressure roller 41 unless the amount of power supplied to the auxiliary heater element 2*b* by the discharge of the capacitor C is increased. Accordingly, the ON time of the auxiliary heater element 2*b* by the discharge of the capacitor C is increased in this case, so as to sufficiently raise the surface temperature of the fixing roller 40. Otherwise, an incomplete fixing of the image may occur at the fixing unit 36.

Of course, two or more of the first through seventh modifications of the first embodiment may be appropriately combined to suit the needs if necessary.

In the first embodiment and the modifications thereof, the controller 8 of the heater 1 variably controls the amount of power supplied from the capacitor C. However, a control unit or means for variably controlling the amount of power supplied from the capacitor C is not limited to such, and may be provided in the fixing unit 36 or in the image forming apparatus, for example. In addition, a control unit or means used to control other functions may be used in common for the purposes of variably controlling the amount of power supplied from the capacitor C.

Moreover, the nip part N in the first embodiment and the modifications thereof is formed by the two rollers, namely, the fixing roller 40 and the pressure roller 41, but nip part N used by the fixing unit 36 and the image forming apparatus is not limited to such. For example, the nip part N may be made by a roller and an endless belt or, by two belts. Furthermore, the recording medium P may make sliding contact with the heated fixing part such as the fixing roller 40 or pass close to the heated fixing part. The main and auxiliary heater elements 2*a* and 2*b* are also not limited to the halogen lamps, and other suitable elements for generating heat may be used, such as a ceramic heater element and an induction heater element. Moreover, it is not essential for the main and auxiliary heater elements 2*a* and 2*b* to be formed by separate or independent elements, and the main and auxiliary heater elements 2*a* and 2*b* may be formed by a single element as long as it is possible to independently supply the power from the main power supply unit 3 and power from the auxiliary power supply unit 4 to the single heater element forming the main and auxiliary heater elements 2*a* and 2*b*.

The image forming apparatus is of course not limited to that shown in FIG. 1, and the photoconductive body may have a belt shape in place of the drum shape. The image forming apparatus may also be a color image forming apparatus which uses a so-called intermediate transfer belt.

The auxiliary power supply unit 4 is also not limited to that using the capacitor C, and may use a secondary battery. The effects of the present invention obtainable by the first embodiment and the modifications thereof are also obtainable in the case of the auxiliary power supply unit 4 that uses the secondary battery. In the case where the auxiliary power supply unit 4 uses a device, such as the secondary battery, having an output voltage that is approximately constant, the ordinate in FIGS. 4B and 4C will correspond to a remaining battery level and not the capacitor voltage.

Second Embodiment

As described above, the surface temperature of the fixing roller in the standby state needs to be set to a low temperature from the point of view of reducing the power consumption. In addition, from the point of view of reducing the waiting time that is required for the surface temperature of the fixing roller to reach the predetermined fixing temperature from the standby state, it is necessary to reduce the heat capacity of the fixing roller.

However, compared to the fixing roller having a large heat capacity, the surface temperature of the fixing roller having a small heat capacity drops rapidly when the heat of the fixing roller is absorbed by the recording medium and the toner when fixing the toner image transferred on the recording medium. For this reason, the surface temperature of the fixing roller having the small heat capacity becomes lower than the lower limit of the fixing temperature, and an incomplete fixing easily occurs.

Hence, in order to prevent the surface temperature of the fixing roller from rapidly dropping, both the power from the main power supply unit and the power from the auxiliary power supply unit may be supplied to the heater of the fixing roller. The auxiliary power supply unit may use a capacitor. Conventionally, the capacitor of such an auxiliary power supply unit is discharged when fully charged, that is, when the capacitor is charged to a predetermined discharge startable (or permittable) value or greater.

But when starting of the discharge of the capacitor is only permitted when the capacitor of the auxiliary power supply unit is fully charged, it may take a long charging time for the capacitor to be fully charged before the image forming process is started. In other words, if the capacitor is only charged to a value less than the predetermined discharge startable value after the capacitor discharges and the image forming process ends, the capacitor must first be fully charged before the next image forming process, which thereby introduces a waiting time corresponding to the charging time before this next image forming process may be carried out.

It is conceivable to permit the starting of the discharge of the capacitor of the auxiliary power supply unit even if the capacitor is only charged to the value less than the predetermined discharge startable value, so as to eliminate the charging time of the capacitor and avoid the waiting time that would otherwise be necessary before the next image forming process. But in this conceivable case, when the discharge of the capacitor starts from a state where the capacitor is not fully charged, the voltage supplied from the capacitor becomes lower than the voltage supplied in the fully charged state of the capacitor. For this reason, particularly when the voltage supplied from the main power supply unit is low and/or the environment temperature inside or outside the image forming apparatus is relatively low, the surface temperature of the fixing roller drops rapidly below the lower limit of the fixing temperature, to thereby cause an incomplete fixing of the image to occur at the fixing unit.

A second embodiment of the present invention is designed to suppress the above described problems of the conventional and conceivable image forming apparatuses. The second embodiment of the image forming apparatus, the second embodiment of the heater and the second embodiment of the fixing unit may have basic structures that are the same as those of the first embodiment described above in conjunction with FIGS. 1 through 5, and an illustration and description thereof will be omitted.

A description will be given of a basic operation of the heater 1 in this second embodiment. First, in the standby state where the image forming process is not carried out, the switching unit 7 shown in FIG. 3 is switched to connect the auxiliary power supply unit 4 to the charger 6, so that the charger charges the capacitor C of the auxiliary power supply unit 4 to a voltage (or power) that is greater than or equal to a first value from which the discharging of the capacitor C is permitted (hereinafter simply referred to as a first dischargeable value) by the power supplied from the main power supply unit 3. The main switch 5 is turned ON and OFF so that the surface temperature of the fixing roller 40 is maintained at a standby temperature that is lower than the fixing temperature.

When generating heat in the heater part 2 by starting the heater 1, the main switch 5 is turned ON to supply the power from the main power supply unit 3 to the main heater element 2*a* via the main switch 5. At the same time, if the voltage (or power) from the auxiliary power supply unit 4 is greater than or equal to the first dischargeable value, the switching unit 7 is switched to supply the power from the auxiliary power supply unit 4 to the auxiliary heater element 2*b*, so that a large power is supplied to the heater part 2. Since this large power is supplied to the heater part 2 from both the main power supply unit 3 and the auxiliary power supply unit 4, the temperature of the fixing roller 40 within the heater part 2 can be raised to the predetermined temperature within a short time.

When the capacitor C is discharged to the voltage at which the discharging stops, it is of course necessary to charge the capacitor C to prepare for the next discharge. In addition, when the image forming apparatus is not used for a long time, the voltage of the capacitor C decreases due to natural discharge, and it may take time to start the image forming process in such a case due to the waiting time required, that is, the charging time of the capacitor C. A method has been proposed to automatically detect the voltage of the capacitor C and to automatically charge the capacitor C depending on the detected voltage. But in any case, in order to enable discharge of the capacitor C that has already been discharged, it is first necessary to charge the capacitor C to a predetermined minimum voltage from which the capacitor C may be discharged. The discharge time required to charge the capacitor C may be on the order of approximately several tens of seconds to approximately 2 minutes and relatively short, but still, the capacitor C cannot be used (that is, discharged) during this charging time.

Accordingly, in order to reduce the charging time of the capacitor C, this second embodiment not only permits the discharge of the auxiliary power supply unit 4 by controlling the switch 9 by the CPU 10 when the voltage (or power) of the auxiliary power supply unit 4 is greater than or equal to the first dischargeable value, but also permits the discharge of the auxiliary power supply unit 4 by controlling the switch 9 by the CPU 10 based on predetermined judgement information when the voltage (or power) of the auxiliary power supply unit 4 is less than the first dischargeable value. The predetermined judgement information may be information related to the heater 1, such as the temperature of the heater 1 itself, the temperature of the fixing unit 36 which uses the heater 1, and the temperature of the image forming apparatus which uses the fixing unit 36.

Figure 7:
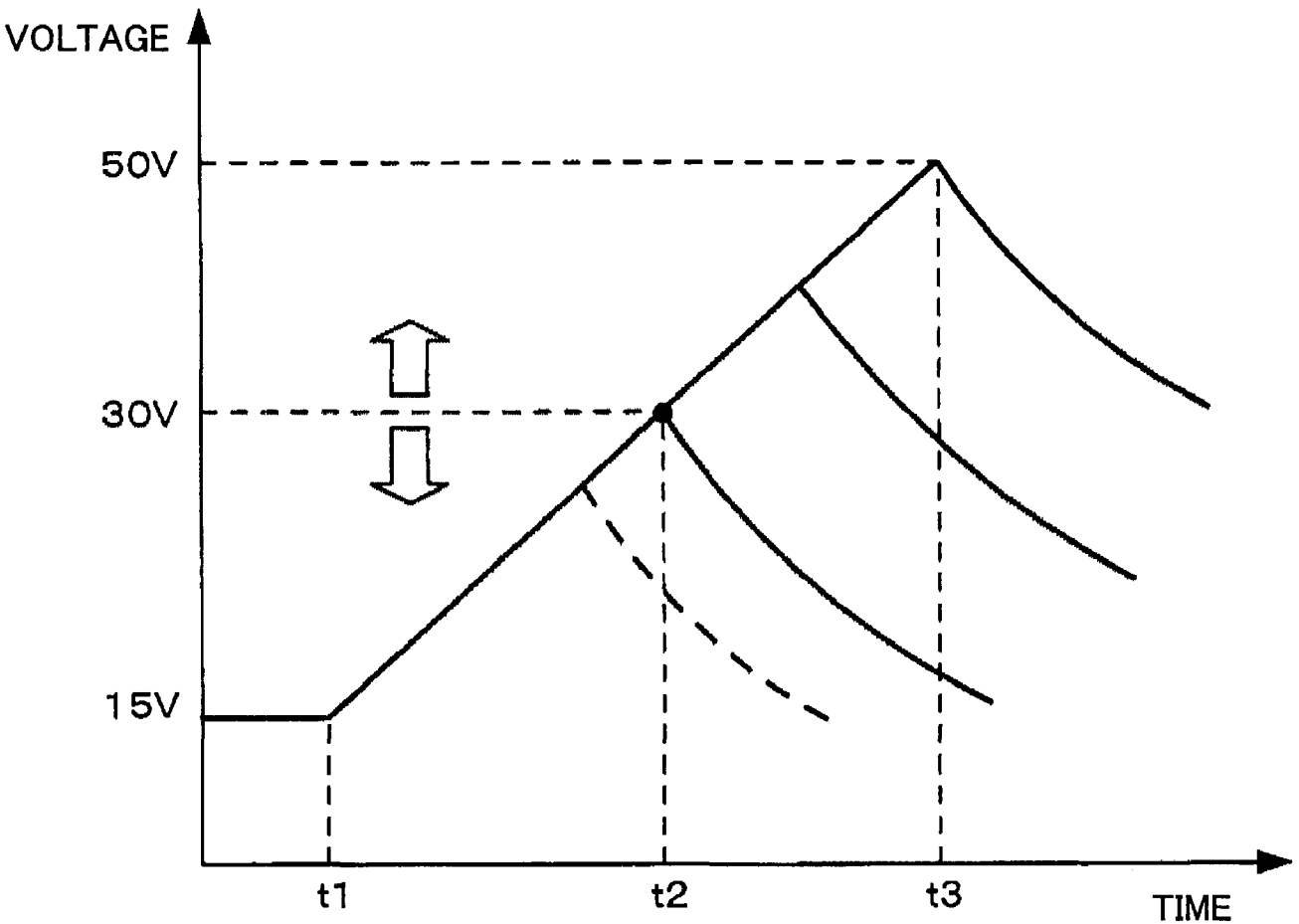
FIG. 7 is a diagram showing a voltage decrease of a capacitor due to discharging in a second embodiment of the present invention when charging is started from a discharge stopped state and charging is stopped in a fully charged state.

FIG. 7 is a diagram showing a voltage decrease of the capacitor C which is used to heat the fixing roller 40 of the image forming apparatus of this second embodiment due to discharging when the charging is started from a discharge stopped state and the charging is stopped in a fully charged state where the charging is made to an upper limit value. In FIG. 7, the ordinate indicates the voltage of the capacitor C, and the abscissa indicates the time in arbitrary units. Further, in FIG. 7, the voltage of the capacitor C is 50 V in the fully charged state, a minimum dischargeable voltage at which the capacitor C may be discharged is 30 V, and a voltage at which the discharge of the capacitor C stops is 15 V. The capacitor voltage is 15 V at a time t1 when the charging starts, 30 V at a time t2 when the capacitor voltage is the minimum dischargeable voltage at which the capacitor C may be discharged, and is 50 V at a time t3 when the capacitor C is fully charged and the charging of the capacitor C is stopped.

When the voltage (or power) of the capacitor C is greater than or equal to the first dischargeable value which is 50 V or slightly lower, the CPU 10 controls the switch 9 to permit the discharge of the auxiliary power supply unit 4. In addition, even when the voltage (or power) of the capacitor C is less than the first dischargeable value during the charging of the capacitor C, if the voltage of the capacitor C is greater than or equal to 30 V which is the minimum dischargeable voltage at which the capacitor C may be discharged, the CPU 10 controls the switch based on the predetermined judgement information to permit the discharge of the auxiliary power supply unit 4.

Of course, the voltages of 50 V, 30 V and 15 V are mere examples and various other voltage values may be used in this second embodiment. For example, the voltage of the capacitor C may be 45 V in the fully charged state, the minimum dischargeable voltage at which the capacitor C may be discharged may be 32 V, and the voltage at which the discharge of the capacitor C stops may be 2 V. For example, the time interval from the time t1 to the time t2 may be less than 1 minute, and the time interval from the time t1 to the time t3 may be less than 2 minutes, such as 1 minute to 1.5 minutes.

Therefore, according to this second embodiment, it is possible to optimize the discharging of the capacitor of the auxiliary power supply unit 4. In addition, it is possible to eliminate the waiting time that is required for capacitor of the auxiliary power supply unit 4 to be charged before carrying out the image forming process.

First Modification of Second Embodiment

In a first modification of the second embodiment, an input voltage that is input to the main power supply unit 3 from the commercial power supply is used for the predetermined judgement information that is related to the heater 1. A known detecting unit or means (not shown) may be used to detect the input voltage of the main power supply unit 3. In this case, the controller 8 controls the switch 9 to permit the discharge of the auxiliary power supply unit 4 depending on the detected input voltage of the main power supply unit 3.

A known detecting unit or means (not shown) may be used to detect the voltage supplied from the auxiliary power supply unit 4. Hence, if the voltage (or power) of the capacitor C is less than the first dischargeable value and is higher than a second dischargeable value that is higher than the minimum dischargeable voltage, for example, based on the detected voltage supplied from the auxiliary power supply unit 4, and the detected input voltage of the main power supply unit 3 is higher than a predetermined value, the controller 8 turns the switch 9 ON even when the auxiliary power supply unit 4 is in an intermediate charging state and is not yet fully charged to the upper limit value, so as to permit discharge from the auxiliary power supply unit 4 and supply the voltage from the auxiliary power supply unit 4 to the auxiliary heater element 2*b*.

In addition, if the voltage (or power) of the capacitor C is less than the first dischargeable value and is lower than the second dischargeable value but is higher than the minimum dischargeable voltage, based on the detected voltage supplied from the auxiliary power supply unit 4, and the detected input voltage of the main power supply unit 3 is lower than or equal to the predetermined value, the controller 8 turns the switch 9 ON only when the auxiliary power supply unit 4 is in a fully charged state and is charged to the upper limit value, so as to permit discharge from the auxiliary power supply unit 4 and supply the voltage from the auxiliary power supply unit 4 to the auxiliary heater element 2*b*.

If the input voltage of the main power supply unit 3 is higher than the predetermined value, it may be judged that a large mount of power is supplied from the main power supply unit 3. In this case, the amount of power supplied to the auxiliary heater element 2*b* by discharging the capacitor C may be small. Hence, if the input voltage of the main power supply unit 3 is higher than the predetermined value, the discharge from the auxiliary power supply unit 4 is permitted even in the intermediate charging state where the capacitor C has not yet fully charged to the upper limit value, so as to eliminate the waiting time prior to the image forming process, which would otherwise be necessary to charge the capacitor C.

If the input voltage of the main power supply unit 3 is lower than or equal to the predetermined value, it may be judged that a small amount of power is supplied from the main power supply unit 3. Accordingly, if the input voltage of the main power supply unit 3 is lower than or equal to the predetermined value, the surface temperature of the fixing roller 40 will not rise sufficiently and an incomplete fixing of the image may occur at the fixing unit 36 unless a large amount of power is supplied from the auxiliary power supply unit 4 to the auxiliary heater element 2*b* by discharging the capacitor C. Hence, if the input voltage of the main power supply unit 3 is lower than or equal to the predetermined value, the switch 9 is turned ON to permit discharge from the auxiliary power supply unit 4 only when the capacitor C is fully charged to the upper limit value, so as to prevent the incomplete fixing at the fixing unit 36.

By controlling the discharge from the auxiliary power supply unit 4 in the above described manner, it is possible to optimize the discharge from the auxiliary power supply unit 4. Moreover, such a discharge control may be employed regardless of whether the main power supply unit 3 is formed by an AC power supply or a DC power supply. Furthermore, the predetermined value which is used as a threshold value for determining whether or not to permit discharge from the auxiliary power supply unit 4 may be appropriately determined based on experiments or the like. Predetermined values used similarly as threshold values in the subsequent modifications of the second embodiment may also be determined appropriately based on experiments or the like.

Similarly, the voltage supplied from the main power supply unit 3 may be used for the predetermined judgement information that is related to the heater 1.

Second Modification of Second Embodiment

In a second modification of the second embodiment, the temperature of the pressure roller 41 is used for the predetermined judgement information that is related to the heater 1. A known temperature sensor or temperature detecting means (not shown) may be used to detect the temperature of the pressure roller 41. In this case, the controller 8 controls the switch 9 to permit the discharge of the auxiliary power supply unit 4 depending on the detected temperature of the pressure roller 41.

A known detecting unit or means (not shown) may be used to detect the voltage supplied from the auxiliary power supply unit 4. Hence, if the voltage (or power) of the capacitor C is less than the first dischargeable value and is higher than a second dischargeable value that is higher than the minimum dischargeable voltage, for example, based on the detected voltage supplied from the auxiliary power supply unit 4, and the detected temperature of the pressure roller 41 is higher than a predetermined value, the controller 8 turns the switch 9 ON even when the auxiliary power supply unit 4 is in an intermediate charging state and is not yet fully charged to the upper limit value, so as to permit discharge from the auxiliary power supply unit 4 and supply the voltage from the auxiliary power supply unit 4 to the auxiliary heater element 2*b*.

In addition, if the voltage (or power) of the capacitor C is less than the first dischargeable value and is lower than the second dischargeable value but is higher than the minimum dischargeable voltage, based on the detected voltage supplied from the auxiliary power supply unit 4, and the detected temperature of the pressure roller 41 is lower than or equal to the predetermined value, the controller 8 turns the switch 9 ON only when the auxiliary power supply unit 4 is in a fully charged state and is charged to the upper limit value, so as to permit discharge from the auxiliary power supply unit 4 and supply the voltage from the auxiliary power supply unit 4 to the auxiliary heater element 2*b*.

For example, when the recording media P are successively supplied in the image forming apparatus and the image forming process is carried out continuously, the temperature of the pressure roller 41 remains sufficiently high and is higher than the predetermined value. In this case, the amount of heat absorbed from the fixing roller 40 by the pressure roller 41 is small, and thus, the amount of power supplied to the auxiliary heater element 2*b* by the discharge of the capacitor C may be small. Hence, if the temperature of the pressure roller 41 is higher than the predetermined value, the discharge from the auxiliary power supply unit 4 is permitted even in the intermediate charging state where the capacitor C has not yet fully charged to the upper limit value, so as to eliminate the waiting time prior to the image forming process, which would otherwise be necessary to charge the capacitor C.

On the other hand, if the temperature of the pressure roller 41 is lower than or equal to the predetermined value, the heat of the fixing roller 40 will be absorbed by the pressure roller 41 to raise the temperature of the pressure roller 41 unless the amount of power supplied to the auxiliary heater element 2*b* by the discharge of the capacitor C is increased. Accordingly, if the temperature of the pressure roller 41 is lower than or equal to the predetermined value, the surface temperature of the fixing roller 40 will not rise sufficiently and an incomplete fixing of the image may occur at the fixing unit 36 unless a large amount of power is supplied from the auxiliary power supply unit 4 to the auxiliary heater element 2*b* by discharging the capacitor C. Hence, if the temperature of the pressure roller 41 is lower than or equal to the predetermined value, the switch 9 is turned ON to permit discharge from the auxiliary power supply unit 4 only when the capacitor C is fully charged to the upper limit value, so as to prevent the incomplete fixing at the fixing unit 36.

By controlling the discharge from the auxiliary power supply unit 4 in the above described manner, it is possible to optimize the discharge from the auxiliary power supply unit 4.

Third Modification of Second Embodiment

In a third modification of the second embodiment, the environment temperature is used for the predetermined judgement information that is related to the heater 1. The environment temperature may be the temperature of the heater 1, the temperature of the fixing unit 36 or the temperature of the image forming apparatus. For example, a nip temperature of the nip part N between the fixing roller 40 and the pressure roller 41 may be used as the environment temperature. In a case where it is difficult to measure the nip temperature, the environment temperature may be selected from the internal or external temperature of the heater 1, the internal or external temperature of the fixing unit 36, and the internal or external temperature of the image forming apparatus. In other words, any temperature information which affects (or is believed to affect) the fixing of the image in the fixing unit 36 may be used as the environment temperature. In this case, the controller 8 controls the switch 9 to permit the discharge of the auxiliary power supply unit 4 depending on the detected environment temperature.

A known temperature sensor or temperature detecting means (not shown) may be used to detect the environment temperature. Hence, if the voltage (or power) of the capacitor C is less than the first dischargeable value and is higher than a second dischargeable value that is higher than the minimum dischargeable voltage, for example, based on the detected voltage supplied from the auxiliary power supply unit 4, and the detected environment temperature is higher than a predetermined value, the controller 8 turns the switch 9 ON even when the auxiliary power supply unit 4 is in an intermediate charging state and is not yet fully charged to the upper limit value, so as to permit discharge from the auxiliary power supply unit 4 and supply the voltage from the auxiliary power supply unit 4 to the auxiliary heater element 2*b*.

In addition, if the voltage (or power) of the capacitor C is less than the first dischargeable value and is lower than the second dischargeable value but is higher than the minimum dischargeable voltage, based on the detected voltage supplied from the auxiliary power supply unit 4, and the detected environment temperature is lower than or equal to the predetermined value, the controller 8 turns the switch 9 ON only when the auxiliary power supply unit 4 is in a fully charged state and is charged to the upper limit value, so as to permit discharge from the auxiliary power supply unit 4 and supply the voltage from the auxiliary power supply unit 4 to the auxiliary heater element 2*b*.

For example, when the recording media P are successively supplied in the image forming apparatus and the image forming process is carried out continuously, the environment temperature remains sufficiently high and is higher than the predetermined value. In this case, the surface temperature of the fixing roller 40 is sufficiently high, and thus, the amount of power supplied to the auxiliary heater element 2*b* by the discharge of the capacitor C may be small. Hence, if the environment temperature is higher than the predetermined value, the discharge from the auxiliary power supply unit 4 is permitted even in the intermediate charging state where the capacitor C has not yet fully charged to the upper limit value, so as to eliminate the waiting time prior to the image forming process, which would otherwise be necessary to charge the capacitor C.

On the other hand, if the environment temperature is lower than or equal to the predetermined value, the surface temperature of the fixing roller 40 will be lower than the predetermined fixing temperature unless the amount of power supplied to the auxiliary heater element 2*b* by the discharge of the capacitor C is increased. Accordingly, if the environment temperature is lower than or equal to the predetermined value, the surface temperature of the fixing roller 40 will not rise sufficiently and an incomplete fixing of the image may occur at the fixing unit 36 unless a large amount of power is supplied from the auxiliary power supply unit 4 to the auxiliary heater element 2*b* by discharging the capacitor C. Hence, if the environment temperature is lower than or equal to the predetermined value, the switch 9 is turned ON to permit discharge from the auxiliary power supply unit 4 only when the capacitor C is fully charged to the upper limit value, so as to prevent the incomplete fixing at the fixing unit 36.

By controlling the discharge from the auxiliary power supply unit 4 in the above described manner, it is possible to optimize the discharge from the auxiliary power supply unit 4.

Fourth Modification of Second Embodiment

In a fourth modification of the second embodiment, the number of recording media P that passed through the fixing unit 36 during a previous job is used for the predetermined judgement information that is related to the heater 1. A known counter or counting means (not shown) may be used to count the number of recording media P that passed through the fixing unit 36 during the previous job. In this case, the controller 8 controls the switch 9 to permit the discharge of the auxiliary power supply unit 4 depending on the counted number of recording media P passed through the fixing unit 36 during the previous job.

A known detecting unit or means (not shown) may be used to detect the voltage supplied from the auxiliary power supply unit 4. Hence, if the voltage (or power) of the capacitor C is less than the first dischargeable value and is higher than a second dischargeable value that is higher than the minimum dischargeable voltage, for example, based on the detected voltage supplied from the auxiliary power supply unit 4, and the counted number of recording media P for the previous job is higher than a predetermined value, the controller 8 turns the switch 9 ON even when the auxiliary power supply unit 4 is in an intermediate charging state and is not yet fully charged to the upper limit value, so as to permit discharge from the auxiliary power supply unit 4 and supply the voltage from the auxiliary power supply unit 4 to the auxiliary heater element 2*b*.

In addition, if the voltage (or power) of the capacitor C is less than the first dischargeable value and is lower than the second dischargeable value but is higher than the minimum dischargeable voltage, based on the detected voltage supplied from the auxiliary power supply unit 4, and the counted number of recording media P for the previous job is lower than or equal to the predetermined value, the controller 8 turns the switch 9 ON only when the auxiliary power supply unit 4 is in a fully charged state and is charged to the upper limit value, so as to permit discharge from the auxiliary power supply unit 4 and supply the voltage from the auxiliary power supply unit 4 to the auxiliary heater element 2*b*.

If the counted number of recording media P for the previous job is higher than the predetermined value, it may be judged that the surface temperature of the fixing roller 40 is sufficiently high. In this case, the amount of power supplied to the auxiliary heater element 2*b* by discharging the capacitor C may be small. Hence, if the counted number of recording media P for the previous job is higher than the predetermined value, the discharge from the auxiliary power supply unit 4 is permitted even in the intermediate charging state where the capacitor C has not yet fully charged to the upper limit value, so as to eliminate the waiting time prior to the image forming process, which would otherwise be necessary to charge the capacitor C.

If the counted number of recording media P for the previous job is lower than or equal to the predetermined value, it may be judged that the surface temperature of the fixing roller 40 is lower than the predetermined fixing temperature. Accordingly, if the counted number of recording media P for the previous job is lower than or equal to the predetermined value, the surface temperature of the fixing roller 40 will not rise sufficiently and an incomplete fixing of the image may occur at the fixing unit 36 unless a large amount of power is supplied from the auxiliary power supply unit 4 to the auxiliary heater element 2*b* by discharging the capacitor C. Hence, if the counted number of recording media P for the previous job is lower than or equal to the predetermined value, the switch 9 is turned ON to permit discharge from the auxiliary power supply unit 4 only when the capacitor C is fully charged to the upper limit value, so as to prevent the incomplete fixing at the fixing unit 36.

By controlling the discharge from the auxiliary power supply unit 4 in the above described manner, it is possible to optimize the discharge from the auxiliary power supply unit 4.

Fifth Modification of Second Embodiment

In a fifth modification of the second embodiment, the time interval between a previous job and a present job is used for the predetermined judgement information that is related to the heater 1. A known timer or time measuring means (not shown) may be used to measure the time interval between the previous job and the present job. In this case, the controller 8 varies the amount of power supplied from the capacitor C depending on the time interval between the previous job and the present job.

A known detecting unit or means (not shown) may be used to detect the voltage supplied from the auxiliary power supply unit 4. Hence, if the voltage (or power) of the capacitor C is less than the first dischargeable value and is higher than a second dischargeable value that is higher than the minimum dischargeable voltage, for example, based on the detected voltage supplied from the auxiliary power supply unit 4, and the measured time interval between the previous job and the present job is longer than a predetermined value, the controller 8 turns the switch 9 ON even when the auxiliary power supply unit 4 is in an intermediate charging state and is not yet fully charged to the upper limit value, so as to permit discharge from the auxiliary power supply unit 4 and supply the voltage from the auxiliary power supply unit 4 to the auxiliary heater element 2*b*.

In addition, if the voltage (or power) of the capacitor C is less than the first dischargeable value and is lower than the second dischargeable value but is higher than the minimum dischargeable voltage, based on the detected voltage supplied from the auxiliary power supply unit 4, and the measured time interval between the previous job and the present job is shorter than or equal to the predetermined value, the controller 8 turns the switch 9 ON only when the auxiliary power supply unit 4 is in a fully charged state and is charged to the upper limit value, so as to permit discharge from the auxiliary power supply unit 4 and supply the voltage from the auxiliary power supply unit 4 to the auxiliary heater element 2*b*.

If the time interval between the previous job and the present job is longer than the predetermined value, it may be judged that the surface temperature of the fixing roller 40 is sufficiently high. In this case, the amount of power supplied to the auxiliary heater element 2*b* by discharging the capacitor C may be small. Hence, if the time interval between the previous job and the present job is longer than the predetermined value, the discharge from the auxiliary power supply unit 4 is permitted even in the intermediate charging state where the capacitor C has not yet fully charged to the upper limit value, so as to eliminate the waiting time prior to the image forming process, which would otherwise be necessary to charge the capacitor C.

If the time interval between the previous job and the present job is shorter than or equal to the predetermined value, it may be judged that the surface temperature of the fixing roller 40 is lower than the predetermined fixing temperature. Accordingly, if the time interval between the previous job and the present job is shorter than or equal to the predetermined value, the surface temperature of the fixing roller 40 will not rise sufficiently and an incomplete fixing of the image may occur at the fixing unit 36 unless a large amount of power is supplied from the auxiliary power supply unit 4 to the auxiliary heater element 2*b* by discharging the capacitor C. Hence, if the time interval between the previous job and the present job is shorter than or equal to the predetermined value, the switch 9 is turned ON to permit discharge from the auxiliary power supply unit 4 only when the capacitor C is fully charged to the upper limit value, so as to prevent the incomplete fixing at the fixing unit 36.

By controlling the discharge from the auxiliary power supply unit 4 in the above described manner, it is possible to optimize the discharge from the auxiliary power supply unit 4.

Sixth Modification of Second Embodiment

In a sixth modification of the second embodiment, the work time of a previous job is used for the information that is related to the heater 1. A known timer or time measuring means (not shown) may be used to measure the work time of the previous job. In this case, the controller 8 varies the amount of power supplied from the capacitor C depending on the work time of the previous job.

A known detecting unit or means (not shown) may be used to detect the voltage supplied from the auxiliary power supply unit 4. Hence, if the voltage (or power) of the capacitor C is less than the first dischargeable value and is higher than a second dischargeable value that is higher than the minimum dischargeable voltage, for example, based on the detected voltage supplied from the auxiliary power supply unit 4, and the measured work time of the previous job is longer than a predetermined value, the controller 8 turns the switch 9 ON even when the auxiliary power supply unit 4 is in an intermediate charging state and is not yet fully charged to the upper limit value, so as to permit discharge from the auxiliary power supply unit 4 and supply the voltage from the auxiliary power supply unit 4 to the auxiliary heater element 2*b*.

In addition, if the voltage (or power) of the capacitor C is less than the first dischargeable value and is lower than the second dischargeable value but is higher than the minimum dischargeable voltage, based on the detected voltage supplied from the auxiliary power supply unit 4, and the measured work time of the previous job is shorter than or equal to the predetermined value, the controller 8 turns the switch 9 ON only when the auxiliary power supply unit 4 is in a fully charged state and is charged to the upper limit value, so as to permit discharge from the auxiliary power supply unit 4 and supply the voltage from the auxiliary power supply unit 4 to the auxiliary heater element 2*b*.

If the work time of the previous job is longer than the predetermined value, it may be judged that the surface temperature of the fixing roller 40 is sufficiently high. In this case, the amount of power supplied to the auxiliary heater element 2*b* by discharging the capacitor C may be small. Hence, if the work time of the previous job is longer than the predetermined value, the discharge from the auxiliary power supply unit 4 is permitted even in the intermediate charging state where the capacitor C has not yet fully charged to the upper limit value, so as to eliminate the waiting time prior to the image forming process, which would otherwise be necessary to charge the capacitor C.

If the work time of the previous job is shorter than or equal to the predetermined value, it may be judged that the surface temperature of the fixing roller 40 is lower than the predetermined fixing temperature. Accordingly, if the work time of the previous job is shorter than or equal to the predetermined value, the surface temperature of the fixing roller 40 will not rise sufficiently and an incomplete fixing of the image may occur at the fixing unit 36 unless a large amount of power is supplied from the auxiliary power supply unit 4 to the auxiliary heater element 2*b* by discharging the capacitor C. Hence, if the work time of the previous job is shorter than or equal to the predetermined value, the switch 9 is turned ON to permit discharge from the auxiliary power supply unit 4 only when the capacitor C is fully charged to the upper limit value, so as to prevent the incomplete fixing at the fixing unit 36.

By controlling the discharge from the auxiliary power supply unit 4 in the above described manner, it is possible to optimize the discharge from the auxiliary power supply unit 4.

Of course, two or more of the first through sixth modifications of the second embodiment may be appropriately combined to suit the needs if necessary.

In the second embodiment and the modifications thereof, the controller 8 of the heater 1 variably controls the discharge from the capacitor C. However, a control unit or means for variably controlling the discharge from the capacitor C is not limited to such, and may be provided in the fixing unit 36 or in the image forming apparatus, for example. In addition, a control unit or means used to control other functions may be used in common for the purposes of variably controlling the discharge from the capacitor C.

Moreover, the nip part N in the second embodiment and the modifications thereof is formed by the two rollers, namely, the fixing roller 40 and the pressure roller 41, but nip part N used by the fixing unit 36 and the image forming apparatus is not limited to such. For example, the nip part N may be made by a roller and a belt or, by two belts. Furthermore, the recording medium P may make sliding contact with a heated fixing part such as the fixing roller 40 or pass close to the heated fixing part.

The image forming apparatus is of course not limited to that shown in FIG. 1, and the photoconductive body may have a belt shape in place of the drum shape. The image forming apparatus may also be a color image forming apparatus which uses a so-called intermediate transfer belt.

The auxiliary power supply unit 4 is also not limited to that using the capacitor C, and may use a secondary battery. The effects of the present invention obtainable by the second embodiment and the modifications thereof are also obtainable in the case of the auxiliary power supply unit 4 that uses the secondary battery. In the case where the auxiliary power supply unit 4 uses a device, such as the secondary battery, having an output voltage that is approximately constant, the ordinate in FIGS. 4B and 4C will correspond to a remaining battery level and not the capacitor voltage.

Third Embodiment

As described above, the surface temperature of the fixing roller in the standby state needs to be set to a low temperature from the point of view of reducing the power consumption. In addition, from the point of view of reducing the waiting time that is required for the surface temperature of the fixing roller to reach the predetermined fixing temperature from the standby state, it is necessary to reduce the heat capacity of the fixing roller.

However, compared to the fixing roller having a large heat capacity, the surface temperature of the fixing roller having a small heat capacity drops rapidly when the heat of the fixing roller is absorbed by the recording medium and the toner when fixing the toner image transferred on the recording medium. For this reason, the surface temperature of the fixing roller having the small heat capacity becomes lower than the lower limit of the fixing temperature, and an incomplete fixing easily occurs.

Hence, in order to prevent the surface temperature of the fixing roller from rapidly dropping, both the power from the main power supply unit and the power from the auxiliary power supply unit may be supplied to the heater of the fixing roller. The auxiliary power supply unit may use a capacitor.

The Japanese Laid-Open Patent Application No. 10-282821 described above proposes supplying the auxiliary power supply unit in the standby state of the fixing unit and supplying the power supply voltage from both the main power supply unit and the auxiliary power supply unit when the fixing unit is started, so as to reduce the waiting time.

A Japanese Laid-Open Patent Application No. 9-230739 proposes switching the temperature of the fixing unit depending on the number of recording media consecutively printed, and switching the temperature of the fixing unit depending on the voltage supplied to the fixing unit.

A Japanese Laid-Open Patent Application No. 2003-297526 proposes varying the connection of a plurality of cells forming the auxiliary power supply unit when making a discharge from the auxiliary power supply unit.

Other proposals have been made in Japanese Laid-Open Patent Applications No. 2000-315567, No. 2002-174988 and No. 2002-184554. The Japanese Laid-Open Patent Application No. 2002-184554 was described above.

However, when supplying the power from the auxiliary power supply unit to the fixing unit in the conventional image forming apparatuses, no consideration is given as to the voltage supplied from the main power supply unit, the environment temperature within or outside the image forming apparatus, and/or the charge accumulated in the auxiliary power supply unit. For this reason, the power stored in the auxiliary power supply unit is not used effectively or efficiently, and depending on the situation, it may take a long waiting time from the standby state until the predetermined fixing temperature is reached and the fixing unit becomes usable.

A third embodiment of the present invention is designed to suppress the above described problems of the conventional image forming apparatuses. The third embodiment of the image forming apparatus, the third embodiment of the heater and the third embodiment of the fixing unit may have basic structures that are the same as those of the first embodiment described above in conjunction with FIGS. 1 through 3, and an illustration and description thereof will be omitted.

Figure 8:
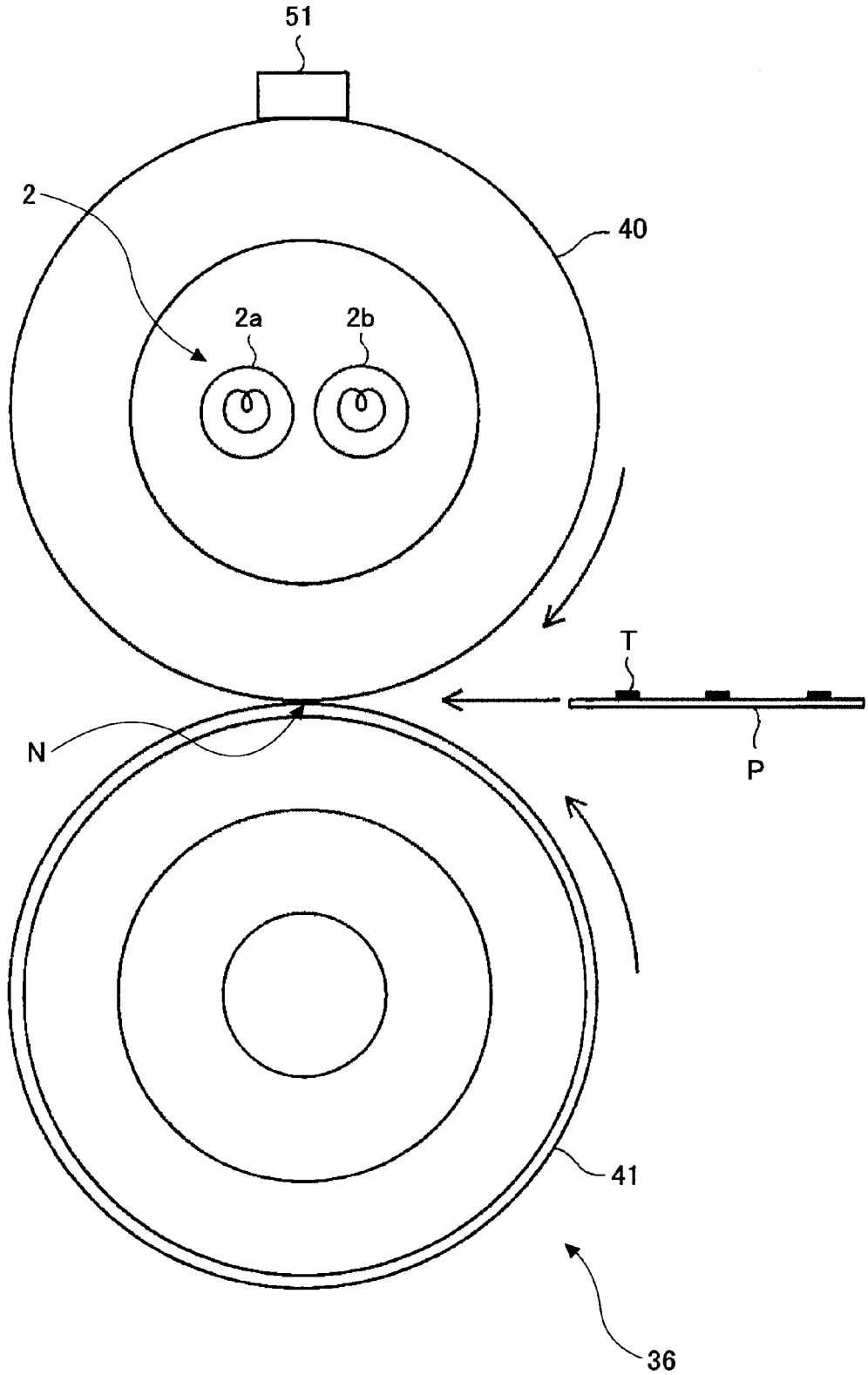
FIG. 8 is a cross sectional view conceptually showing a structure of a third embodiment of the fixing unit according to the present invention that is used in the image forming apparatus shown in FIG. 1.

FIG. 8 is a cross sectional view conceptually showing a structure of a third embodiment of the fixing unit according to the present invention that is used in the image forming apparatus shown in FIG. 1. In FIG. 8, those parts which are the same as those corresponding parts in FIG. 2 are designated by the same reference numerals, and a description thereof will be omitted. The heater 1 shown in FIG. 9 further includes a temperature sensor 51 which detects the surface temperature of the fixing roller 40. A detection signal indicative of the detected surface temperature of the fixing roller 40 is supplied to the CPU 10 within the controller 8 shown in FIG. 3.

Figure 9:
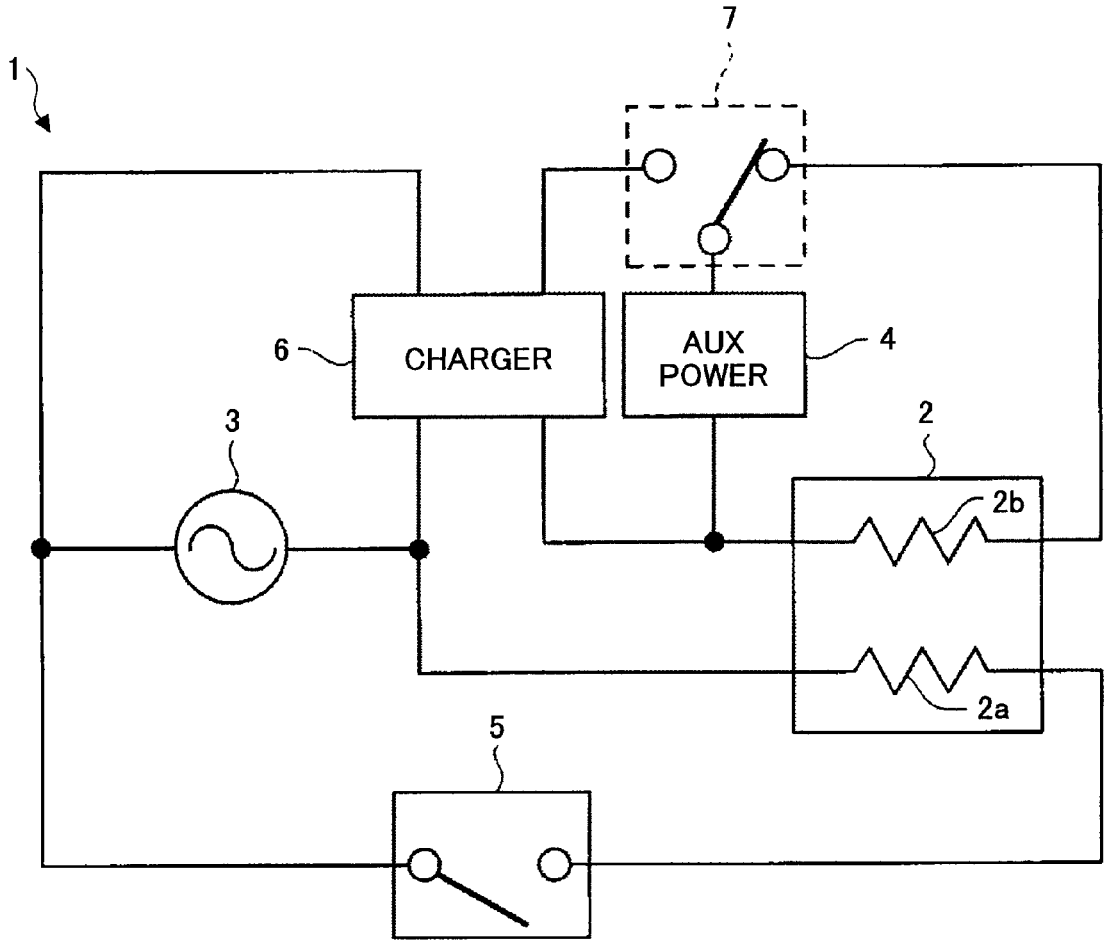
FIG. 9 is a circuit diagram showing another structure of the third embodiment of the heater according to the present invention.

FIG. 9 is a circuit diagram showing another structure of this third embodiment of the heater according to the present invention. In FIG. 9, those parts which are the same as those corresponding parts in FIG. 3 are designated by the same reference numerals, and a description thereof will be omitted. In FIG. 9, the illustration of the controller 9 is omitted for the sake of convenience. The main switch 5 in FIG. 9 is provided in the path between the main power supply unit 3 and the main heater element 2*a*, but this main switch 5 is not connected to a node that connects the main power supply unit 3 and the charger 6, unlike in FIG. 3. The heater structure shown in FIG. 9 may be employed in place of the heater structure shown in FIG. 3 in this third embodiment, and also in any of the first and second embodiments and modifications thereof described above.

The auxiliary power supply unit 4 desirably uses an electric double layer capacitor (electrochemical capacitor) C such as those described in the Japanese Laid-Open Patent Applications No. 2000-315567, No. 2002-174988 and No. 2002-184554 referred above. This is because, compared to a repeatedly chargeable and dischargeable nickel-cadmium battery, the charging time is short (approximately several minutes by a rapid charge), the serviceable life is very long, and there is virtually no deterioration due to the repeated charging and discharging, for the electric double layer capacitor C.

In a case where it would take a long time to raise the surface temperature of the fixing roller 40 by merely supplying the power from the main power supply unit 3 to the main heater element 2*a*, it is possible to shorten the time required to raise the surface temperature of the fixing roller 40 by simultaneously supplying the power to the auxiliary heater element 2*b* from the auxiliary power supply unit 4 that has been charged by the power supplied from the main power supply unit 3 via the charger 6. The power from the auxiliary power supply unit 4 may be supplied to the auxiliary heater element 2*b* not only to heat the fixing roller 40 when no recording medium P is passes the nip part N, but also to heat the fixing roller 40 when the recording medium P passes the nip part N.

Therefore, in this embodiment, the usage of the power supplied from the auxiliary power supply unit 4 and/or the amount of power supplied from the auxiliary power supply unit 4 are/is variably controlled based on information that is related to the heater 1 (or heater part 2), so as to efficiently utilize the power stored in the auxiliary power supply unit 4. As a result, it is possible to reduce the waiting time that is required until the surface temperature of the fixing roller 40 reaches the predetermined fixing temperature when the main power supply unit 3 is turned ON, reduce the waiting time that is required for the surface temperature of the fixing roller 40 to reach the predetermined fixing temperature from the standby state such as a sleep mode and a power save mode of the image forming apparatus, and improve the productivity when continuously carrying out the image forming process with respect to the consecutively supplied recording media P.

First Modification of Third Embodiment

In a first modification of the third embodiment, an input voltage that is input to the main power supply unit 3 from the commercial power supply is used for the information that is related to the heater 1 (or heater part 2).

FIGS. 10 through 13 are diagrams showing relationships between time and the heater temperature, that is, the surface temperature of the fixing roller 40, for different input voltages supplied from the commercial power supply to the main power supply unit 3. In FIGS. 10 through 13, the voltage values of 90 V, 95 V and 100 V are merely examples and the voltage values are not limited to such, and the time base is shown in arbitrary units.

Figure 10:
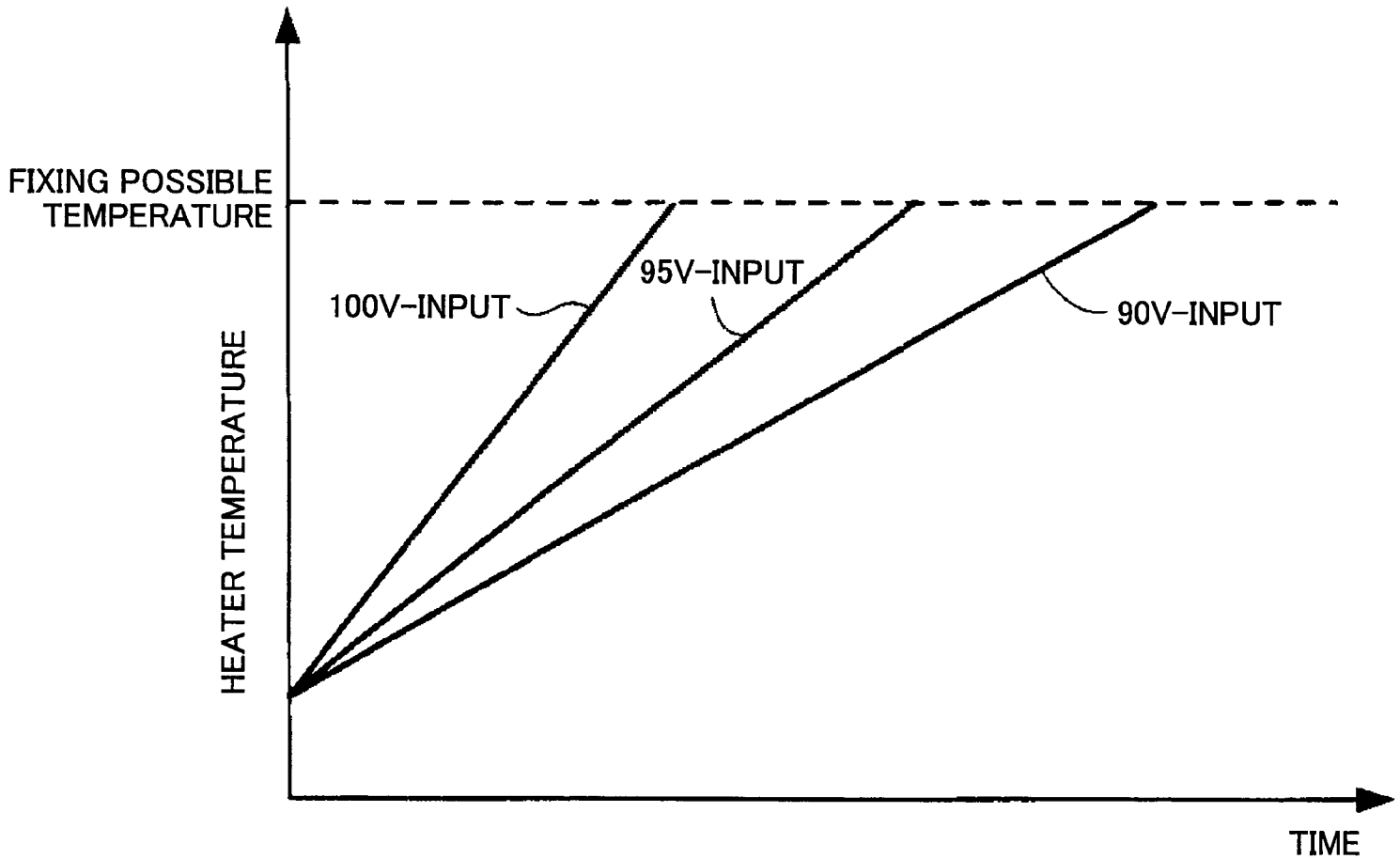
FIG. 10 is a diagram showing a relationship between time and the heater temperature for different input voltages of the main power supply unit when starting the fixing unit in a case where no power is supplied from the auxiliary power supply unit to the auxiliary heater element.
Figure 11:
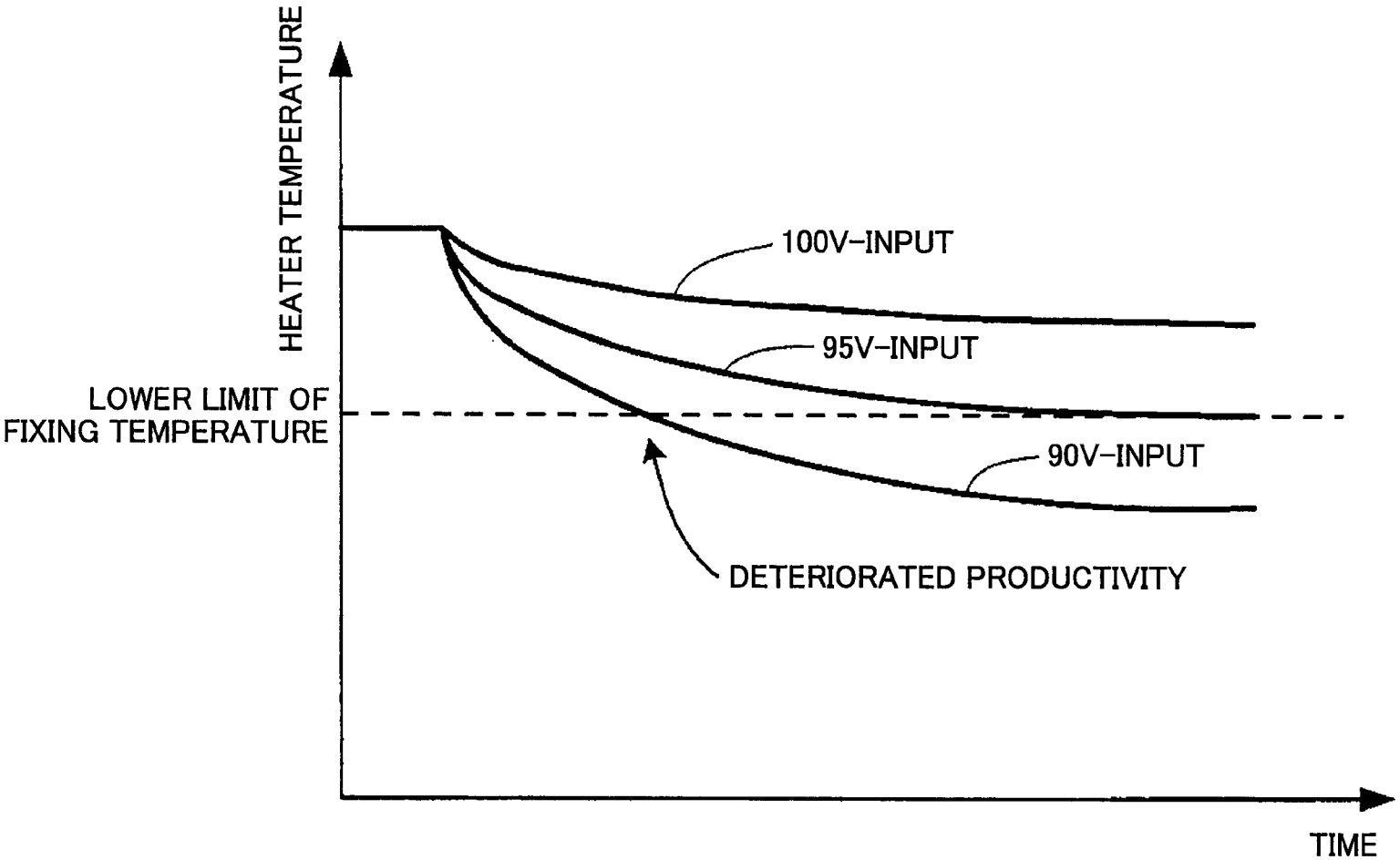
FIG. 11 is a diagram showing a relationship between time and the heater temperature for different input voltages of the main power supply unit when the recording media are successively supplied to the fixing unit in a case where no power is supplied from the auxiliary power supply unit to the auxiliary heater element.
Figure 12:
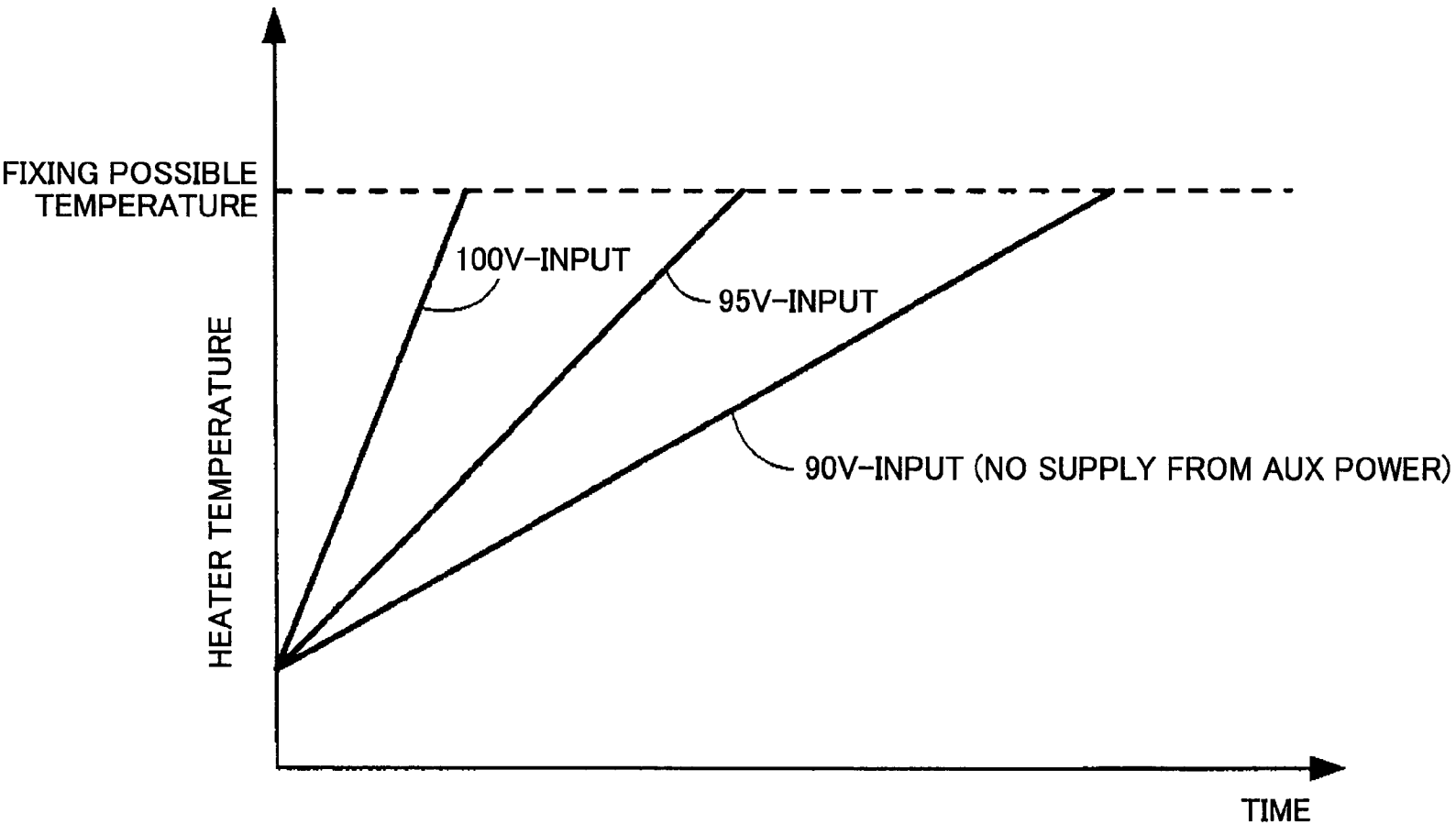
FIG. 12 is a diagram showing a relationship between time and the heater temperature for different input voltages of the main power supply unit when starting the fixing unit in a case where the power is supplied from the auxiliary power supply unit to the auxiliary heater element.
Figure 13:
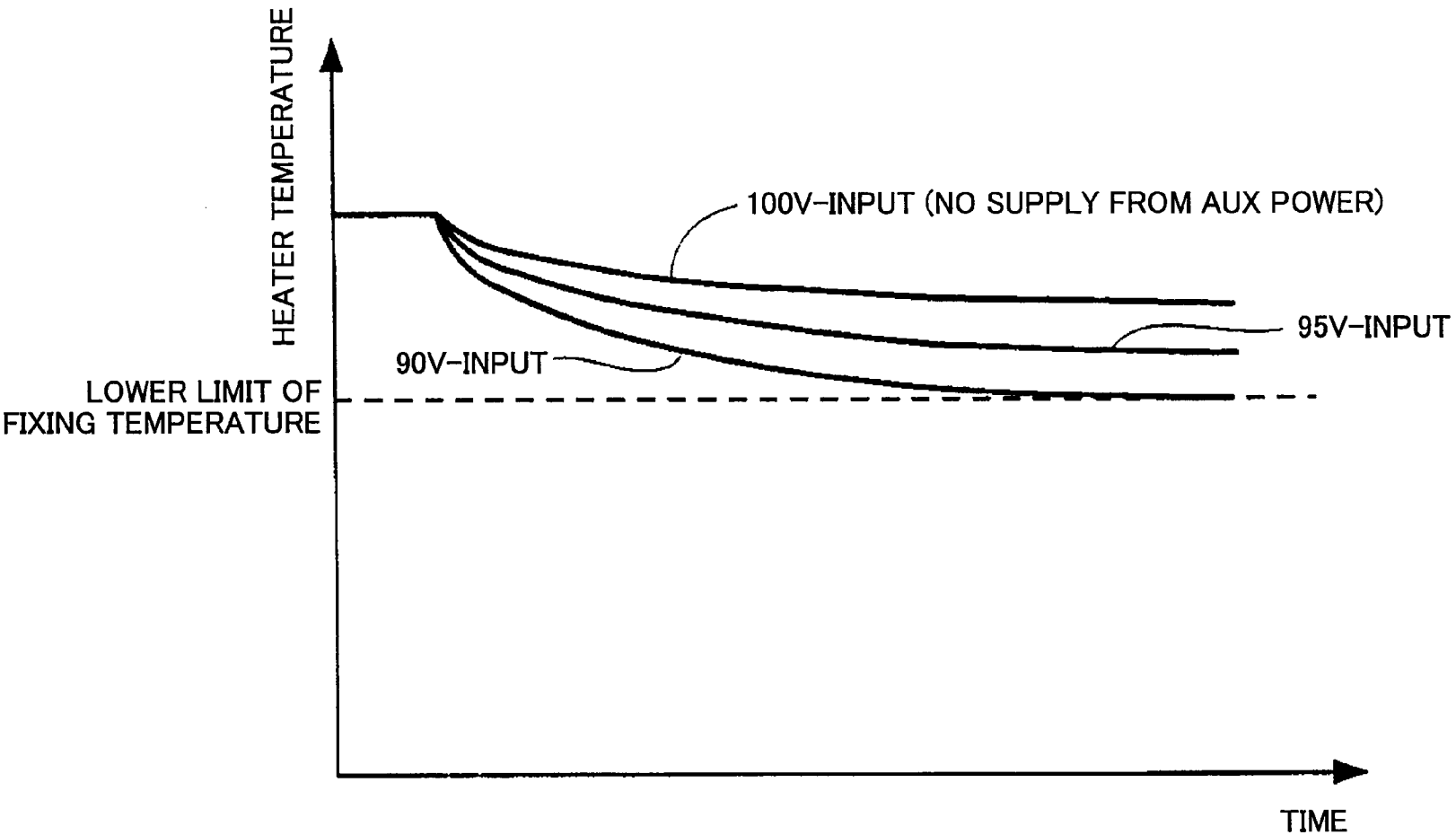
FIG. 13 is a diagram showing a relationship between time and the heater temperature for different input voltages of the main power supply unit when the recording media are successively supplied to the fixing unit in a case where the power is supplied from the auxiliary power supply unit to the auxiliary heater element.

FIG. 10 is a diagram showing a relationship between time and the heater temperature (the surface temperature of the fixing roller 40) for different input voltages of the main power supply unit 3 when starting the fixing unit 36 in a case where no power is supplied from the auxiliary power supply unit 4 to the auxiliary heater element 2*b*. FIG. 11 is a diagram showing a relationship between time and the heater temperature (the surface temperature of the fixing roller 40) for different input voltages of the main power supply unit 3 when the recording media P are successively supplied to the fixing unit 36 to carry out the image forming process continuously in a case where no power is supplied from the auxiliary power supply unit 4 to the auxiliary heater element 2*b*. FIG. 12 is a diagram showing a relationship between time and the heater temperature (the surface temperature of the fixing roller 40) for different input voltages of the main power supply unit 3 when starting the fixing unit 36 in a case where the power is supplied from the auxiliary power supply unit 4 to the auxiliary heater element 2*b*. Further, FIG. 13 is a diagram showing a relationship between time and the heater temperature (the surface temperature of the fixing roller 40) for different input voltages of the main power supply unit 3 when the recording media P are successively supplied to the fixing unit 36 to carry out the image forming process continuously in a case where the power is supplied from the auxiliary power supply unit 4 to the auxiliary heater element 2*b*.

In a case indicated by "100V-input" where 100 V is input from the commercial power supply to the main power supply unit 3 and the input voltage of the main power supply unit 3 is greater than or equal to a predetermined value and sufficiently high, it may be seen from FIGS. 10 and 11 that the heater temperature does not fall below the lower limit of the fixing temperature even when the recording media P are successively supplied to the fixing unit 36 to carry out the image forming process continuously (hereinafter simply referred to as a continuous image forming process). For this reason, the productivity does not deteriorate during the continuous image forming process, and there is no need to use the power stored in the auxiliary power supply unit 4. Accordingly, the power from the auxiliary power supply unit 4 can be used in a power-ON state where the main power supply unit 3 is turned ON or, when the surface temperature of the fixing roller 40 (or the temperature of the fixing unit 36) is returned to the predetermined fixing temperature from the standby state (standby temperature), to thereby make it possible to reduce the time required to raise the surface temperature of the fixing roller 40 to the predetermined fixing temperature, as may be seen from FIGS. 10 and 12.

In this first modification of the third embodiment, a known detecting unit or means (not shown), such as a voltage detector, detects the input voltage of the main power supply unit 3. The controller 8 controls the switch 7 based on the detected input voltage of the main power supply unit 3, so that the auxiliary power supply unit 4 is connected to the charger 6 for the continuous image forming process when the detected input voltage of the main power supply unit 3 is 100 V, and the auxiliary power supply unit 4 is connected to the auxiliary heater element 2*b* for the image forming process in the power-ON state or when the surface temperature of the fixing roller 40 (or the temperature of the fixing unit 36) is returned to the predetermined fixing temperature from the standby state (standby temperature).

In a case indicated by "90V-input" where 90 V is input from the commercial power supply to the main power supply unit 3 and the input voltage of the main power supply unit 3 is lower than the predetermined value and not sufficiently high, the surface temperature of the fixing roller 40 will become less than the lower limit of the fixing temperature during the continuous image forming process unless the power from the auxiliary power supply unit 4 is supplied to the auxiliary heater element 2*b*. In other words, if the auxiliary power supply unit 4 is not used during the continuous image forming process in such a situation, the productivity of the image forming apparatus must be lowered in order to satisfy a desired fixing quality. Hence, in this first modification of the third embodiment, the power from the auxiliary power supply unit 4 is supplied to the auxiliary heater element 2*b* during the continuous image forming process in such a situation, so as to prevent the heater temperature from falling below the lower limit of the fixing temperature as shown in FIG. 13, and to avoid lowering the productivity.

Accordingly, in this first modification of the third embodiment, if the voltage detection signal from the detecting unit or means indicates that the input voltage of the main power supply unit 3 is lower than the predetermined value and is not sufficiently high (for example, 90 V or less), the controller 8 controls the switch 7 based on the temperature detection signal from the temperature sensor 51 so that the auxiliary power supply unit 4 is connected to the charger 6 and the auxiliary power supply unit 4 will not be used in the power-ON state or when the surface temperature of the fixing roller 40 (or the temperature of the fixing unit 36) is returned to the predetermined fixing temperature from the standby state (standby temperature). In addition, if the voltage detection signal from the detecting unit or means indicates that the input voltage of the main power supply unit 3 is low, the controller 8 controls the switch 7 so that the auxiliary power supply unit 4 is connected to the auxiliary heater element 2*b* for the image forming process in the power-ON state or when the surface temperature of the fixing roller 40 (or the temperature of the fixing unit 36) is returned to the predetermined fixing temperature from the standby state (standby temperature).

On the other hand, if the voltage detection signal from the detecting unit or means indicates that the input voltage of the main power supply unit 3 is an intermediate value (for example, 95 V) that is between the sufficiently high value (for example, 100 V) and the not sufficiently high value (for example, 90 V or less), the controller 8 controls the switch 7 so as to supply a predetermined minimum power that can avoid deterioration of the productivity from the auxiliary power supply unit 4 to the auxiliary heater element 2*b* for the image forming process with respect to the consecutively supplied recording media P. In addition, the controller 8 controls the switch 7 so as to supply the remaining power of the auxiliary power supply unit 4 (power that remains after the discharge at the time of the image forming process with respect to the consecutively supplied recording media P) to the auxiliary heater element 2*b* in the power-ON state or when the surface temperature of the fixing roller 40 (or the temperature of the fixing unit 36) is returned to the predetermined fixing temperature from the standby state (standby temperature). Hence, as may be seen from FIGS. 12 and 13, it is possible to reduce the time required to raise the surface temperature of the fixing roller 40 (temperature of the fixing unit 36) to the predetermined fixing temperature capable of carrying out a stable fixing process.

Figure 14:
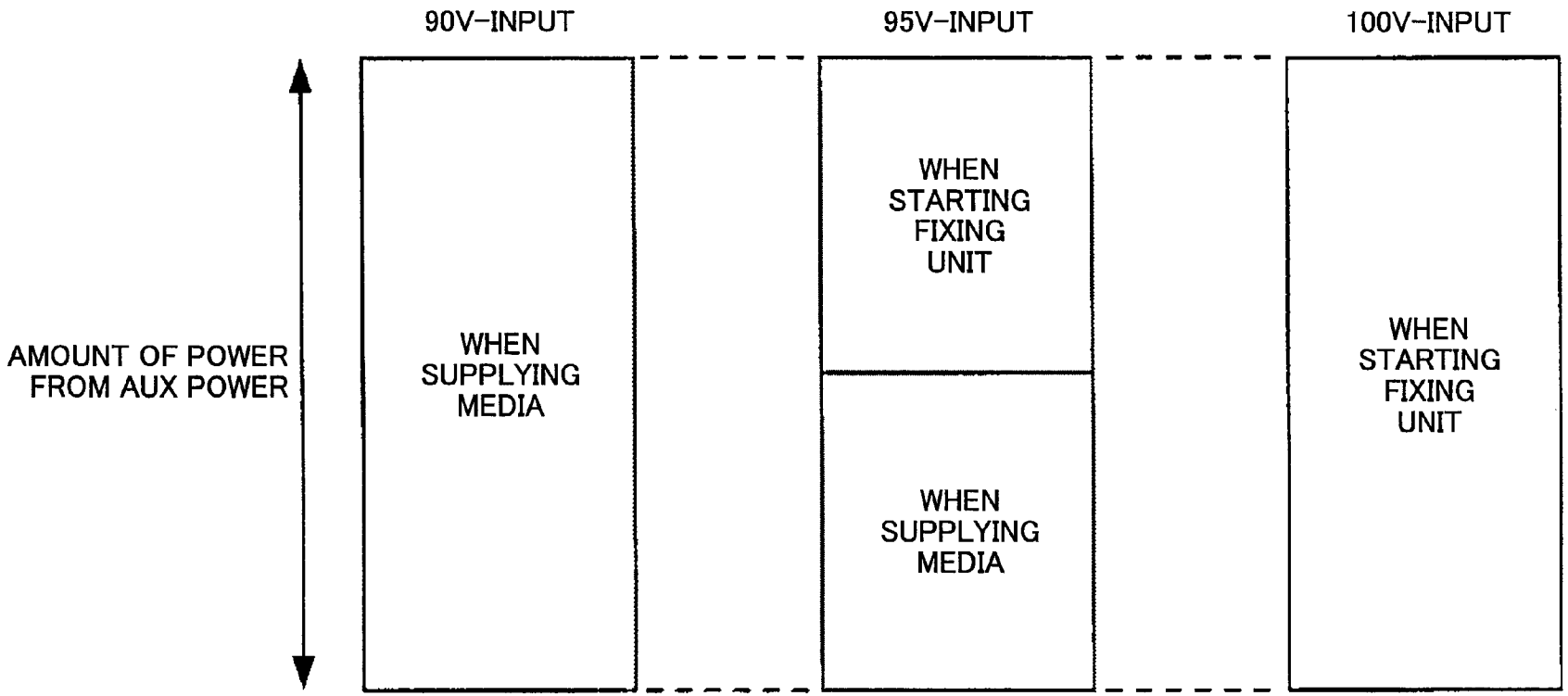
FIG. 14 is a diagram for explaining the usage and the rate of usage of the power stored in the auxiliary power supply unit.

Therefore, the power stored in the auxiliary power supply unit 4 is used differently between the power-ON state or when the surface temperature of the fixing roller 40 (or the temperature of the fixing unit 36) is returned to the predetermined fixing temperature from the standby state (standby temperature) and when the image forming process is carried out with respect to the successively supplied recording media P, depending on the input voltage of the main power supply unit 3. In addition, the usage and the rate of usage of the power stored in the auxiliary power supply unit 4 is determined as shown in FIG. 14, that is, determined differently between the power-ON state or when the surface temperature of the fixing roller 40 (or the temperature of the fixing unit 36) is returned to the predetermined fixing temperature from the standby state (standby temperature) and when the image forming process is carried out with respect to the successively supplied recording media P, so as to effectively utilize the power stored in the auxiliary power supply unit 4. FIG. 14 is a diagram for explaining the usage and the rate of usage of the power stored in the auxiliary power supply unit 4. As a result, it is possible to reduce the time required to raise the surface temperature of the fixing roller 40 when the main power supply unit 3 is turned ON and reduce the time required to raise the surface temperature of the fixing roller 40 to the predetermined fixing temperature capable of carrying out the stable fixing process from the standby state such as the sleep mode and the power save mode of the image forming apparatus. It is also possible to maintain a satisfactory fixing quality without deteriorating the productivity when carrying out the image forming process with respect to the successively supplied recoding media P.

The usage of the power stored in the auxiliary power supply unit 4 refers to the supply timing with which the power from the capacitor C is supplied to the auxiliary heater element 2*b*. The supply timing may be any of the following timings T1 through T3.

Timing T1: When the main power supply unit 3 is turned ON.

Timing T2: When carrying out the image forming process (by supplying the recording medium P to the fixing unit 36. It is effective to vary the supply timing and/or the supply amount depending on the number of recording media P to be subjected to the image forming process, the size of the recording medium P and the kind of the recording medium P, Timing T3: When the fixing unit 36 is in the standby state. This standby state not only includes the normal standby state between jobs, but also the sleep mode and the power save mode of the image forming apparatus. By supplying a small amount of power from the auxiliary power supply unit 4 to the auxiliary heater element 2*b* when the capacitor C is fully charged, it is possible to prevent the capacitor C of the auxiliary power supply unit 4 from being maintained in the high voltage state for a long time. Otherwise, if the capacitor C is maintained in the high voltage state for a long time, the serviceable life of the capacitor C tends to deteriorate.

Similarly, the voltage supplied from the main power supply unit 3 may be used for the information that is related to the heater 1 (or heater part 2).

Second Modification of Third Embodiment

In a second modification of the third embodiment, an environment temperature of the fixing unit 36 is used for the information that is related to the heater 1 (or heater part 2). A known temperature sensor or temperature detecting means (not shown) detects the environment temperature of the fixing unit 36. The controller 8 controls the switch 7 based on the temperature detection signal that is indicative of the environment temperature of the fixing unit 36 and is received from the known temperature sensor or temperature detecting means, so as to control the usage of the power stored in the auxiliary power supply unit 4.

FIGS. 15 through 18 are diagrams showing relationships between time and the heater temperature, that is, the surface temperature of the fixing roller 40, for different environment temperatures of the fixing unit 36. In FIGS. 15 through 18, the temperature values of 30° C., 20° C. and 10° C. are merely examples and the temperature values are not limited to such, and the time base is shown in arbitrary units.

Figure 15:
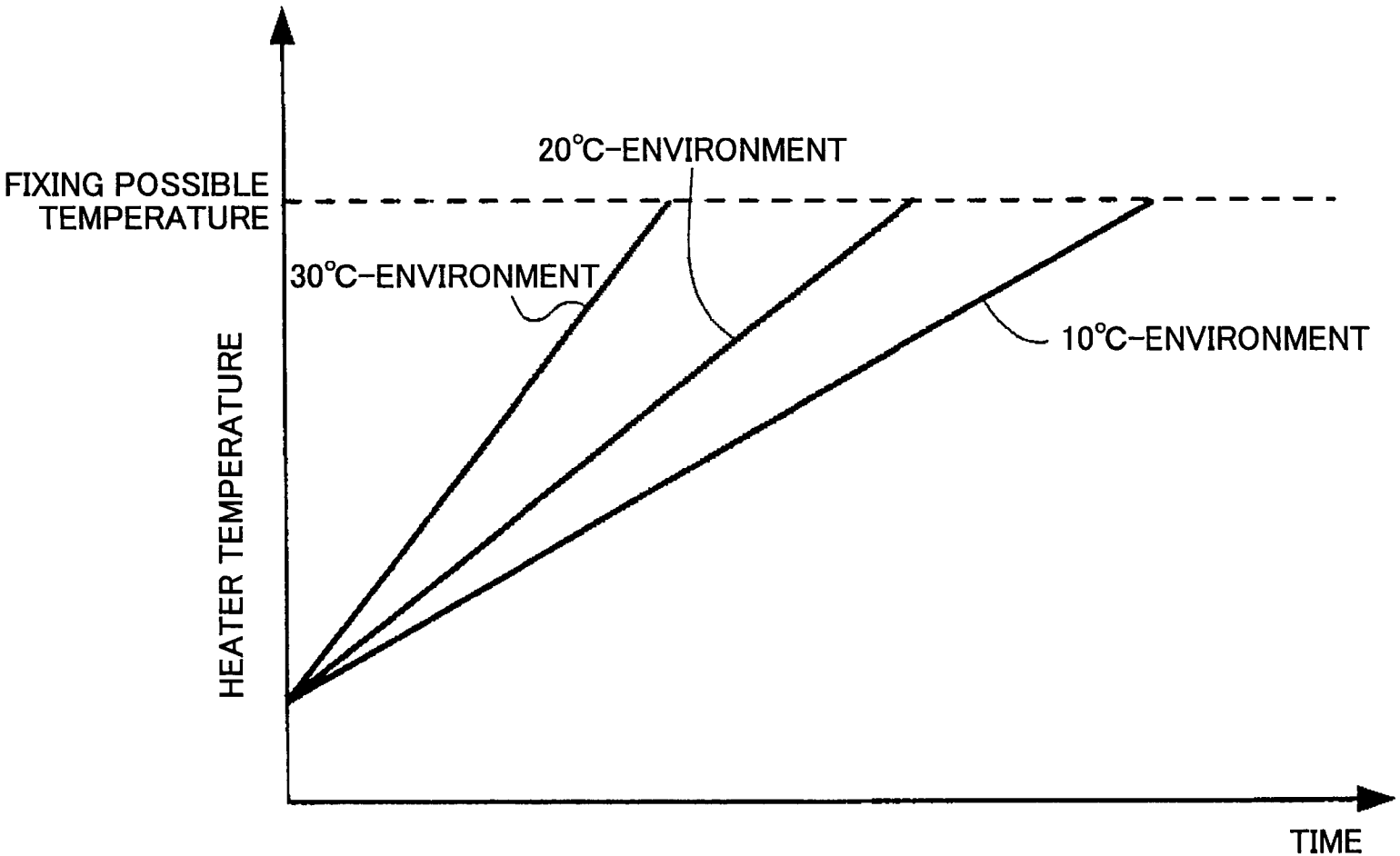
FIG. 15 is a diagram showing a relationship between time and the heater temperature for different environment temperatures of the fixing unit when starting the fixing unit in a case where no power is supplied from the auxiliary power supply unit to the auxiliary heater element.
Figure 16:
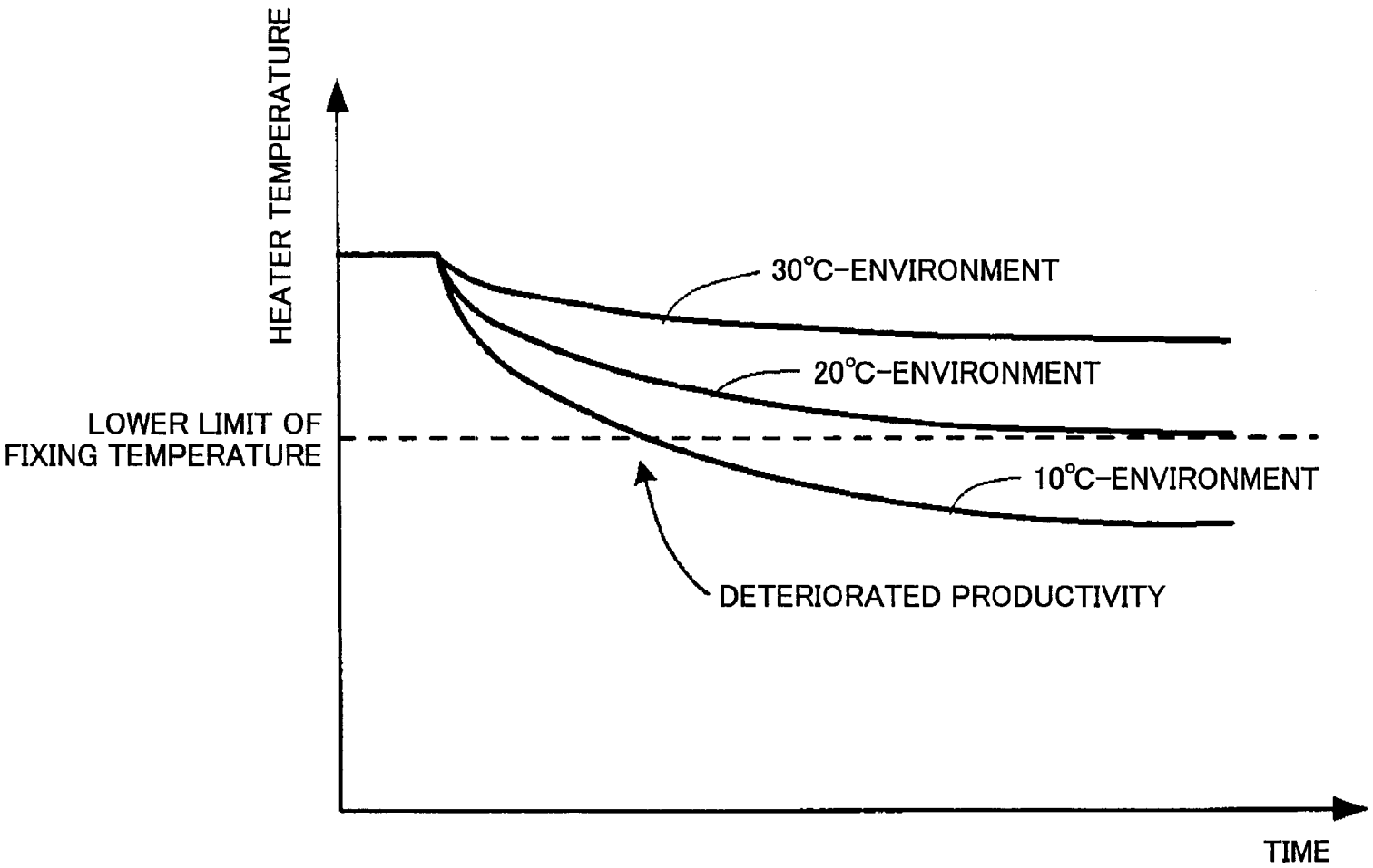
FIG. 16 is a diagram showing a relationship between time and the heater temperature for different environment temperatures of the fixing unit when the recording media are successively supplied to the fixing unit in a case where no power is supplied from the auxiliary power supply unit to the auxiliary heater element.
Figure 17:
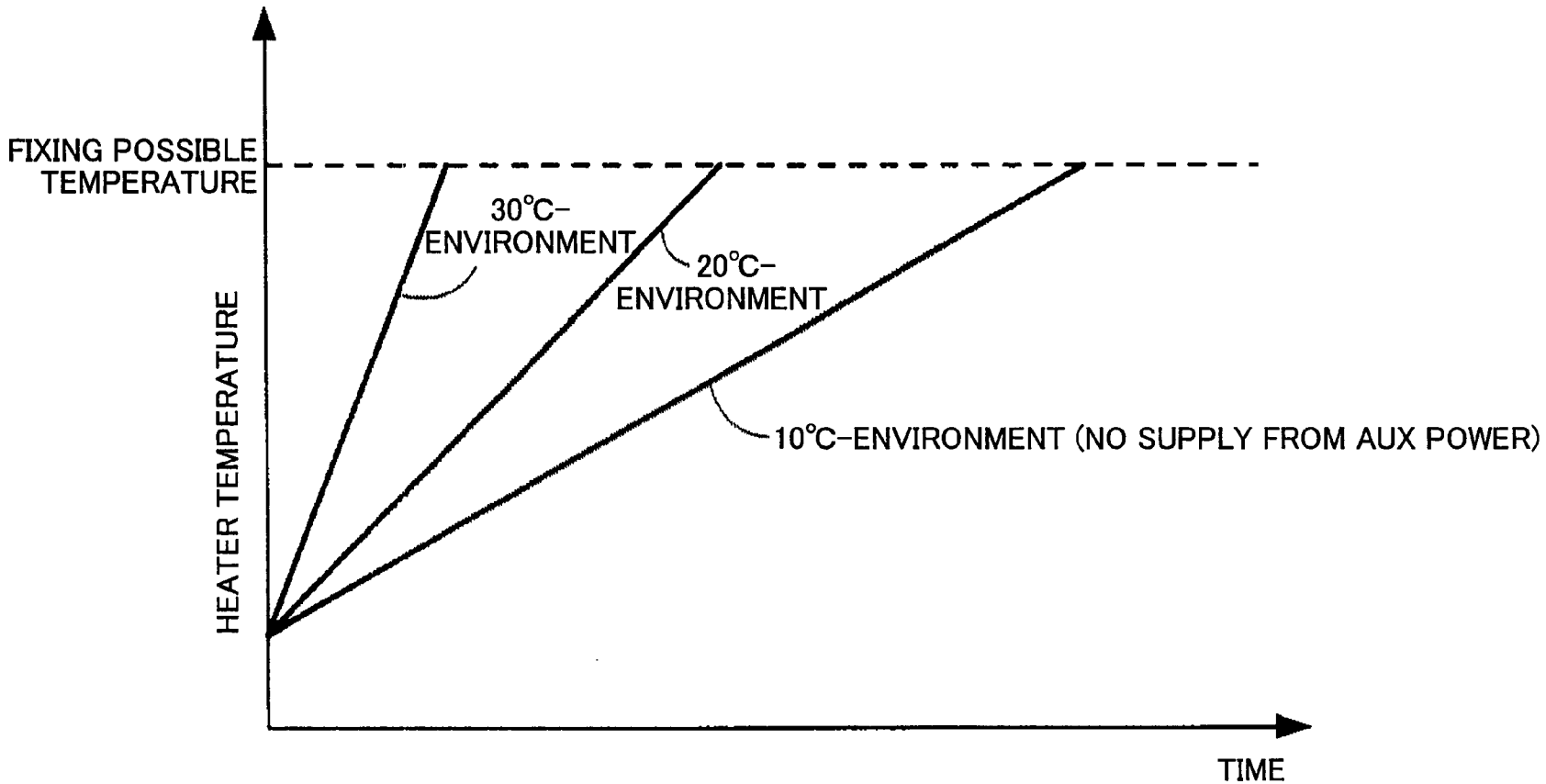
FIG. 17 is a diagram showing a relationship between time and the heater temperature for different environment temperatures of the fixing unit when starting the fixing unit in a case where the power is supplied from the auxiliary power supply unit to the auxiliary heater element.
Figure 18:
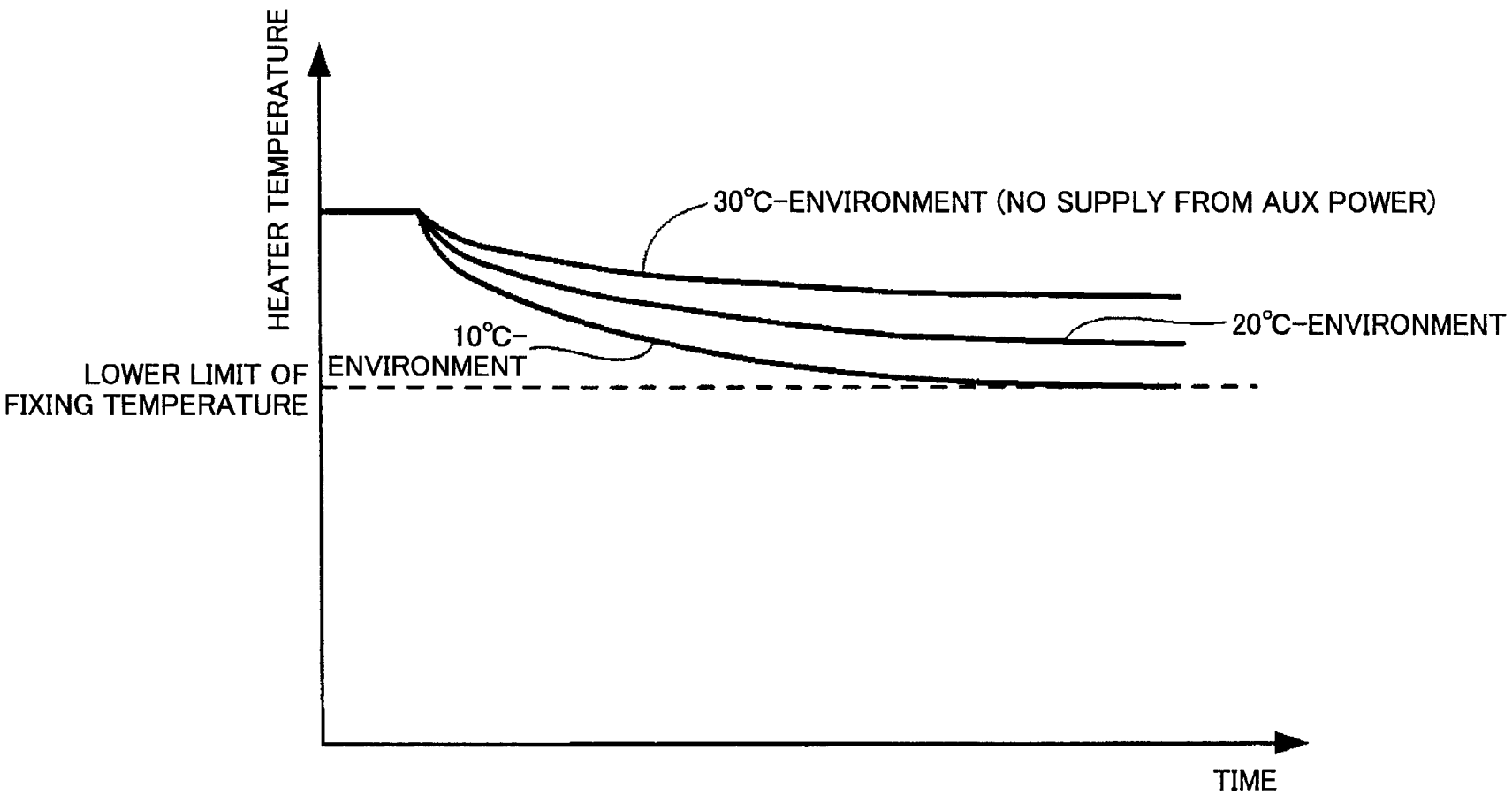
FIG. 18 is a diagram showing a relationship between time and the heater temperature for different environment temperatures of the fixing unit when the recording media are successively supplied to the fixing unit in a case where the power is supplied from the auxiliary power supply unit to the auxiliary heater element.

FIG. 15 is a diagram showing a relationship between time and the heater temperature (the surface temperature of the fixing roller 40) for different environment temperatures of the fixing unit 36 when starting the fixing unit 36 in a case where no power is supplied from the auxiliary power supply unit 4 to the auxiliary heater element 2*b*. FIG. 16 is a diagram showing a relationship between time and the heater temperature (the surface temperature of the fixing roller 40) for different environment temperatures of the fixing unit 36 when the recording media P are successively supplied to the fixing unit 36 to carry out the image forming process continuously in a case where no power is supplied from the auxiliary power supply unit 4 to the auxiliary heater element 2*b*. FIG. 17 is a diagram showing a relationship between time and the heater temperature (the surface temperature of the fixing roller 40) for different environment temperatures of the fixing unit 36 when starting the fixing unit 36 in a case where the power is supplied from the auxiliary power supply unit 4 to the auxiliary heater element 2*b*. Further, FIG. 18 is a diagram showing a relationship between time and the heater temperature (the surface temperature of the fixing roller 40) for different environment temperatures of the fixing unit 36 when the recording media P are successively supplied to the fixing unit 36 to carry out the image forming process continuously in a case where the power is supplied from the auxiliary power supply unit 4 to the auxiliary heater element 2*b*.

In a case indicated by "30° C.-environment" where the environment temperature of the fixing unit 36 is greater than or equal to a predetermined value (for example, 30° C. or greater) and sufficiently high, it may be seen from FIGS. 15 and 16 that the heater temperature does not fall below the lower limit of the fixing temperature even when the recording media P are successively supplied to the fixing unit 36 to carry out the continuous image forming process due to the small heat loss at the heater 1. For this reason, the productivity does not deteriorate during the continuous image forming process, and there is no need to use the power stored in the auxiliary power supply unit 4. Accordingly, the power from the auxiliary power supply unit 4 can be used in a power-ON state where the main power supply unit 3 is turned ON or, when the surface temperature of the fixing roller 40 (or the temperature of the fixing unit 36) is returned to the predetermined fixing temperature from the standby state (standby temperature), to thereby make it possible to reduce the time required to raise the surface temperature of the fixing roller 40 to the predetermined fixing temperature, as may be seen from FIGS. 15 and 17.

In this second modification of the third embodiment, the controller 8 controls the switch 7 based on the detected environment temperature of the fixing unit 36, so that the auxiliary power supply unit 4 is connected to the charger 6 for the continuous image forming process when the detected environment temperature of the fixing unit 36 is 30° C., and the auxiliary power supply unit 4 is connected to the auxiliary heater element 2*b* for the image forming process in the power-ON state or when the surface temperature of the fixing roller 40 (or the temperature of the fixing unit 36) is returned to the predetermined fixing temperature from the standby state (standby temperature).

In a case indicated by "10° C.-environment" where the environment temperature of the fixing unit 36 is lower than the predetermined value (for example, 10° C. or less) and not sufficiently high, the surface temperature of the fixing roller 40 will become less than the lower limit of the fixing temperature during the continuous image forming process unless the power from the auxiliary power supply unit 4 is supplied to the auxiliary heater element 2*b*. In other words, if the auxiliary power supply unit 4 is not used during the continuous image forming process in such a situation, the productivity of the image forming apparatus must be lowered in order to satisfy a desired fixing quality. Hence, in this second modification of the third embodiment, the power from the auxiliary power supply unit 4 is supplied to the auxiliary heater element 2*b* during the continuous image forming process in such a situation, so as to prevent the heater temperature from falling below the lower limit of the fixing temperature as shown in FIG. 18, and to avoid lowering the productivity.

Accordingly, in this second modification of the third embodiment, if the temperature detection signal from the temperature sensor or temperature detecting means indicates that the environment temperature of the fixing unit 36 is lower than the predetermined value and is not sufficiently high (for example, 10° C. or less), the controller 8 controls the switch 7 based on the temperature detection signal from the temperature sensor 51 so that the auxiliary power supply unit 4 is connected to the charger 6 and the auxiliary power supply unit 4 will not be used in the power-ON state or when the surface temperature of the fixing roller 40 (or the temperature of the fixing unit 36) is returned to the predetermined fixing temperature from the standby state (standby temperature). In addition, if the temperature detection signal from the temperature sensor or temperature detecting means indicates that the environment temperature of the fixing unit 36 is low, the controller 8 controls the switch 7 so that the auxiliary power supply unit 4 is connected to the auxiliary heater element 2*b* for the image forming process in the power-ON state or when the surface temperature of the fixing roller 40 (or the temperature of the fixing unit 36) is returned to the predetermined fixing temperature from the standby state (standby temperature).

On the other hand, if the temperature detection signal from the temperature sensor or temperature detecting means indicates that the environment temperature of the fixing unit 36 is an intermediate value (for example, 20° C.) that is between the sufficiently high value (for example, 30° C.) and the not sufficiently high value (for example, 10° C. or less), the controller 8 controls the switch 7 so as to supply a predetermined minimum power that can avoid deterioration of the productivity from the auxiliary power supply unit 4 to the auxiliary heater element 2*b* for the image forming process with respect to the consecutively supplied recording media P. In addition, the controller 8 controls the switch 7 so as to supply the remaining power of the auxiliary power supply unit 4 (power that remains after the discharge at the time of the image forming process with respect to the consecutively supplied recording media P) to the auxiliary heater element 2*b* in the power-ON state or when the surface temperature of the fixing roller 40 (or the temperature of the fixing unit 36) is returned to the predetermined fixing temperature from the standby state (standby temperature). Hence, as may be seen from FIGS. 17 and 18, it is possible to reduce the time required to raise the surface temperature of the fixing roller 40 (temperature of the fixing unit 36) to the predetermined fixing temperature capable of carrying out a stable fixing process.

Figure 19:
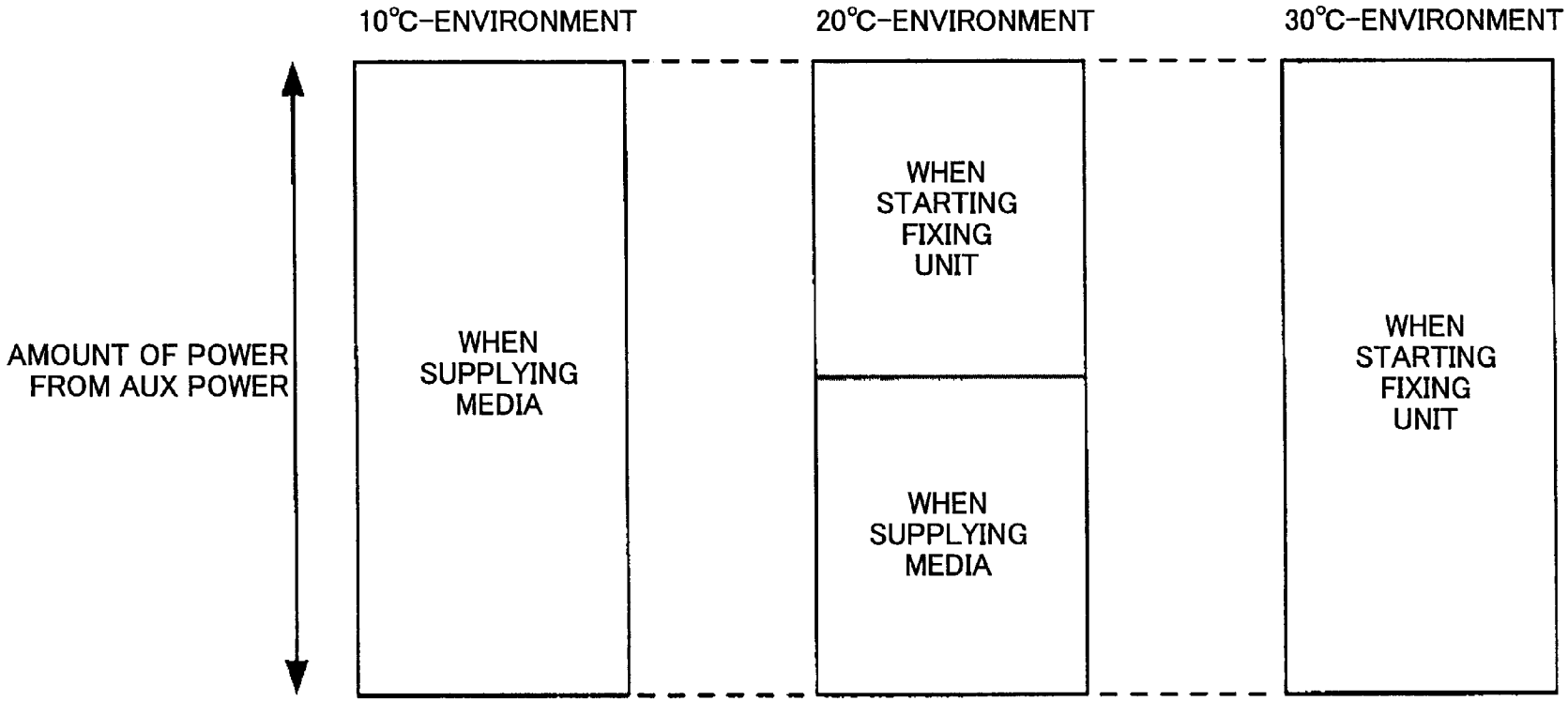
FIG. 19 is a diagram for explaining the usage and the rate of usage of the power stored in the auxiliary power supply unit.

Therefore, the power stored in the auxiliary power supply unit 4 is used differently between the power-ON state or when the surface temperature of the fixing roller 40 (or the temperature of the fixing unit 36) is returned to the predetermined fixing temperature from the standby state (standby temperature) and when the image forming process is carried out with respect to the successively supplied recording media P, depending on the environment temperature of the fixing unit 36. In addition, the usage and the rate of usage of the power stored in the auxiliary power supply unit 4 is determined as shown in FIG. 19, that is, determined differently between the power-ON state or when the surface temperature of the fixing roller 40 (or the temperature of the fixing unit 36) is returned to the predetermined fixing temperature from the standby state (standby temperature) and when the image forming process is carried out with respect to the successively supplied recording media P, so as to effectively utilize the power stored in the auxiliary power supply unit 4. FIG. 19 is a diagram for explaining the usage and the rate of usage of the power stored in the auxiliary power supply unit 4. As a result, it is possible to reduce the time required to raise the surface temperature of the fixing roller 40 when the main power supply unit 3 is turned ON and reduce the time required to raise the surface temperature of the fixing roller 40 to the predetermined fixing temperature capable of carrying out the stable fixing process from the standby state such as the sleep mode and the power save mode of the image forming apparatus. It is also possible to maintain a satisfactory fixing quality without deteriorating the productivity when carrying out the image forming process with respect to the successively supplied recoding media P.

Similarly, the environment temperature of the heater 1 or the temperature of the image forming apparatus, that is, the internal or external temperature of the image forming apparatus, may be used for the information that is related to the heater 1 (or heater part 2).

Third Modification of Third Embodiment

In a third modification of the third embodiment, an output voltage of the auxiliary power supply unit 4 is used for the information that is related to the heater 1 (or heater part 2). A known detecting unit or means (not shown) detects the output voltage of the auxiliary power supply unit 4. The controller 8 controls the switch 7 based on the voltage detection signal that is indicative of the output voltage of the auxiliary power supply unit 4 and is received from the known detecting unit or means, so as to control the usage of the power stored in the auxiliary power supply unit 4.

FIGS. 20 through 23 are diagrams showing relationships between time and the heater temperature, that is, the surface temperature of the fixing roller 40, for different output voltages of the auxiliary power supply unit 4. In FIGS. 20 through 23, the voltage values of 45 V, 35 V and 25 V are merely examples and the voltage values are not limited to such, and the time base is shown in arbitrary units.

Figure 20:
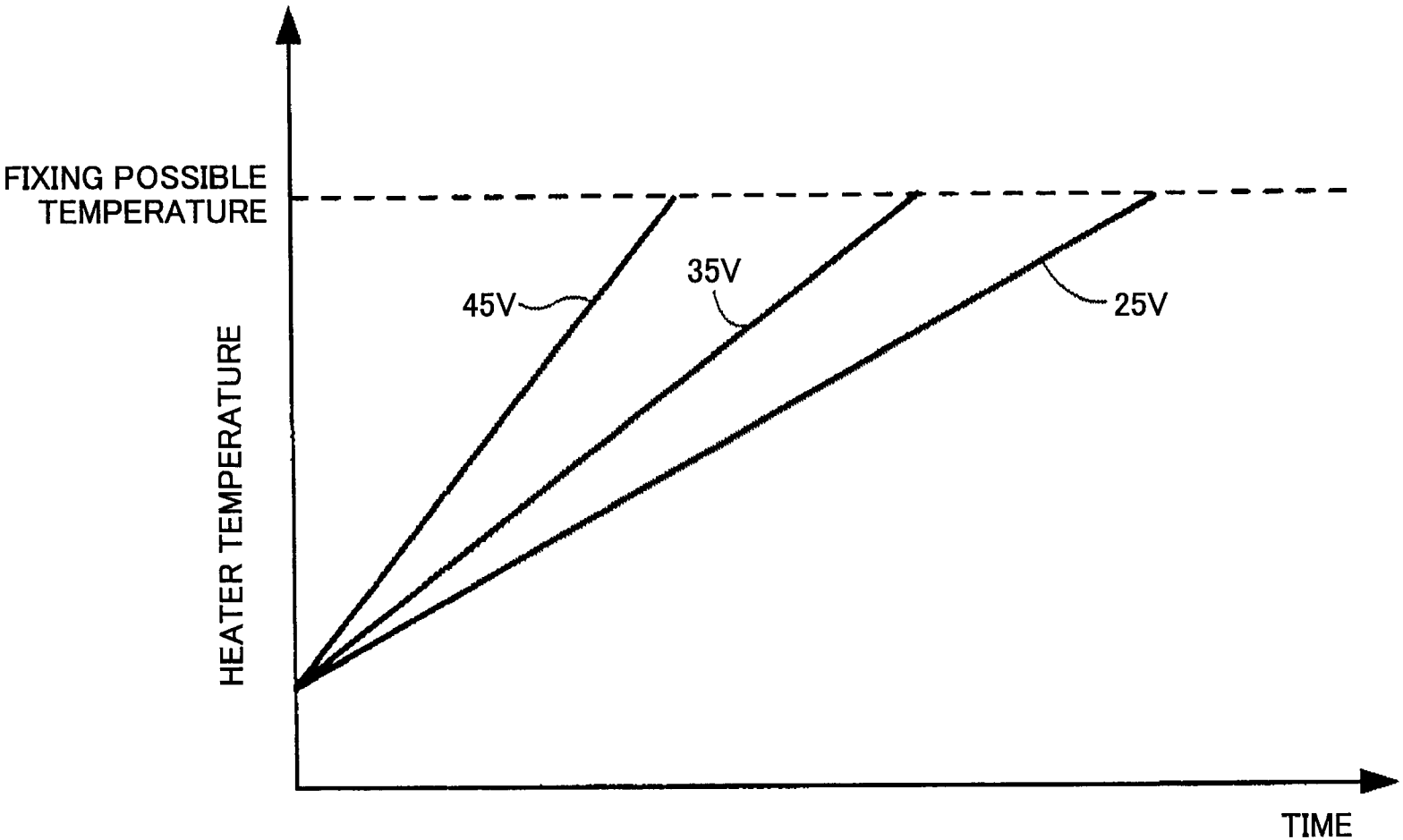
FIG. 20 is a diagram showing a relationship between time and the heater temperature for different output voltages of the auxiliary power supply unit when starting the fixing unit in a case where no power is supplied from the auxiliary power supply unit to the auxiliary heater element.
Figure 21:
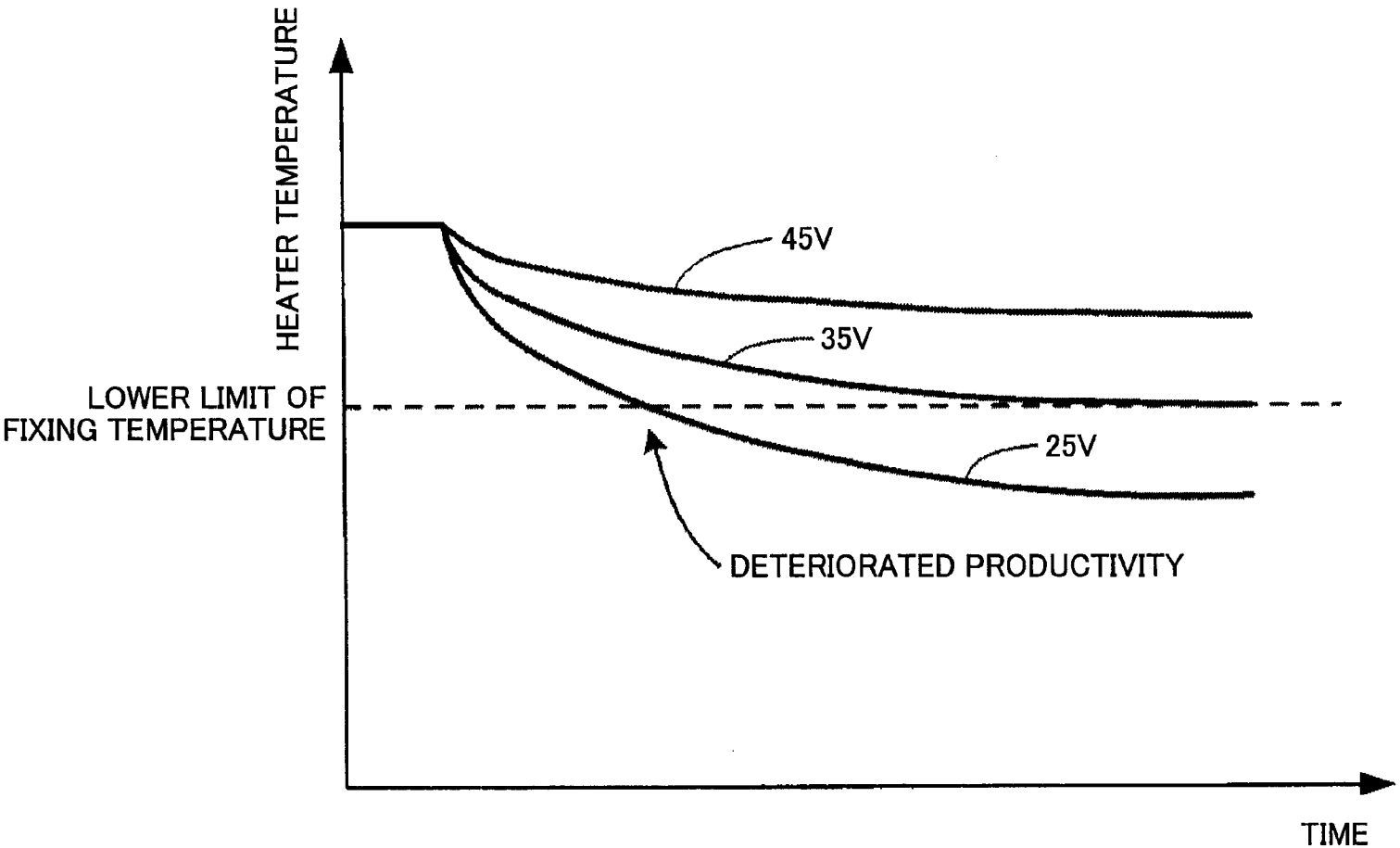
FIG. 21 is a diagram showing a relationship between time and the heater temperature for different output voltages of the auxiliary power supply unit when the recording media are successively supplied to the fixing unit in a case where no power is supplied from the auxiliary power supply unit to the auxiliary heater element.
Figure 22:
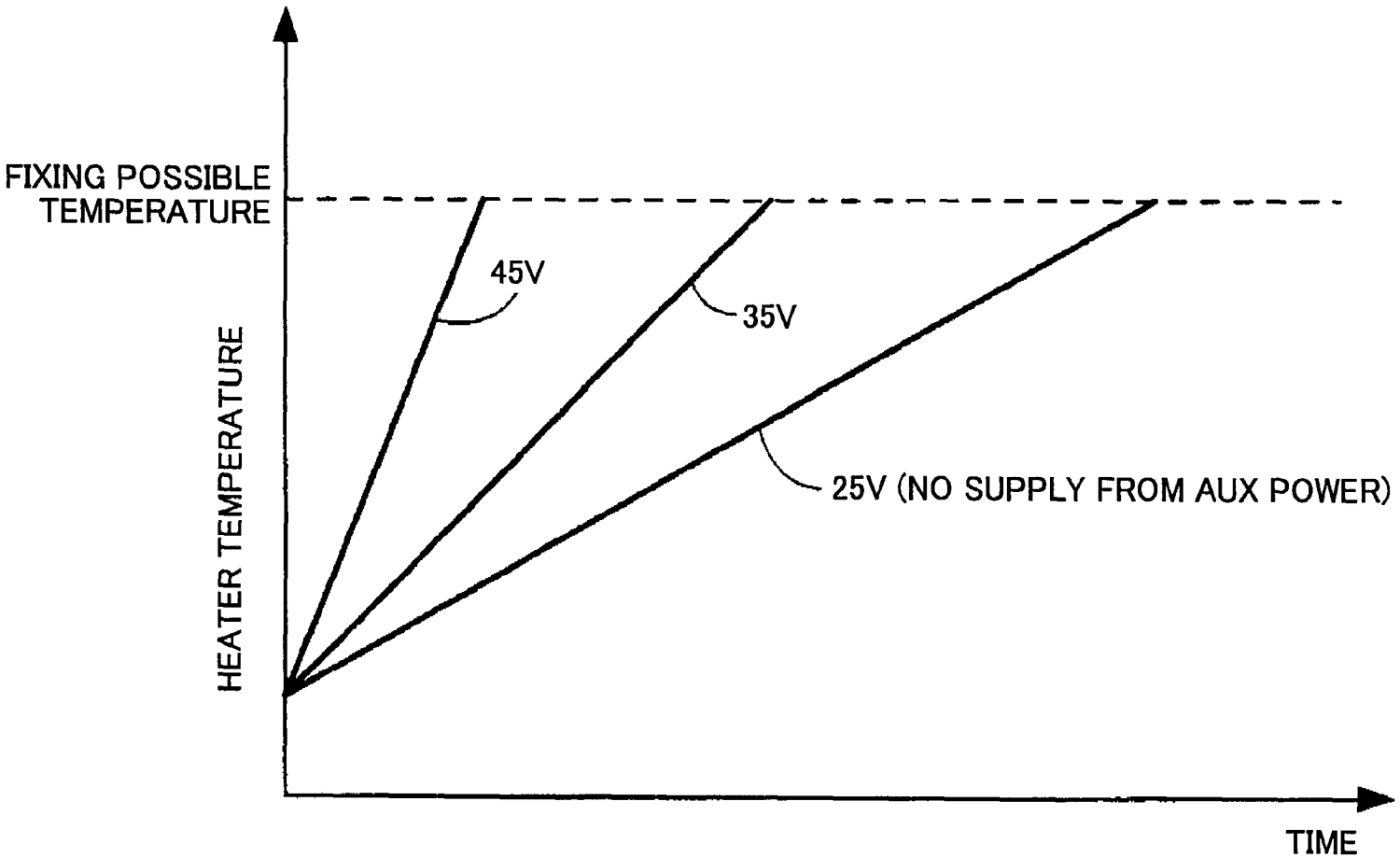
FIG. 22 is a diagram showing a relationship between time and the heater temperature for different output voltages of the auxiliary power supply unit when starting the fixing unit in a case where the power is supplied from the auxiliary power supply unit to the auxiliary heater element.
Figure 23:
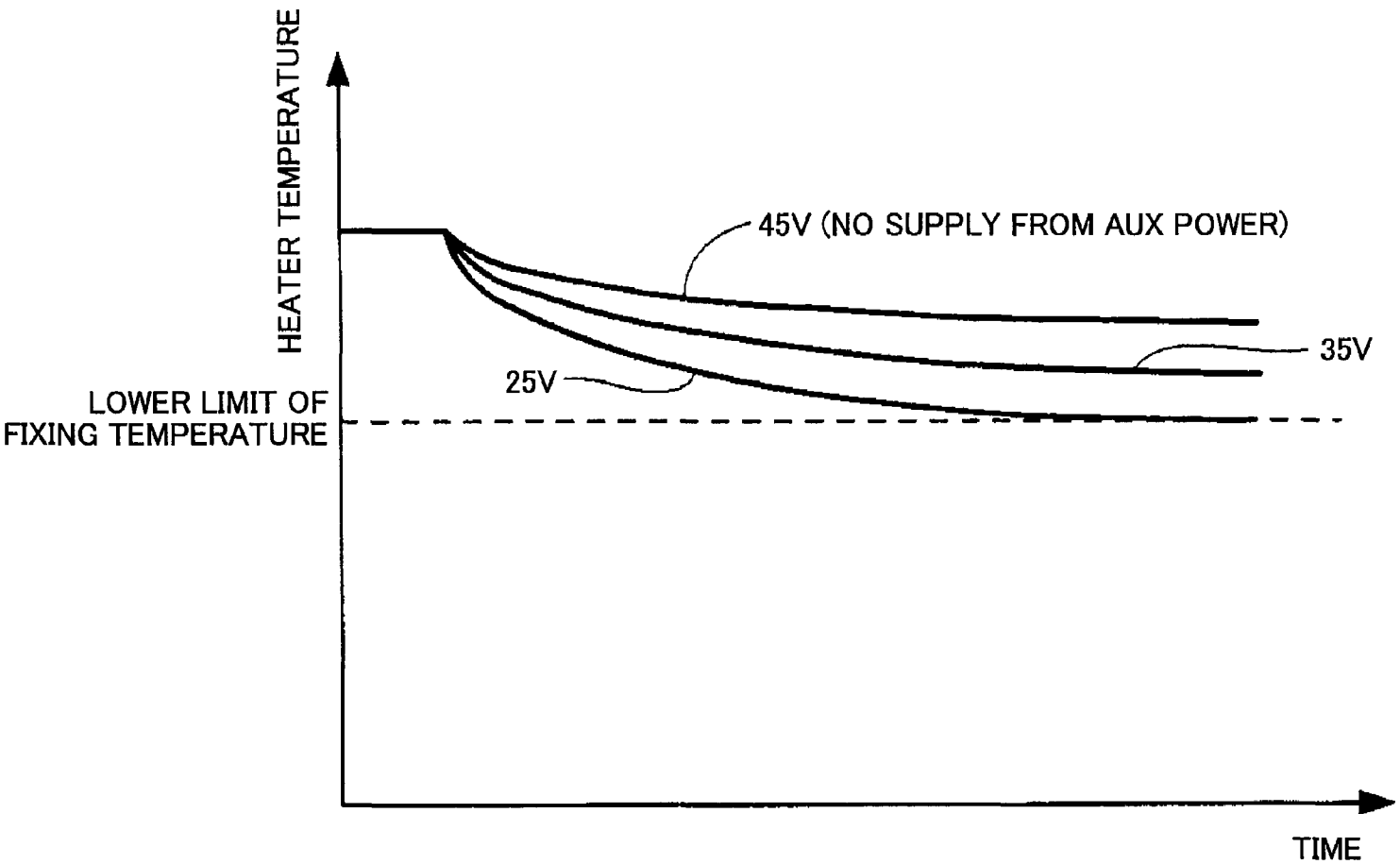
FIG. 23 is a diagram showing a relationship between time and the heater temperature for different output voltages of the auxiliary power supply unit when the recording media are successively supplied to the fixing unit in a case where the power is supplied from the auxiliary power supply unit to the auxiliary heater element.

FIG. 20 is a diagram showing a relationship between time and the heater temperature (the surface temperature of the fixing roller 40) for different output voltages of the auxiliary power supply unit 4 when starting the fixing unit 36 in a case where no power is supplied from the auxiliary power supply unit 4 to the auxiliary heater element 2*b*. FIG. 21 is a diagram showing a relationship between time and the heater temperature (the surface temperature of the fixing roller 40) for different output voltages of the auxiliary power supply unit 4 when the recording media P are successively supplied to the fixing unit 36 to carry out the image forming process continuously in a case where no power is supplied from the auxiliary power supply unit 4 to the auxiliary heater element 2*b*. FIG. 22 is a diagram showing a relationship between time and the heater temperature (the surface temperature of the fixing roller 40) for different output voltages of the auxiliary power supply unit 4 when starting the fixing unit 36 in a case where the power is supplied from the auxiliary power supply unit 4 to the auxiliary heater element 2*b*. Further, FIG. 23 is a diagram showing a relationship between time and the heater temperature (the surface temperature of the fixing roller 40) for different output voltages of the auxiliary power supply unit 4 when the recording media P are successively supplied to the fixing unit 36 to carry out the image forming process continuously in a case where the power is supplied from the auxiliary power supply unit 4 to the auxiliary heater element 2*b*.

In a case indicated by "45 V-output" where the output voltage of the auxiliary power supply unit 4 is greater than or equal to a predetermined value (for example, 45 V or greater) and sufficiently high, it may be seen from FIGS. 20 and 21 that the heater temperature does not fall below the lower limit of the fixing temperature even when the recording media P are successively supplied to the fixing unit 36 to carry out the continuous image forming process due to the small heat loss at the heater 1. For this reason, the productivity does not deteriorate during the continuous image forming process, and there is no need to use the power stored in the auxiliary power supply unit 4. Accordingly, the power from the auxiliary power supply unit 4 can be used in a power-ON state where the main power supply unit 3 is turned ON or, when the surface temperature of the fixing roller 40 (or the temperature of the fixing unit 36) is returned to the predetermined fixing temperature from the standby state (standby temperature), to thereby make it possible to reduce the time required to raise the surface temperature of the fixing roller 40 to the predetermined fixing temperature, as may be seen from FIGS. 20 and 22.

In this third modification of the third embodiment, the controller 8 controls the switch 7 based on the detected output voltage of the auxiliary power supply unit 4, so that the auxiliary power supply unit 4 is connected to the charger 6 for the continuous image forming process when the detected output voltage of the auxiliary power supply unit 4 is greater than or equal to the predetermined value (for example, 45 V or greater), and the auxiliary power supply unit 4 is connected to the auxiliary heater element 2*b* for the image forming process in the power-ON state or when the surface temperature of the fixing roller 40 (or the temperature of the fixing unit 36) is returned to the predetermined fixing temperature from the standby state (standby temperature).

In a case indicated by "25 V-output" where the output voltage of the auxiliary power supply unit 4 is lower than the predetermined value (for example, 25 V or less) and not sufficiently high, the surface temperature of the fixing roller 40 will become less than the lower limit of the fixing temperature during the continuous image forming process unless the power from the auxiliary power supply unit 4 is supplied to the auxiliary heater element 2*b*. In other words, if the auxiliary power supply unit 4 is not used during the continuous image forming process in such a situation, the productivity of the image forming apparatus must be lowered in order to satisfy a desired fixing quality. Hence, in this third modification of the third embodiment, the power from the auxiliary power supply unit 4 is supplied to the auxiliary heater element 2*b* during the continuous image forming process in such a situation, so as to prevent the heater temperature from falling below the lower limit of the fixing temperature as shown in FIG. 23, and to avoid lowering the productivity.

Accordingly, in this third modification of the third embodiment, if the voltage detection signal from the detecting unit or means indicates that the output voltage of the auxiliary power supply unit 4 is lower than the predetermined value and is not sufficiently high (for example, 25 V or less), the controller 8 controls the switch 7 based on the temperature detection signal from the temperature sensor 51 so that the auxiliary power supply unit 4 is connected to the charger 6 and the auxiliary power supply unit 4 will not be used in the power-ON state or when the surface temperature of the fixing roller 40 (or the temperature of the fixing unit 36) is returned to the predetermined fixing temperature from the standby state (standby temperature). In addition, if the voltage detection signal from the detecting unit or means indicates that the auxiliary power supply unit 4 is low, the controller 8 controls the switch 7 so that the auxiliary power supply unit 4 is connected to the auxiliary heater element 2*b* for the image forming process in the power-ON state or when the surface temperature of the fixing roller 40 (or the temperature of the fixing unit 36) is returned to the predetermined fixing temperature from the standby state (standby temperature).

On the other hand, if the voltage detection signal from the detecting unit or means indicates that the output voltage of the auxiliary power supply unit 4 is an intermediate value (for example, 35 V) that is between the sufficiently high value (for example, 45 V) and the not sufficiently high value (for example, 25 V or less), the controller 8 controls the switch 7 so as to supply a predetermined minimum power that can avoid deterioration of the productivity from the auxiliary power supply unit 4 to the auxiliary heater element 2*b* for the image forming process with respect to the consecutively supplied recording media P. In addition, the controller 8 controls the switch 7 so as to supply the remaining power of the auxiliary power supply unit 4 (power that remains after the discharge at the time of the image forming process with respect to the consecutively supplied recording media P) to the auxiliary heater element 2*b* in the power-ON state or when the surface temperature of the fixing roller 40 (or the temperature of the fixing unit 36) is returned to the predetermined fixing temperature from the standby state (standby temperature). Hence, as may be seen from FIGS. 22 and 23, it is possible to reduce the time required to raise the surface temperature of the fixing roller 40 (temperature of the fixing unit 36) to the predetermined fixing temperature capable of carrying out a stable fixing process.

Figure 24:
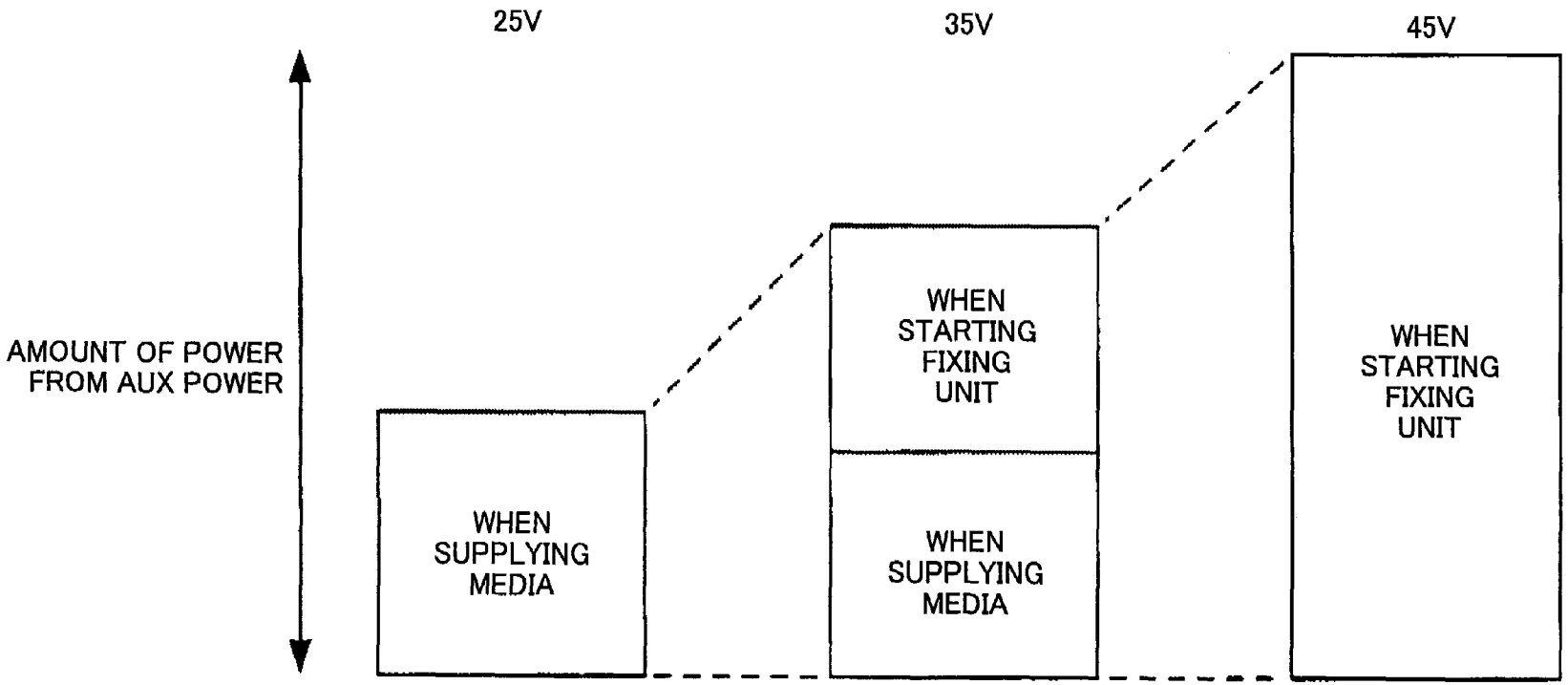
FIG. 24 is a diagram for explaining the usage and the rate of usage of the power stored in the auxiliary power supply unit.

Therefore, the power stored in the auxiliary power supply unit 4 is used differently between the power-ON state or when the surface temperature of the fixing roller 40 (or the temperature of the fixing unit 36) is returned to the predetermined fixing temperature from the standby state (standby temperature) and when the image forming process is carried out with respect to the successively supplied recording media P, depending on the output voltage of the auxiliary power supply unit 4. In addition, the usage and the rate of usage of the power stored in the auxiliary power supply unit 4 is determined as shown in FIG. 24, that is, determined differently between the power-ON state or when the surface temperature of the fixing roller 40 (or the temperature of the fixing unit 36) is returned to the predetermined fixing temperature from the standby state (standby temperature) and when the image forming process is carried out with respect to the successively supplied recording media P, so as to effectively utilize the power stored in the auxiliary power supply unit 4. FIG. 24 is a diagram for explaining the usage and the rate of usage of the power stored in the auxiliary power supply unit 4. As a result, it is possible to reduce the time required to raise the surface temperature of the fixing roller 40 when the main power supply unit 3 is turned ON and reduce the time required to raise the surface temperature of the fixing roller 40 to the predetermined fixing temperature capable of carrying out the stable fixing process from the standby state such as the sleep mode and the power save mode of the image forming apparatus. It is also possible to maintain a satisfactory fixing quality without deteriorating the productivity when carrying out the image forming process with respect to the successively supplied recoding media P.

Of course, two or more of the first through third modifications of the third embodiment may be appropriately combined to suit the needs if necessary.

Therefore, according to the third embodiment and the modifications thereof, only a necessary amount of power from the auxiliary power supply unit is supplied to the fixing unit (or heater) depending on the usage, such as when raising the temperature of the fixing unit (or heater) to the predetermined fixing temperature and when carrying out the image forming process in response to the supplied recording medium, so as to reduce the time required to raise the temperature of the fixing unit (or heater) and to simultaneously avoid deterioration of the productivity.

Fourth Embodiment

As described above, a method has been proposed to simultaneously supply the power from the main power supply unit and the power from the auxiliary power supply unit to the plurality of heater elements of the fixing unit, so as to reduce the waiting time that is required to raise the temperature of the fixing unit to a reload temperature, that is, the predetermined fixing temperature capable of carrying out the stable fixing process. By reducing this waiting time, it is also possible to reduce the total time required to form the image on the recording medium. The Japanese Laid-Open Patent Application No. 2002-174988 described above proposes such a method.

However, even in the case of the image forming apparatus employing such a proposed method, which places priority on the image quality, a deterioration in the image quality may occur due to incomplete or abnormal fixing. In addition, it is difficult to simultaneously realize a long serviceable life of the auxiliary power supply unit and a high image quality.

A fourth embodiment of the present invention is designed to suppress the above described problems of the conventional image forming apparatus.

A description will be given of the preconditions of the fourth embodiment of the image forming apparatus, the fourth embodiment of the heater and the fourth embodiment of the fixing unit according to the present invention.

Figure 25:
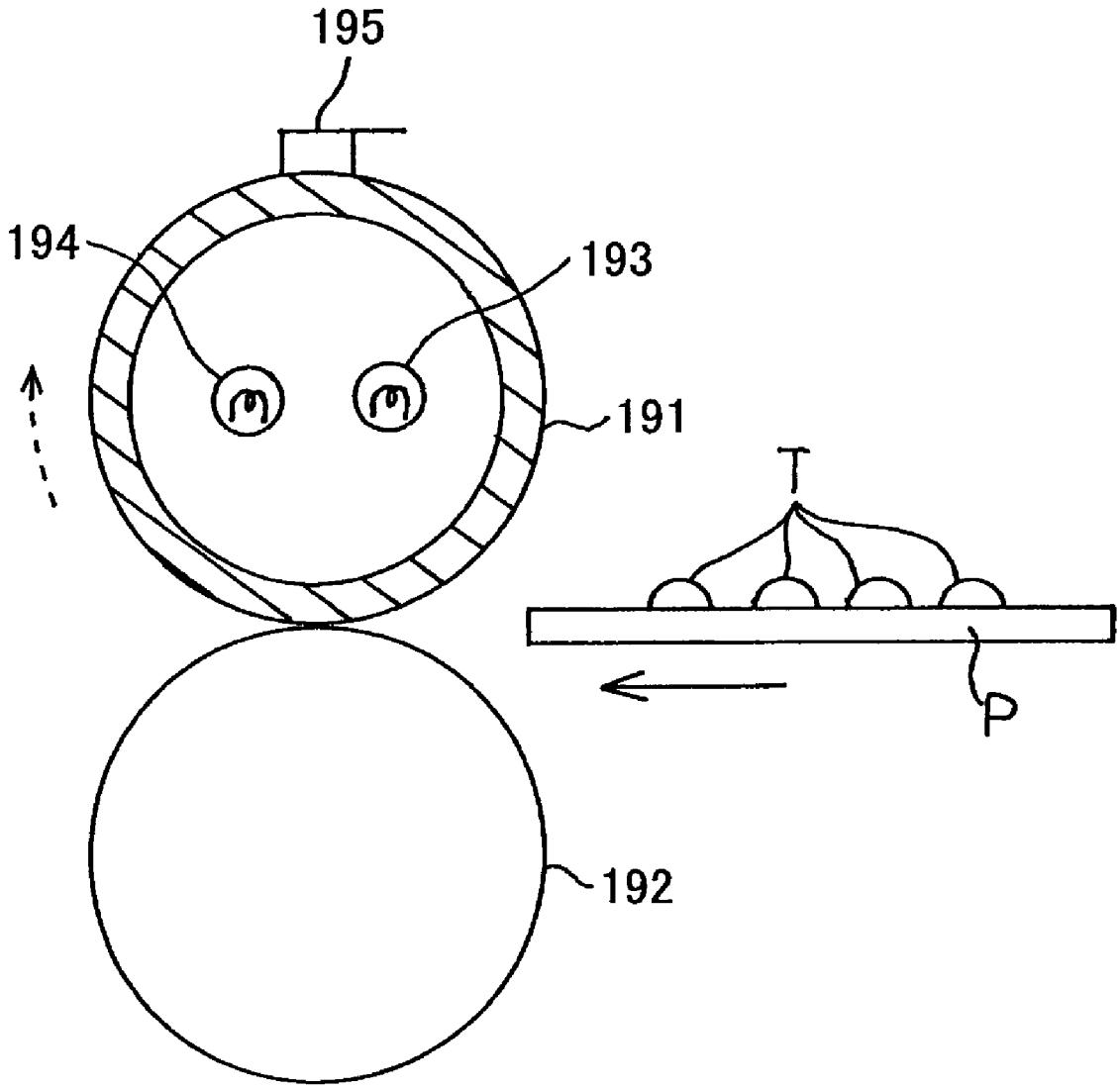
FIG. 25 is a cross sectional view showing a fixing unit having a type of structure employed in a fourth embodiment.

FIG. 25 is a cross sectional view showing a fixing unit having a type of structure employed in this fourth embodiment. In FIG. 25, a known pressing mechanism or means (not shown) urges a pressure roller 192 to press against a fixing roller 191 with a predetermined nip pressure, and the fixing roller 191 is rotated clockwise and the pressure roller 192 is rotated counterclockwise by a known driving mechanism or means (not shown). The fixing roller 191 includes a main heater element 193 and an auxiliary heater element 194 which heat the fixing roller 191 so that the surface temperature of the fixing roller 191 reaches a predetermined fixing temperature capable of carrying out a fixing process with respect to a toner image (or toner T) that is formed on a recording medium P. The surface temperature of the fixing roller 191 is monitored by a temperature sensor 195 which makes contact with the surface of the fixing roller 191, for example.

When carrying out the image forming process in the image forming apparatus employing the electrophotography technique, the recording medium P formed with the toner image (or toner T) is supplied to the nip part between the fixing roller 191 and the pressure roller 192, as indicated by an arrow in FIG. 25. The toner image is fixed on the recording medium P as the recording medium P passes between the fixing roller 191 and the pressure roller 192 due to the heat and pressure applied on the recording medium P. A predetermined amount of heat needs to be applied on the recording medium P in order to fix the toner image, and thus, the supply of power to the main and auxiliary heater elements 193 and 194 is controlled so that the surface temperature of the fixing roller 191 reaches the reload temperature, that is, the predetermined fixing temperature capable of carrying out a stable fixing process.

Figure 26:
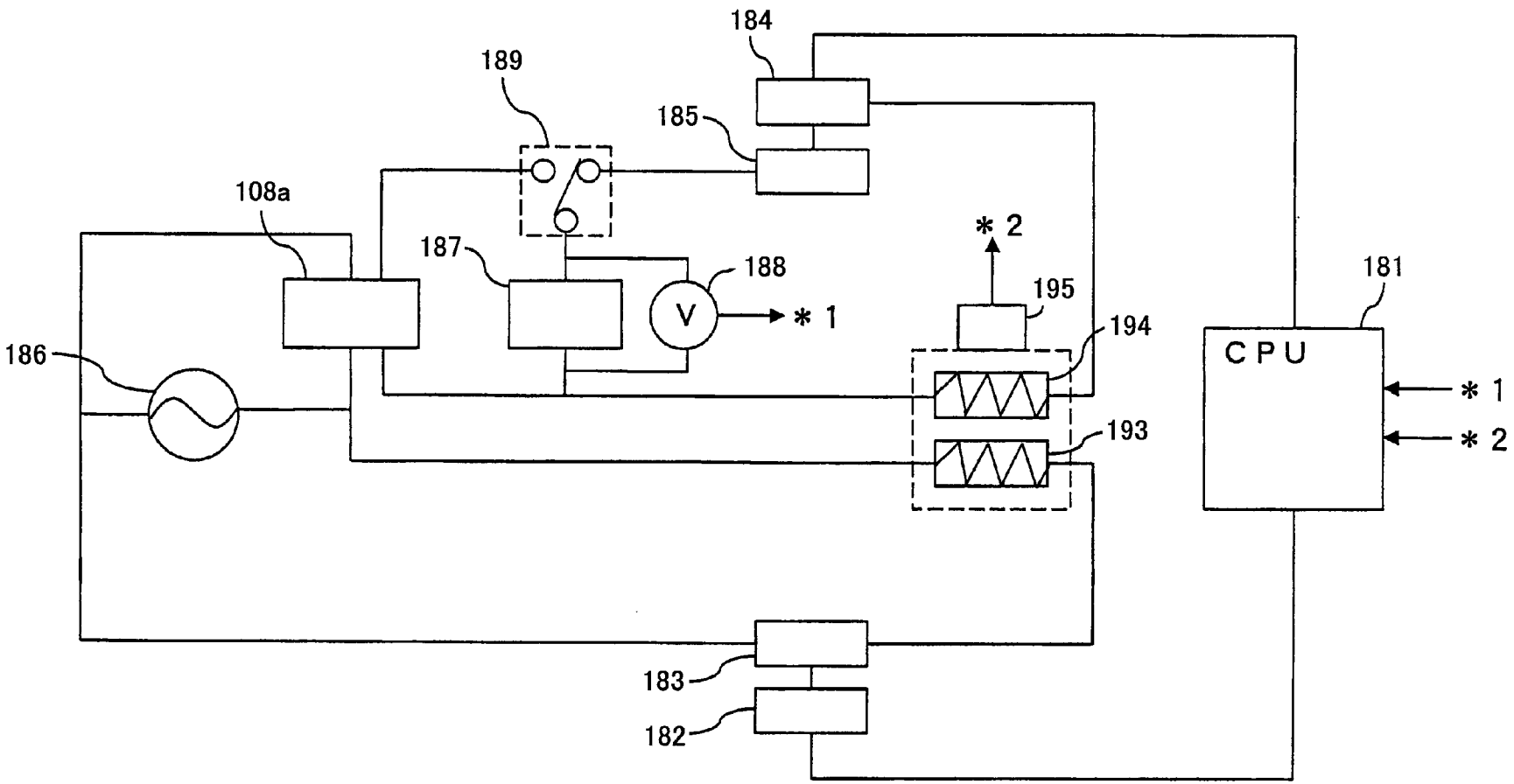
FIG. 26 is a circuit diagram showing a fixing unit system having a type of structure employed in the fourth embodiment.

FIG. 26 is a circuit diagram showing a fixing unit system having a type of structure employed in this fourth embodiment. In a fixing unit system 190 shown in FIG. 26, the main heater element 193 receives the power supplied from a main power supply unit 186, that is, an external power supply such as a commercial power supply. On the other hand, the auxiliary heater element 193 receives the power supplied from an auxiliary power supply unit 187 which is formed by a capacitor, for example. The auxiliary heater element 194 is desirably made up of a plurality of heater elements that are connected in parallel to the capacitor of the auxiliary power supply unit 187, so that at least one of these heater elements can be connected to the capacitor by controlling a switch part (not shown). For example, all of the heater elements of the auxiliary heater element 194 are connected to the capacitor when starting the image forming apparatus, and one or more selected heater elements (less than the total number of heater elements) are connected to the capacitor when carrying out the image forming process by supplying the recording medium P to the fixing unit.

A charged voltage detector 188 detects a capacitor voltage of the capacitor, indicating the charged energy (remaining amount of power) of the auxiliary power supply unit 187, and outputs a voltage detection signal *1 indicative of the detected capacitor voltage. The temperature sensor 195 detects the surface temperature of the fixing roller 191, and outputs a temperature detection signal *2 indicative of the detected surface temperature. The detection signals *1 and *2 are supplied to a controller that is formed by a CPU 181 directly, or via an input circuit (not shown). The CPU 181 controls the supply of power via a triac 183 to the main heater element 193 via a controller 182, and controls the supply of power via a FET 185 to the auxiliary heater element 194 via a controller 184, based on the detection signals *1 and *2, so that the surface temperature of the fixing roller 191 reaches a set temperature. The capacitor of the auxiliary power supply unit 197 is connected to a charger 108*a* and becomes chargeable by controlling a switch 189. The charged voltage detector 188 is connected to the capacitor of the auxiliary power supply unit 187.

Figure 27:
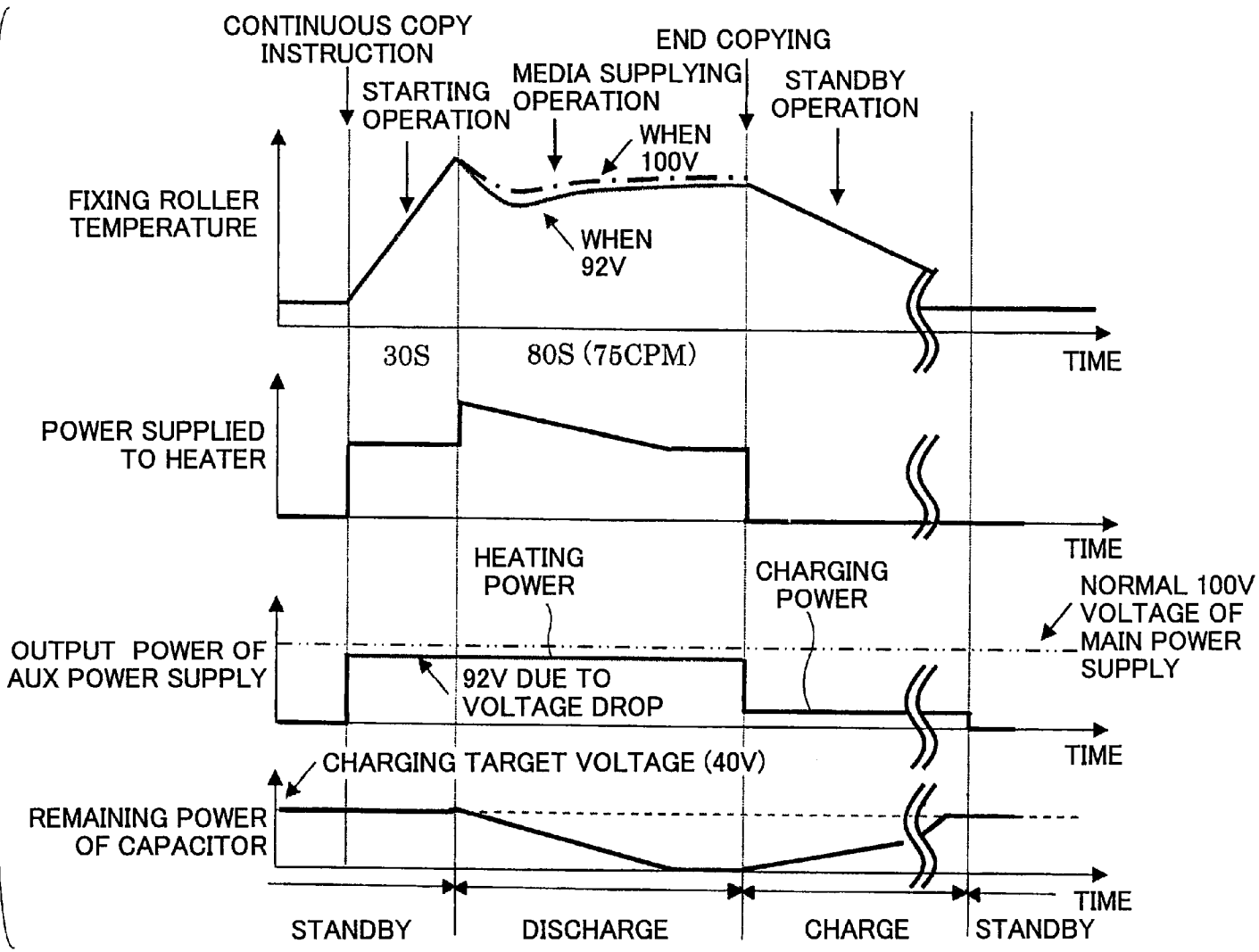
FIG. 27 is a diagram for explaining an operation of the fixing unit system shown in FIG. 26.

FIG. 27 is a diagram for explaining an operation of the fixing unit system 190 shown in FIG. 26. For the sake of convenience, it is assumed that the fixing unit system 190 operates under the following preconditions when carrying out steps s81 through s83.

Cpm conditions (number of recording media P subjected to the image forming process (that is, number of copies made) per minute): 75 cpm Capacitor charging target voltage: 40 V (capacitor rated voltage: 45 V)

Copy instruction: Continuous copy instruction that instructs a continuous image forming process with respect to 100 successively supplied recording media P Capacitor voltage when copy instruction issued: 40 V Step s81: The capacitor voltage (40 V) of the capacitor of the auxiliary power supply unit 187 is detected by the charged voltage detector 188, and the voltage detection signal *1 is input to the CPU 181. Based on the voltage detection signal *1, the CPU 181 confirms that the capacitor voltage (40 V) is greater than or equal to the capacitor charging target voltage (40 V). The capacitor of the auxiliary power supply unit 187 is in a discharge standby state.

Step s82: When a continuous copy instruction is issued in response to a copy key (or button) of an operation part that is pushed by a user, for example, the operation of the fixing unit system 190 is started. More particularly, the power from the main power supply unit 186 is supplied to the main heater element 193, and the fixing roller 191 is heated. For example, a starting time of 30 seconds is required to raise the surface temperature of the fixing roller 191 to the set temperature. In this state, the capacitor of the auxiliary power supply unit 197 is in a standby state.

Step s83: The supply of the recording media P at 75 cpm is started, and the power from the main power supply unit 186 is supplied to the main heater element 193 and the power from the auxiliary power supply unit 187 is supplied to the auxiliary heater element 194. The fixing roller 191 is heated by the heater elements 193 and 194, and the toner image (toner T) on each recording medium P is fixed as the recording media P successively pass through the nip part between the fixing roller 191 and the pressure roller 192.

Although the power from both the main and auxiliary power supply units 186 and 187 are supplied to the fixing unit in this state, the present inventors have found that an incomplete fixing (or unstable fixing) may occur in some cases. According to analysis performed by the present inventors, it was found that the incomplete fixing is caused by a voltage drop (drop to 92 V in the case shown in FIG. 27) of the main power supply unit 186.

In other words, because the amount of power supplied from the main power supply unit (commercial power supply) 186 is assumed to be constant (for example, 100 V and 15 A) and the amount of power to be supplied from the capacitor of the auxiliary power supply unit 187 is set by subtracting the amount of power supplied from the main power supply unit 186 from the amount of power required by the fixing unit, the voltage drop of the main power supply unit 186 caused insufficient heating of the fixing unit and resulted in the surface temperature of the fixing roller 191 becoming lower than the reload temperature.

In addition, in recent office environments, not only the office automation (OA) equipments but also various electronic and electrical equipments such as personal computers receive the power supplied from the commercial power supply, that is, the main power supply unit 186. For this reason, it was found that the main power supply unit 186 cannot always supply constant power (100 V and 15 A). Furthermore, the extent of the voltage drop of the main power supply unit 186 is dependent on the electronic and electrical equipments used and varies for each office environment, thereby making it difficult to prevent the incomplete fixing in the image forming apparatus.

The present inventors have found that the problems described above can be suppressed and the utilization efficiency of the capacitor of the auxiliary power supply unit can be improved, by monitoring an output voltage of the commercial power supply, that is, the main power supply unit.

Figure 28:
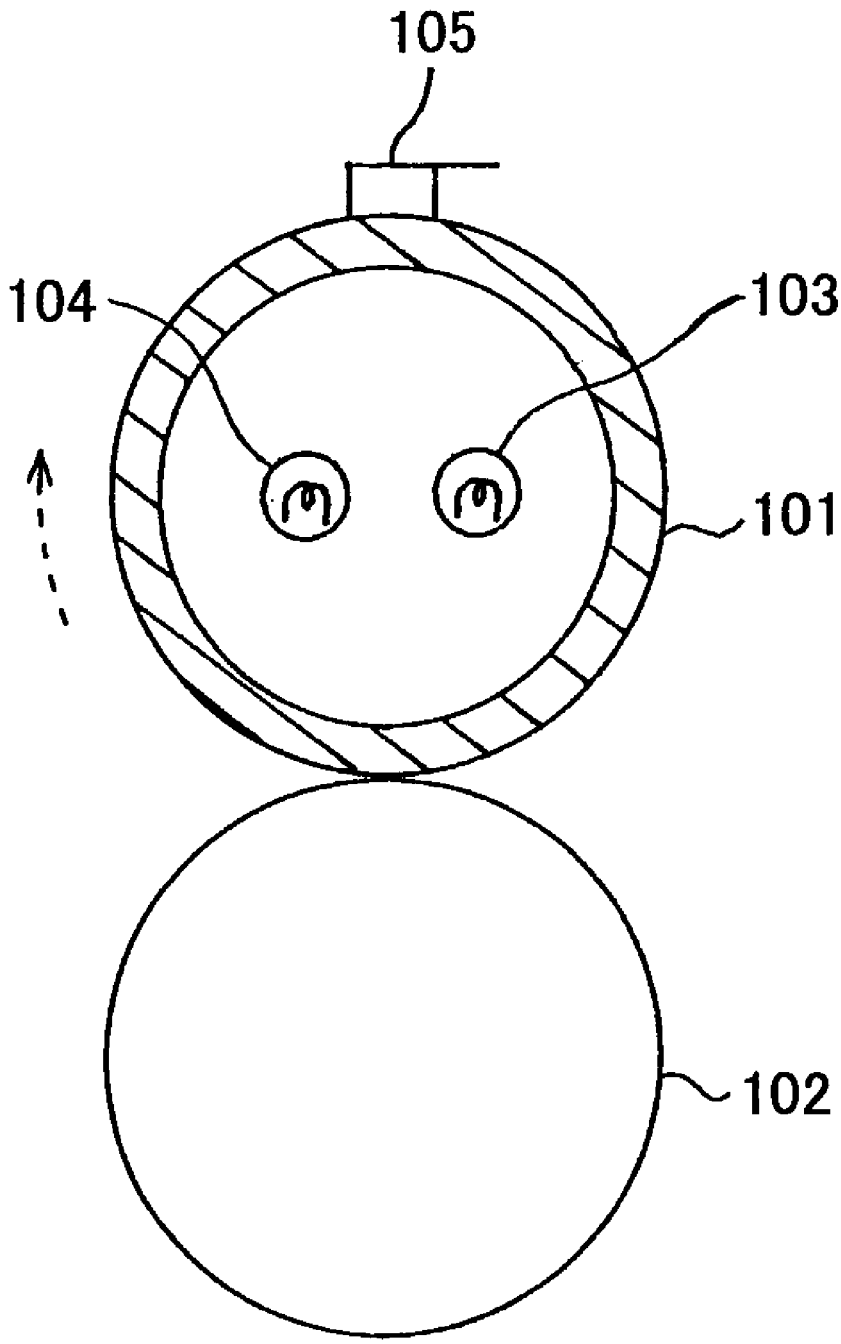
FIG. 28 is a cross sectional view showing a fixing unit of the fourth embodiment.

FIG. 28 is a cross sectional view showing a fixing unit of the fourth embodiment. In FIG. 28, a known pressing mechanism or means (not shown) urges a pressure roller 102 to press against a fixing roller 101 with a predetermined nip pressure, and the fixing roller 101 is rotated clockwise and the pressure roller 102 is rotated counterclockwise by a known driving mechanism or means (not shown). The fixing roller 101 and the pressure roller 102 are stationary when starting the fixing unit. The fixing roller 101 includes a main heater element 103 and an auxiliary heater element 104 which heat the fixing roller 101 so that the surface temperature of the fixing roller 101 reaches a predetermined fixing temperature capable of carrying out a fixing process with respect to a toner image (or toner T) that is formed on a recording medium P. The surface temperature of the fixing roller 101 is monitored by a temperature sensor 105. The temperature sensor 105 is arranged to monitor the surface temperature of the fixing roller 101 at a position on an opposite end from the nip part relative to a center axis of the fixing roller 101. The temperature sensor 105 may be formed by any type of sensor or detector, such as a radiation thermometer and a thermocouple, that can detect the surface temperature of the fixing roller 101, and may be a contact type which makes contact with the outer peripheral surface of the fixing roller 101 or a non-contact type.

The fixing roller 101 is normally formed by a hollow cylindrical roller, but may be formed by an endless belt. The pressure roller 102 is normally formed by a hollow cylindrical roller having an outer surface that is made of a resilient material such as silicone rubber.

FIG. 28 shows a case where the main and auxiliary heater elements 103 and 104 have a rod shape. The main heater element 103 generates heat when supplied with power from a main power supply unit 116 such as a commercial power supply capable of constantly supplying power. The fixing roller 101 is heated by the radiated heat from the main heater element 103. The auxiliary heater element 104 generates heat when supplied with power from an auxiliary power supply unit 117 such as a capacitor. The fixing roller 101 is heated by the radiated heat from the auxiliary heater element 104. The surface temperature of the fixing roller 101 is maintained to an appropriate temperature by turning the auxiliary power supply unit 1170N and OFF by a power control unit or means.

When carrying out the image forming process in the image forming apparatus employing the electrophotography technique, the recording medium P formed with the toner image (or toner T) is supplied to the nip part between the fixing roller 101 and the pressure roller 102. The toner image is fixed on the recording medium P as the recording medium P passes between the fixing roller 101 and the pressure roller 102 due to the heat and pressure applied on the recording medium P.

Figure 29:
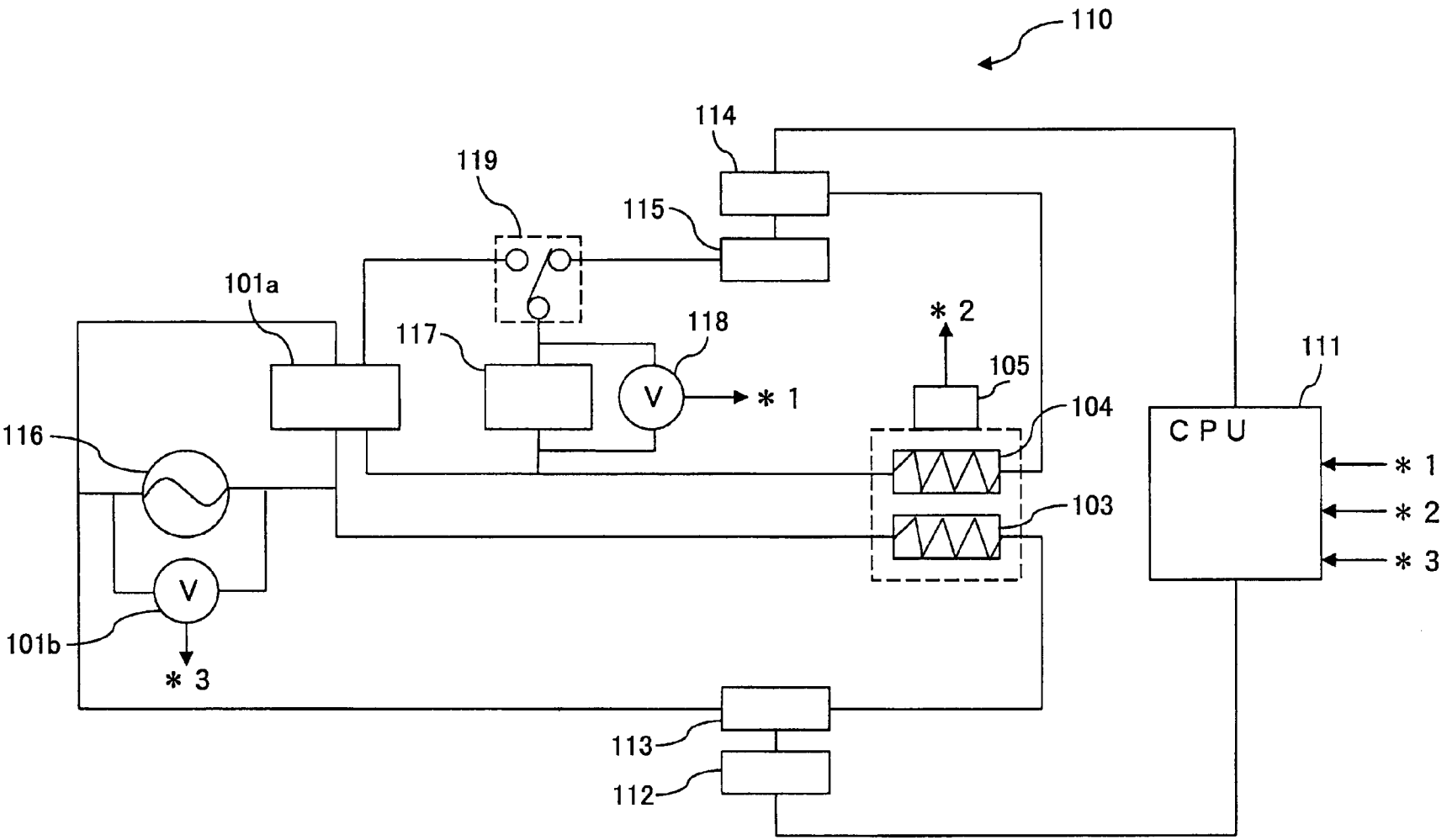
FIG. 29 is a circuit diagram showing a fixing unit system of the fourth embodiment.

FIG. 29 is a circuit diagram showing a fixing unit system of the fourth embodiment. In a fixing unit system 110 shown in FIG. 29, the main heater element 103 receives the power supplied from the main power supply unit 116, that is, an external power supply such as the commercial power supply. On the other hand, the auxiliary heater element 103 receives the power supplied from an auxiliary power supply unit 117 which is formed by a capacitor, for example. The auxiliary heater element 104 is desirably made up of a plurality of heater elements that are connected in parallel to the capacitor of the auxiliary power supply unit 117, so that at least one of these heater elements can be connected to the capacitor by controlling a switch part (not shown). For example, all of the heater elements of the auxiliary heater element 104 are connected to the capacitor when starting the image forming apparatus, and one or more selected heater elements (less than the total number of heater elements) are connected to the capacitor when carrying out the image forming process by supplying the recording medium P to the fixing unit.

A charged voltage detector 118 detects a capacitor voltage of the capacitor, indicating the charged energy (remaining amount of power) of the auxiliary power supply unit 117, and outputs a voltage detection signal *1 indicative of the detected capacitor voltage. The temperature sensor 105 detects the surface temperature of the fixing roller 101, and outputs a temperature detection signal *2 indicative of the detected surface temperature. A voltage detector 101*b* detects the output voltage of the main power supply unit 116, and outputs a voltage detection signal *3 indicative of the detected output voltage of the main power supply unit 116. The detection signals *1, *2 and *3 are supplied to a controller that is formed by a CPU 111 directly, or via an input circuit (not shown). The CPU 111 controls the supply of power via a triac 113 to the main heater element 103 via a controller 112, and controls the supply of power via a FET 115 to the auxiliary heater element 104 via a controller 114, based on the detection signals *1, *2 and *3, so that the surface temperature of the fixing roller 101 reaches a set temperature. The capacitor of the auxiliary power supply unit 117 is connected to a charger 101*a* and becomes chargeable by controlling a switch 119. The charged voltage detector 118 is connected to the capacitor of the auxiliary power supply unit 117. The capacitor of the auxiliary power supply unit 117 has an electrostatic capacitance on the F order or greater, and may be realized by an electric double layer capacitor.

Figure 30:
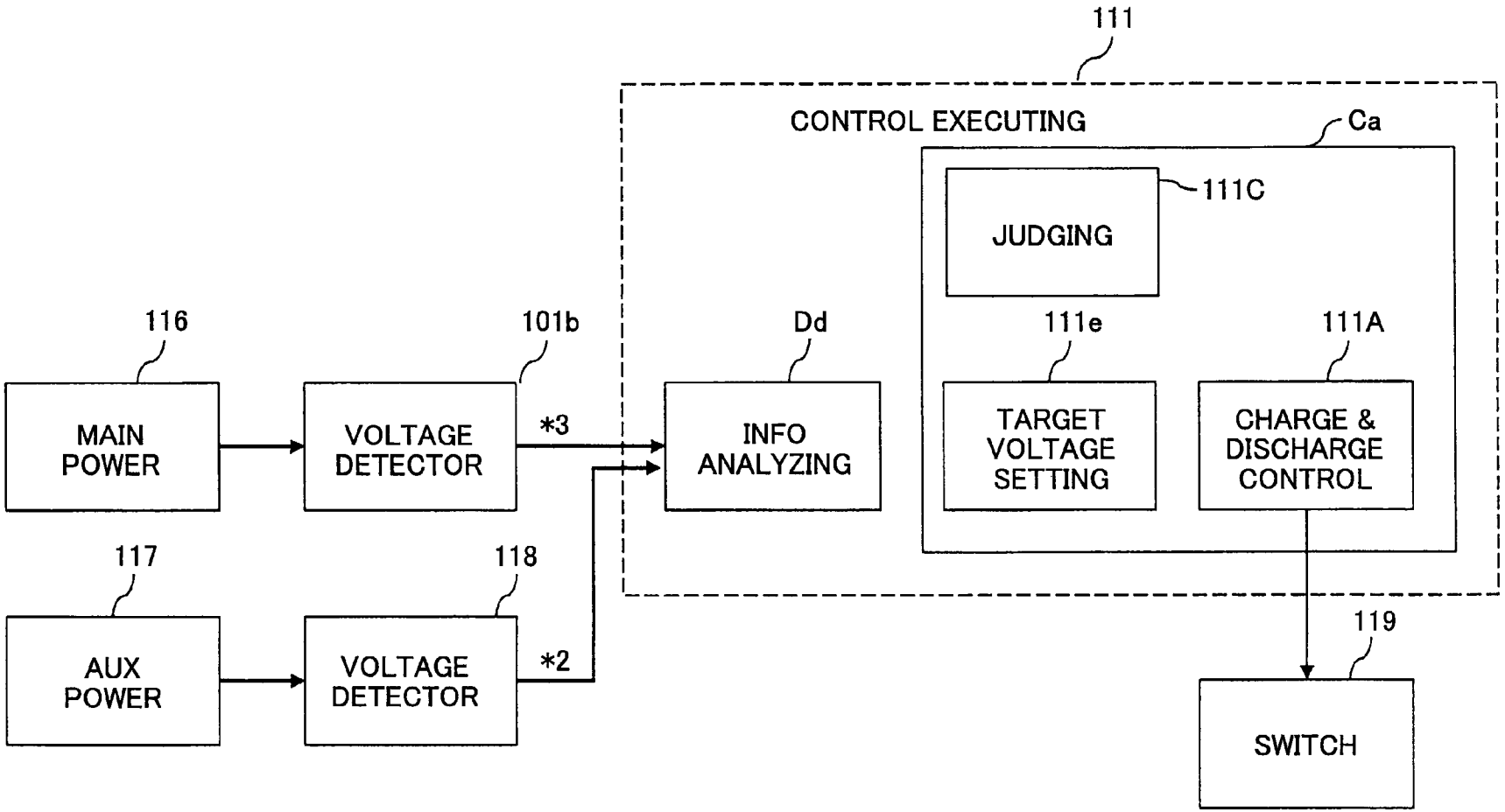
FIG. 30 is a system block diagram showing an important part of the fixing unit system of the fourth embodiment.

FIG. 30 is a system block diagram showing an important part of the fixing unit system 110 of this fourth embodiment, related to changing a target voltage based on a voltage drop of the commercial power supply, that is, the main power supply unit 116. The CPU 111 shown in FIG. 30 includes an information analyzing part Dd and a control executing part Ca. This control executing part Ca includes a judging part 111C, a target voltage setting part 111*e*, and a charge and discharge control part 111A, as functional blocks.

The information analyzing part Dd receives the voltage detection signal (or voltage information)*3 from the voltage detector 101*b* and the voltage detection signal (or charged energy information)*1 from the charged voltage detector 118.

The judging part 111C has a function of judging whether or not a voltage drop of the main power supply unit (commercial power supply) 116 occurred based on the voltage detection signal *3, and judging whether or not the capacitor voltage of the auxiliary power supply unit 117 has reached a target voltage set in the target voltage setting part 111*e* based on the voltage detection signal *1. The judging part 111C holds a threshold value (commercial power supply voltage threshold value) for judging whether or not the voltage drop of the main power supply unit 116 occurred. If this threshold value is 93 V, for example, the judging part 111C judges no voltage drop if the voltage detection signal *3 indicates that the output voltage of the main power supply unit 116 is greater than or equal to 93 V, and judges that the voltage drop occurred if the voltage detection signal *3 indicates that the output voltage of the main power supply unit 116 is less than 93 V.

The target voltage setting part 111*e* has a function of setting the target voltage to which the capacitor of the auxiliary power supply unit 117 is to be charged, based on a judgement result of the judging part 111C related to the voltage drop of the main power supply unit 116. More particularly, the target voltage setting part 111*e* sets the target voltage to a reference voltage (for example, 40 V if the rated capacitor voltage is 45 V) if the judgement result of the judging part 111C indicates that there is no voltage drop of the main power supply unit 116, and sets the target voltage to a value (for example, 43 V) that is increased from the reference voltage if the judgement result of the judging part 111C indicates that the voltage drop of the main power supply unit 116 exists.

The charging and discharging voltage control part 111A has a function of controlling the charging of the capacitor of the auxiliary power supply unit 117 by controlling the switch 119 based on the judgement result of the judging part 111C related to the capacitor voltage of the auxiliary power supply unit 117. More particularly, the switch 119 is switched and connected to the auxiliary heater element 104 so as to put the capacitor of the auxiliary power supply unit 117 in the discharge standby state if the capacitor voltage is greater than or equal to the target voltage, and the switch 119 is switched and connected to the charger 101*a* so as to charge the capacitor of the auxiliary power supply unit 117 if the capacitor voltage is less than the target voltage.

Figure 31:
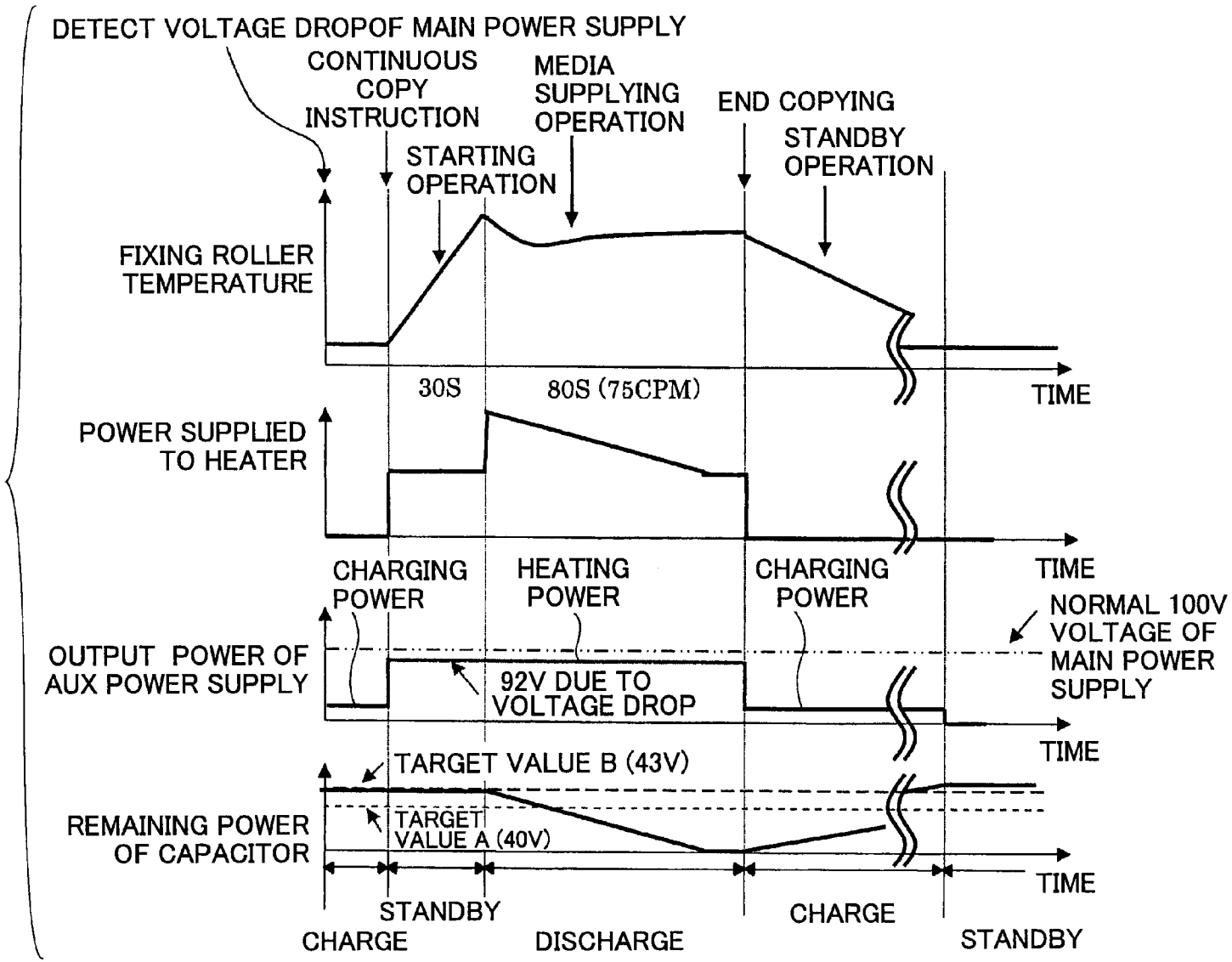
FIG. 31 is a diagram for explaining an operation of the fixing unit system of the fourth embodiment.

FIG. 31 is a diagram for explaining an operation of the fixing unit system 110 of this fourth embodiment. For the sake of convenience, it is assumed that the fixing unit system 110 operates under the following preconditions when carrying out steps s11 through s21.

Cpm conditions (number of recording media P subjected to the image forming process (that is, number of copies made) per minute): 75 cpm Capacitor charging target voltage: (capacitor rated voltage: 45 V)

40 V (target value A) if (commercial power supply voltage) ≧93 V

43 V (target value B) if (commercial power supply voltage) <93 V

Copy instruction: Continuous copy instruction that instructs a continuous image forming process with respect to 100 successively supplied recording media P Voltage drop of commercial power supply: drop to 92 V from 100 V Capacitor voltage when voltage drop of commercial power supply occurs: 40 V Step s11: When a voltage drop from 100 V to 92 V occurs in the output voltage of the main power supply unit (commercial power supply) 116, the voltage detection signal *3 from the voltage detector 101*b* indicating that the output voltage of the main power supply unit 116 has dropped to 92 V is input to the judging part 111C via the information analyzing part Dd within the CPU 111.

Step s12: The judging part 111C judges that the voltage drop of the main power supply unit 116 has occurred since the voltage of 92 V indicated by the voltage detection signal *3 is less than the threshold value of 93 V.

Step s13: The target voltage setting part 111*e* changes the setting of the target voltage to which the capacitor of the auxiliary power supply unit 117 is to be charged, from 40 V (target value A) to 43 V (target value B), based on the judgement result of the judging part 111C indicating that the voltage drop of the main power supply unit 116 has occurred.

Step s14: The judging part 111C receives, via the information analyzing part Dd within the CPU 111, the voltage detection signal *1 from the charged voltage detector 118 indicating that the capacitor voltage is 40 V.

Step s15: The judging part 111C judges that the capacitor voltage is less than the target voltage of 43 V, based on the voltage detection signal *1.

Step s16: The charging and discharging voltage control part 111A switches and connects the switch 119 to the charger 101*a*, based on the judgement result of the judging part 111C indicating that the capacitor voltage is less than the target voltage of 43 V, so as to start charging the capacitor of the auxiliary power supply unit 117.

Step s17: When the capacitor voltage reaches 43 V, the judging part 111C receives, via the information analyzing part Dd within the CPU 111, the voltage detection signal *1 from the charged voltage detector 118 indicating that the capacitor voltage is 43 V.

Step s18: The judging part 111C judges that the capacitor voltage of the auxiliary power supply unit 117 is greater than or equal to the target voltage of 43 V, based on the voltage detection signal *1.

Step s19: The charging and discharging voltage control part 111A switches and connects the switch 119 to the auxiliary heater element 104 so as to put the capacitor of the auxiliary power supply unit 117 in the discharge standby state, based on the judgement result of the judging part 111C indicating that the capacitor voltage is greater than or equal to the target voltage.

Step s20: When a continuous copy instruction is issued in response to a copy key (or button) of the operation part that is pushed by a user, for example, the operation of the fixing unit system 110 is started. More particularly, the power (92 V) from the main power supply unit 116 is supplied to the main heater element 103, and the fixing roller 101 is heated. For example, a starting time of 30 seconds is required to raise the surface temperature of the fixing roller 101 to the set temperature. In this state, the capacitor of the auxiliary power supply unit 117 is in a standby state.

Step s21: The supply of the recording media P at 75 cpm is started, and the power (92 V) from the main power supply unit 116 is supplied to the main heater element 103 and the power (discharge starting voltage of 43 V) from the auxiliary power supply unit 117 is supplied to the auxiliary heater element 104. The fixing roller 101 is heated by the heater elements 103 and 104, and the toner image (toner T) on each recording medium P is fixed as the recording media P successively pass through the nip part between the fixing roller 101 and the pressure roller 102. The surface temperature of the fixing roller 101 is maintained to the reload temperature or greater up to the last recording medium P, and a satisfactory fixing process can be carried out with respect to each of the successively supplied recording media P. The fixing process with respect to the 100 consecutive recording media P requires 80 seconds, for example.

Therefore, according to this fourth embodiment, it is possible to carry out a satisfactory fixing process and maintain a high image quality of the images formed on the recording media P, even when the voltage drop of the main power supply unit 116 occurs, by effectively utilizing the capacitor of the auxiliary power supply unit 117.

Figure 32:
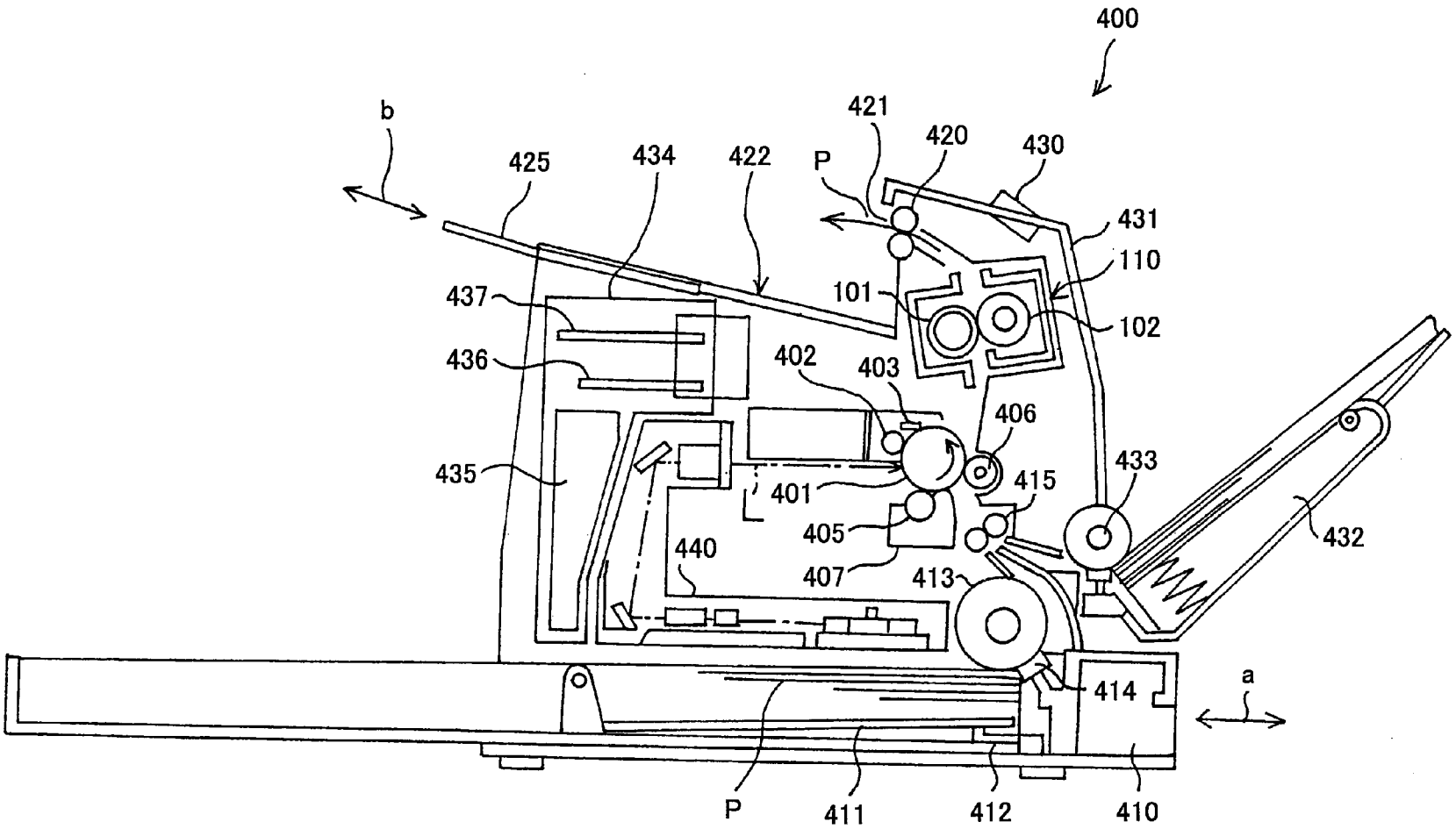
FIG. 32 is a cross sectional view showing an image forming apparatus of the fourth embodiment.

FIG. 32 is a cross sectional view showing the image forming apparatus of this fourth embodiment having the fixing unit system 110 described above.

An image forming apparatus 400 shown in FIG. 32 employs the electrophotography technique and includes a drum-shaped photoconductive body 401 that is provided as an image bearing member, a charging unit 402 that uniformly charges the outer peripheral surface of the photoconductive body 401, a laser optical system 440 that irradiates a laser beam L on the charged surface of the photoconductive body 401 to expose and form an electrostatic latent image, and a developing unit 407. The developing unit 407 includes a developing sleeve 405 that develops the electrostatic latent image on the surface of the photoconductive body 401 into a toner image. A transfer unit 406 transfers the toner image that is formed on the surface of the photoconductive body 401 onto the recording medium P which is supplied from a media supply cassette 410, and transports the recording medium P to the fixing unit system 110. In the fixing unit system 110, heat and pressure are applied on the toner image by the fixing roller 101 and the pressure roller 102, so as to fix the toner image on the recording medium P. A cleaning unit 403 cleans the surface of the photoconductive body 401.

The recording media P are supported on a plate 411 within the media supply cassette 410 which is detachable in a direction a. A spring (not shown) urges the plate 111 upwards via an arm 412, so that the recording media P are pushed against a media supply roller 413. Of the stacked recording media P, the top recording medium P is supplied from the media supply cassette 410 by the media supply roller 413 which rotates in response to an instruction from a controller (not shown), and a separating pad 414 prevents more than one recording medium P from being supplied at one time. The supplied recording medium P is transported to a resist roller pair 415.

An operation panel 430 is provided in a slightly projecting manner on an upper front surface (top right portion in FIG. 32) of a housing 431. A media supply tray 432 is pivotally supported on the housing 431. Of the stacked recording media P, the top recording medium P is supplied from the media supply tray 432 by a media supply roller 433 which rotates in response to an instruction from the controller (not shown), and a separating pad prevents more than one recording medium P from being supplied at one time. The supplied recording medium P is transported to the resist roller pair 415. The recording medium P is supplied from the selected one of the media supply cassette 410 and the media supply tray 432.

The resist roller pair 415 transports the recording medium P towards the transfer unit 406 at a timing synchronized to the toner image on the photoconductive body 401. The transfer unit 406 transfers the toner image on the photoconductive body 401 onto the recording medium P supplied by the resist roller pair 514, and the fixing unit system 110 fixes the toner image on the recording medium P.

When the main power supply unit 116 of the image forming apparatus 400 is turned ON, each part of the image forming apparatus 400 is started, and thus, the fixing unit system 110 is also started at the same time. As a result, the supply of power from the capacitor of the auxiliary power supply unit 117 to the auxiliary heater element 104 is also started, to thereby heat the fixing roller 101 and put the fixing unit into the standby state. Then, the power supply control of this fourth embodiment described above is carried out. In other words, the target voltage to which the capacitor of the auxiliary power supply unit 117 is to be charged is increased if the voltage drop occurs in the output voltage of the main power supply unit 116, so as to charge the capacitor to the target voltage. When the copy instruction is received, the capacitor voltage which is higher than normal is supplied from the capacitor of the auxiliary power supply unit 117 so as to compensate for the voltage drop of the output voltage of the main power supply unit 116, so that the continuous image forming process can be carried out while maintaining the satisfactory image quality up to the last recording medium P of the successively supplied recording media P.

The recording medium P having the toner image that is fixed is ejected by an eject roller pair 420 onto an eject tray 422 via a media eject opening 421. The ejected recording media P are stacked on the eject tray 422. In order to cope with various sizes of the recording media P, the eject tray 422 is provided with an auxiliary tray 425 which is slidable in a direction b.

A power supply circuit 435, a printed circuit board 436 such as an engine driver board, a controller board 437 and various other electronic and control units are accommodated within a casing part 434.

First Modification of Fourth Embodiment

Next, a description will be given of the preconditions of a first modification of the fourth embodiment of the image forming apparatus, a first modification of the fourth embodiment of the heater and a first modification of the fourth embodiment of the fixing unit according to the present invention.

Figure 33:
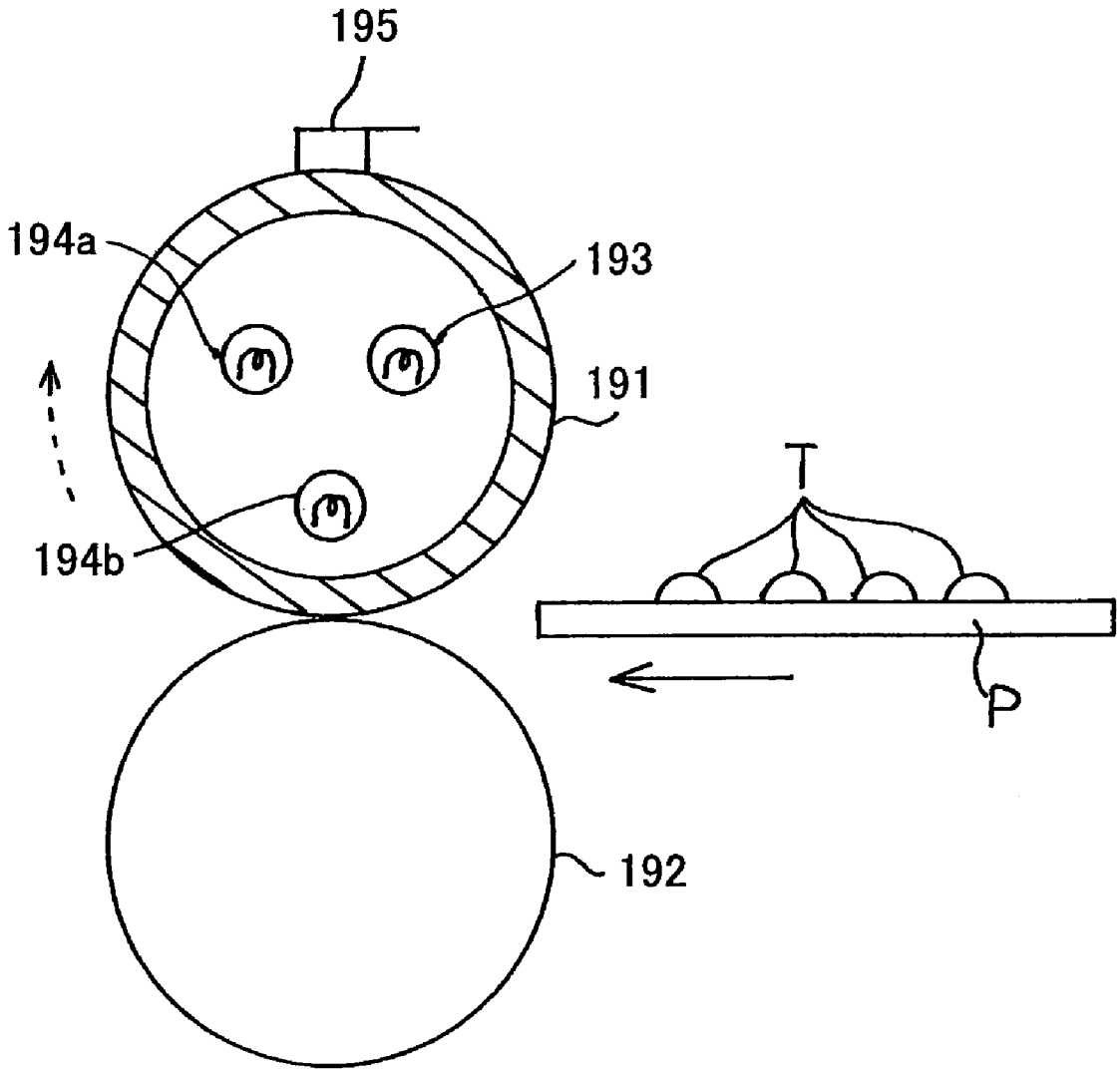
FIG. 33 is a cross sectional view showing a fixing unit having a type of structure employed in a first modification of the fourth embodiment.

FIG. 33 is a cross sectional view showing a fixing unit having a type of structure employed in the first modification of the fourth embodiment. In FIG. 33, those parts which are the same as those corresponding parts in FIG. 25 are designated by the same reference numerals, and a description thereof will be omitted.

In FIG. 33, the main heater element 193 and two auxiliary heater elements 194*a* and 194*b* are arranged at equi-angular intervals about a rotary axis within the fixing roller 191. Otherwise, the fixing unit shown in FIG. 33 is the same as the fixing unit shown in FIG. 25.

The main heater element 193 receives the power from the main power supply unit 186, that is, the commercial power supply, and has a rated power of 1200 W, for example. On the other hand, the auxiliary heater elements 194*a* and 194*b* receive the power from the auxiliary power supply unit 187, that is, the capacitor. The auxiliary heater element 194*a* is used when starting the image forming apparatus, and has a rated power of 700 W (at 100 V), for example. The auxiliary heater element 194*b* is used when supplying the recording medium P to the fixing unit, and has a rated power of 500 W (at 100 V), for example.

The circuit structure of the fixing unit system including this fixing unit shown in FIG. 33 is basically the same as that shown in FIG. 26, except that the auxiliary heater elements 194*a* and 194*b* are connected in parallel to the capacitor of the auxiliary power supply unit 187, so that at least one of these auxiliary heater elements 194*a* and 194*b* can be connected to the capacitor by controlling a switch part (not shown). In addition, the capacitor of the auxiliary power supply unit 187 is to be charged to a capacitor voltage of 100 V.

Figure 34:
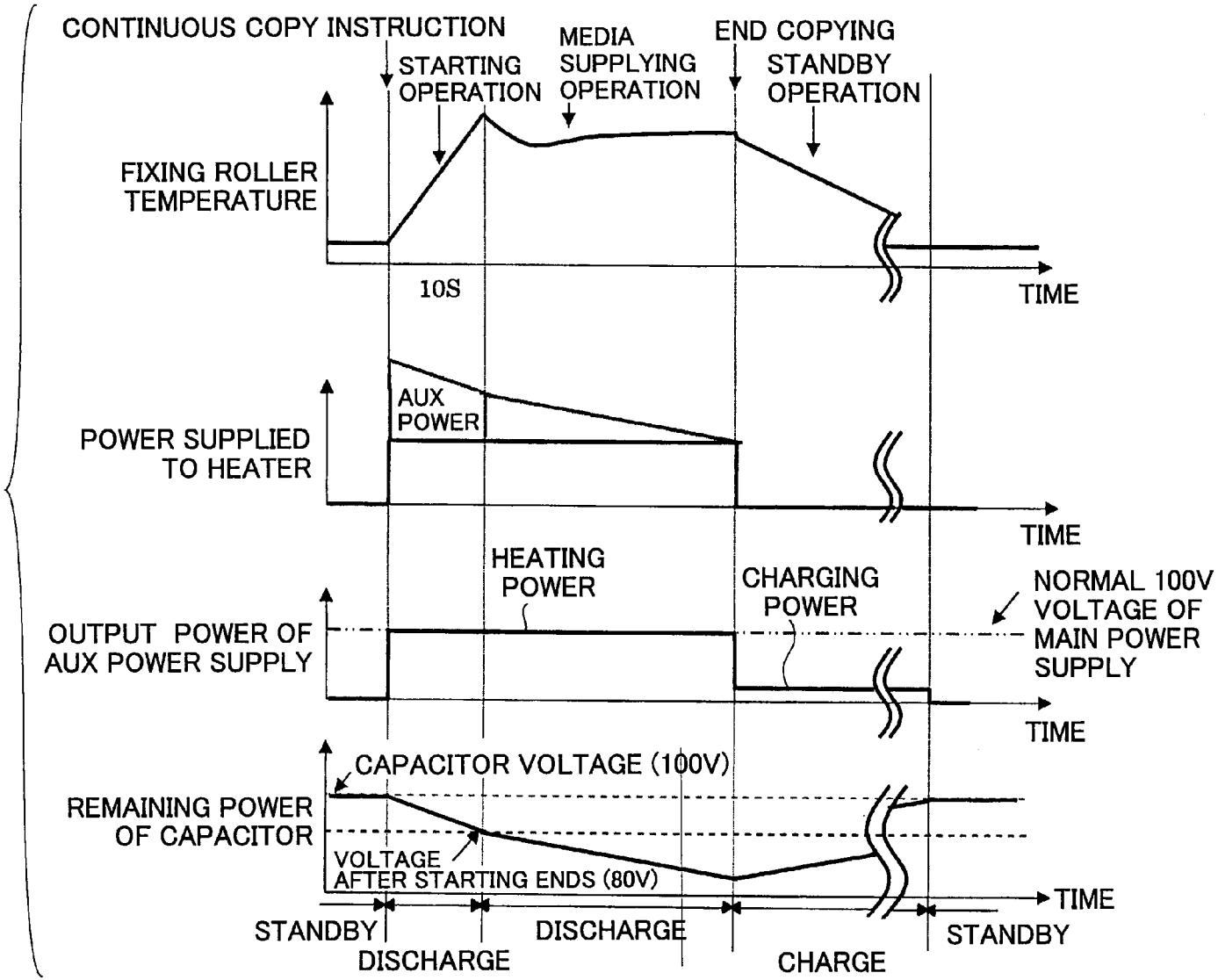
FIG. 34 is a diagram for explaining an operation of a fixing unit system having a type of structure employed in the first modification of the fourth embodiment.

FIG. 34 is a diagram for explaining an operation of the fixing unit system having the type of structure employed in the first modification of the fourth embodiment. For the sake of convenience, it is assumed that the fixing unit system 190 operates under the following preconditions when carrying out steps s91 through s93.

Cpm conditions (number of recording media P subjected to the image forming process (that is, number of copies made) per minute): 75 cpm Capacitor charging target voltage: 100 V Voltage of commercial power supply: 100 V Capacitor voltage when copy instruction issued: 100 V Heater Rated Power:

Main heater element 193: 1200 W

Auxiliary heater element 194*a:* 700 W (at 100 V)

Auxiliary heater element 194*b:* 500 W (at 100 V)

Heater Total Rated Power:

(i) When starting: 2400 W (all heater elements 193, 194*a* and 194*b* are turned ON, 1200 W+700 W+500 W)

(ii) When successively supplying recording media P: 1020 W (heater elements 193 and 194*b* are turned ON, input power to heater element 193 is 700 W due to duty control, input power to heater element 194*b* is 320 W since capacitor voltage is 80 V immediately after starting)

Step s91: The capacitor of the auxiliary power supply unit 187 is charged to the target voltage of 100 V and is put in a discharge standby state.

Step s92: When a continuous copy instruction is issued in response to the copy key (or button) of the operation part that is pushed by the user, for example, the operation of the fixing unit system 190 is started. More particularly, the power from the main power supply unit 186 is supplied to the main heater element 193, and the power from the capacitor of the auxiliary power supply unit 187 is supplied to the auxiliary heater elements 194*a* and 194*b*, so as to heat the fixing roller 191 to a temperature greater than or equal to the reload temperature. Since all of the heater elements 193, 194*a* and 194*b* are turned ON, a power of 2400 W is input to the fixing unit, to thereby rapidly heat the fixing roller 191 to the set temperature in 10 seconds.

Step s93: The supply of the recording media P at 75 cpm is started, and the power from the main power supply unit 186 is supplied to the main heater element 193 and the power from the auxiliary power supply unit 187 is supplied to the auxiliary heater element 194*b*. The fixing roller 191 is heated by the heater elements 193 and 194*b*, and the toner image (toner T) on each recording medium P is fixed as the recording media P successively pass through the nip part between the fixing roller 191 and the pressure roller 192. In this case, the input power to the heater elements 193 and 194*b* is 1020 W in total.

Although the power from both the main and auxiliary power supply units 186 and 187 are supplied to the fixing unit in this state, the present inventors have found that an incomplete fixing (or unstable fixing) may occur in some cases. According to analysis performed by the present inventors, it was found that the incomplete fixing is caused by a voltage drop of the main power supply unit 186.

In other words, because the amount of power supplied from the main power supply unit (commercial power supply) 186 is assumed to be constant (for example, 100 V) and the amount of power to be supplied from the capacitor of the auxiliary power supply unit 187 is set by subtracting the amount of power supplied from the main power supply unit 186 from the amount of power required by the fixing unit, the voltage drop of the main power supply unit 186 caused insufficient heating of the fixing unit and resulted in the surface temperature of the fixing roller 191 becoming lower than the reload temperature, even though the power from the main power supply unit 186 is supplied to the main heater element 193 and the power from the auxiliary power supply unit 187 is supplied to the auxiliary heater elements 194*a* and 194*b*.

The present inventors have found that the problems described above can be suppressed and the utilization efficiency of the capacitor of the auxiliary power supply unit can be improved, by monitoring an output voltage of the commercial power supply, that is, the main power supply unit.

Figure 35:
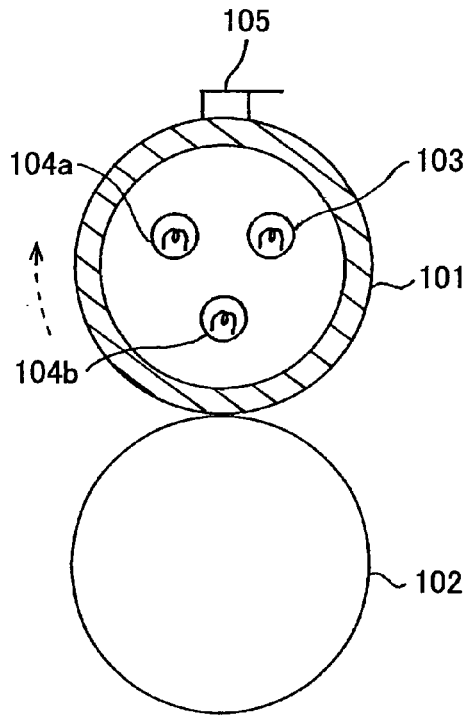
FIG. 35 is a cross sectional view showing a fixing unit of a first modification of the fourth embodiment.

FIG. 35 is a cross sectional view showing a fixing unit of the first modification of the fourth embodiment. In FIG. 35, those parts which are the same as those corresponding parts in FIG. 28 are designated by the same reference numerals, and a description thereof will be omitted.

In FIG. 35, the main heater element 103 and two auxiliary heater elements 104*a* and 104*b* are arranged at equi-angular intervals about a rotary axis within the fixing roller 101. Otherwise, the fixing unit shown in FIG. 35 is the same as the fixing unit shown in FIG. 28.

The main heater element 103 receives the power from the main power supply unit 116, that is, the commercial power supply, and has a rated power of 1200 W, for example. On the other hand, the auxiliary heater elements 104*a* and 104*b* receive the power from the auxiliary power supply unit 117, that is, the capacitor. The auxiliary heater element 104*a* is used when starting the image forming apparatus, and has a rated power of 700 W (at 100 V), for example. The auxiliary heater element 104*b* is used when supplying the recording medium P to the fixing unit, and has a rated power of 500 W (at 100 V), for example.

Figure 36:
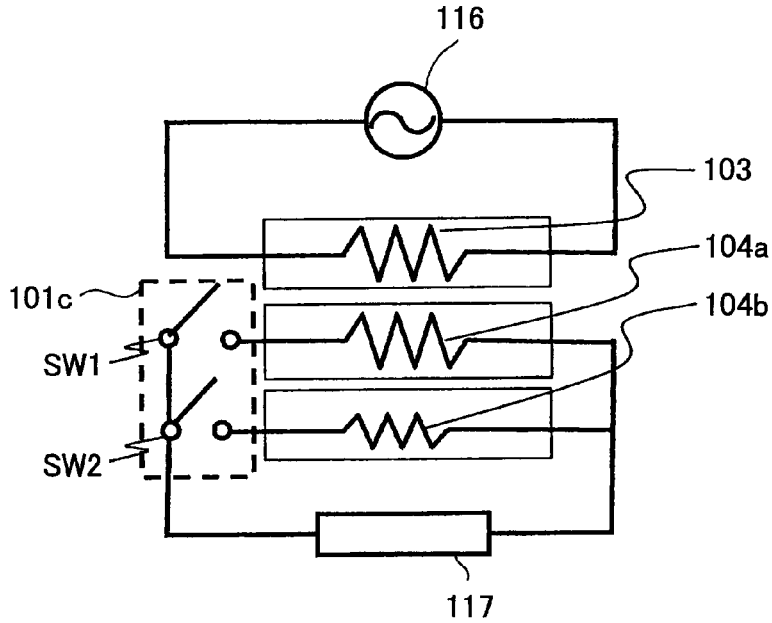
FIG. 36 is a circuit diagram showing an important part of a fixing unit system of the first modification of the fourth embodiment.

The circuit structure of the fixing unit system including this fixing unit shown in FIG. 35 is basically the same as that shown in FIG. 29, except that the auxiliary heater elements 104*a* and 104*b* are connected in parallel to the capacitor of the auxiliary power supply unit 117, so that at least one of these auxiliary heater elements 104*a* and 104*b* can be connected to the capacitor by controlling a switch part 101C (shown in FIG. 36). In addition, the capacitor of the auxiliary power supply unit 117 is to be charged to a capacitor voltage of 100 V.

FIG. 36 is a circuit diagram showing an important part of the fixing unit system of the first modification of the fourth embodiment, which differs from the fixing unit system shown in FIG. 29.

In FIG. 36, the auxiliary heater elements 104*a* and 104*b* are connected to the capacitor of the auxiliary power supply unit 117 via the switch part 101C, so that at least one of the auxiliary heater elements 104*a* and 104*b* may be selected to vary the total rated power of the heater part. More particularly, when a switch SW1 of the switch part 101C is turned ON and a switch SW2 of the switch part 101C is turned OFF, only the auxiliary heater element 104*a* is connected to the capacitor. When the switch SW1 is turned OFF and the switch SW2 is turned ON, only the auxiliary heater element 104*b* is connected to the capacitor. Further, when the switch SW1 is turned ON and the switch SW2 is turned ON, both the auxiliary heater elements 104*a* and 104*b* are connected to the capacitor.

Figure 37:
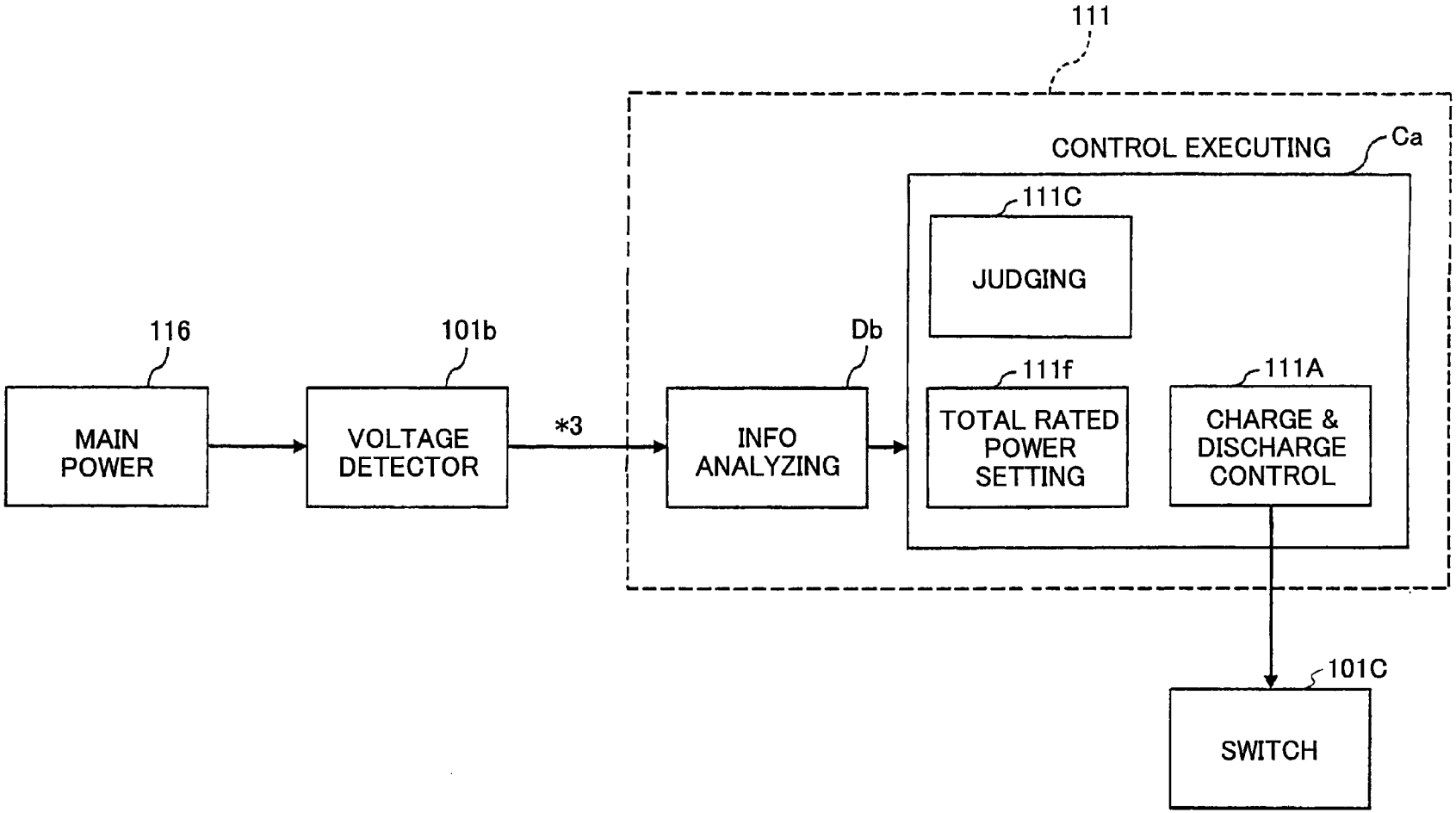
FIG. 37 is a system block diagram showing an important part of the fixing unit system of the first modification of the fourth embodiment.

FIG. 37 is a system block diagram showing an important part of the fixing unit system of the first modification of the fourth embodiment, related to changing the target voltage based on a voltage drop of the commercial power supply, that is, the main power supply unit 116. In FIG. 37, those parts which are essentially the same as those corresponding parts in FIG. 30 are designated by the same reference numerals, and a description thereof will be omitted. The CPU 111 shown in FIG. 37 includes the information analyzing part Dd and the control executing part Ca. This control executing part Ca includes the judging part 111C, a total rated power setting part 111*f*, and the charge and discharge control part 111A, as functional blocks.

The information analyzing part Dd receives the voltage detection signal (or voltage information) *3 from the voltage detector 101*b*.

The judging part 111C has a function of judging whether or not a voltage drop of the main power supply unit (commercial power supply) 116 occurred based on the voltage detection signal *3. The judging part 111C holds a threshold value (commercial power supply voltage threshold value) for judging whether or not the voltage drop of the main power supply unit 116 occurred. If this threshold value is 93 V, for example, the judging part 111C judges no voltage drop if the voltage detection signal *3 indicates that the output voltage of the main power supply unit 116 is greater than or equal to 93 V, and judges that the voltage drop occurred if the voltage detection signal *3 indicates that the output voltage of the main power supply unit 116 is less than 93 V.

The total rated power setting part 111*f* has a function of setting the total rated power that is to be set with respect to the heater part, based on a judgement result of the judging part 111C related to the voltage drop of the main power supply unit 116. More particularly, the total rated power setting part 111*f* determines the combination of the heater elements 103, 104*a* and 104*b* to be used when the recording medium P is supplied to the fixing unit, based on the judgement result of the judging part 111C. If the judgement result of the judging part 111C indicates that there is no voltage drop of the main power supply unit 116, the total rated power setting part 111*f* sets a normal combination of the heater elements 103, 104*a* and 104*b*, that is, the combination of the main heater element 103 and the auxiliary heater element 104*b*. On the other hand, if the judgement result of the judging part 111C indicates that the voltage drop of the main power supply unit 116 exists, the total rated power setting part 111*f* sets a combination of the heater elements 103, 104*a* and 104*b* so as to increase the total rated power compared to the normal combination, that is, the combination of the main heater element 103 and the auxiliary heater element 104*a* or, the combination of all of the heater elements 103, 104*a* and 104*b*.

The charging and discharging voltage control part 111A has a function of controlling the ON and OFF states of the switch part 101C based on the set result of the total rated power setting part 111*f*, so as to select at least one of the auxiliary heater elements 104*a* and 104*b* that is to be connected to the capacitor of the auxiliary power supply unit 117.

For the sake of convenience, it is assumed that the fixing unit system 110 operates under the following preconditions when carrying out steps s31 through s35.

Cpm conditions (number of recording media P subjected to the image forming process (that is, number of copies made) per minute): 75 cpm Capacitor charging target voltage: 100 V Voltage drop of commercial power supply: drop to 92 V from 100 V Capacitor voltage when copy instruction issued: 100 V Heater Rated Power:

Main heater element 103: 1200 W

Auxiliary heater element 104*a:* 700 W (at 100 V)

Auxiliary heater element 104*b:* 500 W (at 100 V)

Heater Total Rated Power:

(i) When starting: 2400 W (all heater elements 103, 104*a* and 104*b* are turned ON, 1200 W+700 W+500 W)

(ii) When successively supplying recording media P: 1020 W (heater element 103 is turned ON, heater element 104*b* is turned ON) if (commercial power supply voltage) ≧93 V 1150 W (heater element 103 is turned ON, heater element 104*a* is turned ON) if (commercial power supply voltage) <93 V Step s31: When a continuous copy instruction is issued in response to the copy key (or button) of the operation part that is pushed by the user, for example, the voltage detection signal *3 from the voltage detector 101*b* that indicates that the output voltage of the main power supply unit (commercial power supply) 116 is 92 V is input to the judging part 111C via the information analyzing part Dd within the CPU 111.

Step s32: Since the output voltage (92 V) of the main power supply unit 116 is less than the threshold voltage (93 V), the judging part 111C judges that a voltage drop has occurred in the output voltage of the main power supply unit 116.

Step s33: Based on the judgement result of the judging part 111C, the total rated power setting part 111*f* selects a combination of the main heater element 103 and the auxiliary heater element 104*a* to obtain the total rated power for the case where the recording media P are successively supplied for the continuous image forming process.

Step s34: The operation of the fixing unit system 110 is started. More particularly, the power from the main power supply unit 116 is supplied to the main heater element 103, and the power from the capacitor of the auxiliary power supply unit 117 is supplied to the auxiliary heater elements 104*a* and 104*b*, so as to heat the fixing roller 101 to a temperature greater than or equal to the reload temperature. Since all of the heater elements 103, 104*a* and 104*b* are turned ON, a power of 2400 W is input to the fixing unit, to thereby rapidly heat the fixing roller 101 to the set temperature in 10 seconds.

Step s35: The supply of the recording media P at 75 cpm is started, and the power from the main power supply unit 116 is supplied to the main heater element 103 and the power from the auxiliary power supply unit 117 is supplied to the auxiliary heater element 104*a*. The fixing roller 101 is heated by the heater elements 103 and 104*a*, and the toner image (toner T) on each recording medium P is fixed as the recording media P successively pass through the nip part between the fixing roller 101 and the pressure roller 102. In this case, the input power to the heater elements 103 and 104*a* is 1150 W in total. The surface temperature of the fixing roller 101 is maintained to the reload temperature or greater up to the last recording medium P, and a satisfactory fixing process can be carried out with respect to each of the successively supplied recording media P.

Therefore, according to this first modification of the fourth embodiment, it is possible to obtain a satisfactory image quality even when a voltage drop occurs in the output voltage of the main power supply unit (commercial power supply), by efficiently utilizing the capacitor of the auxiliary power supply unit and the auxiliary heater elements connectable thereto. Hence, the problems described above in conjunction with FIGS. 33 and 34 can be suppressed.

Although this first modification of the fourth embodiment sets the total rated power for the case where the recording media are successively supplied for the continuous image forming process by using a combination of the main heater element and a selected one of the two auxiliary heater elements, the heater element combination is of course not limited to such. One or a plurality of heater elements of the heater part may be selected to set the total rated power. For example, the following combinations c1 through c4 are possible.

Combination c1: Combination of the auxiliary heater elements 104*a* and 104*b*

Combination c2: Combination of the main heater element 103 and the auxiliary heater element 104*b*

Combination c3: Combination of the main heater element 103 and the auxiliary heater element 104*a*

Combination c4: Combination of the main heater element 103 and the auxiliary heater elements 104*a* and 104*b*

The image forming apparatus of this first modification of the fourth embodiment having the fixing unit system 110 described above, is basically the same as the image forming apparatus 400 shown in FIG. 32, and a detailed description thereof will be omitted. When the image forming apparatus of this first modification of the fourth embodiment receives an external copy instruction, the total rated power of the heater is set for the case where the recording media P are successively supplied for the continuous image forming process, depending on the output voltage of the main power supply unit (commercial power supply) 116 that is detected by the voltage detector 101*b*. The total rated power of the heater is changed to a value that is higher than normal when a voltage drop in the output voltage of the main power supply unit 116 is detected. Accordingly, the amount of heat generated by at least one of the auxiliary heater elements 104*a* and 104*b* powered by the capacitor of the auxiliary power supply unit 117 is increased so as to compensate for an amount corresponding to the voltage drop in the output voltage of the main power supply unit 116.

Second Modification of Fourth Embodiment

Figure 38:
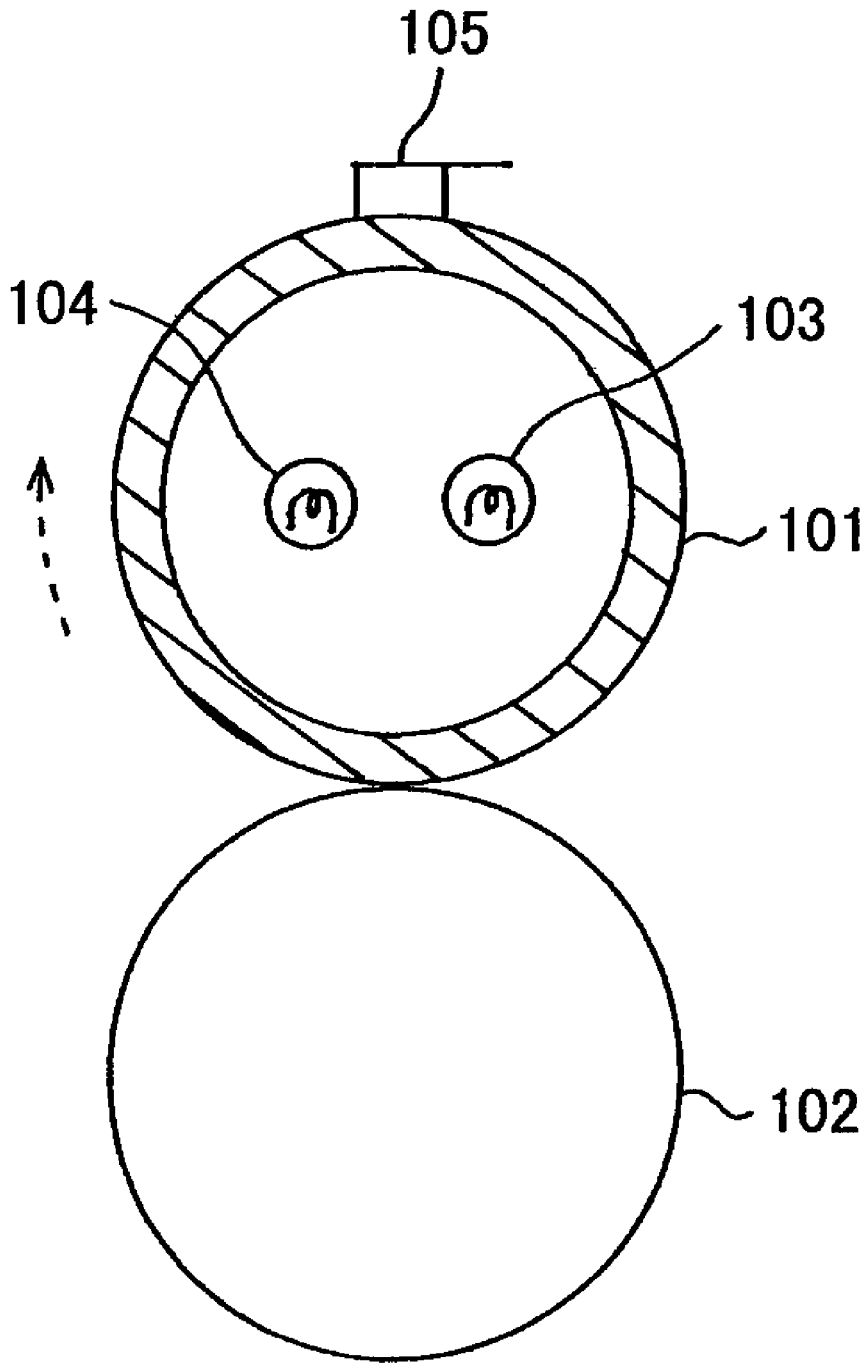
FIG. 38 is a cross sectional view showing a fixing unit of a second modification of the fourth embodiment.

FIG. 38 is a cross sectional view showing a fixing unit of a second modification of the fourth embodiment. In FIG. 38, a known pressing mechanism or means (not shown) urges a pressure roller 102 to press against a fixing roller 101 with a predetermined nip pressure, and the fixing roller 101 is rotated clockwise and the pressure roller 102 is rotated counterclockwise by a known driving mechanism or means (not shown). The fixing roller 101 and the pressure roller 102 are stationary when starting the fixing unit. The fixing roller 101 includes a main heater element 103 and an auxiliary heater element 104 which heat the fixing roller 101 so that the surface temperature of the fixing roller 101 reaches a predetermined fixing temperature capable of carrying out a fixing process with respect to a toner image (or toner T) that is formed on a recording medium P. The surface temperature of the fixing roller 101 is monitored by a temperature sensor 105. The temperature sensor 105 is arranged to monitor the surface temperature of the fixing roller 101 at a position on an opposite end from the nip part relative to a center axis of the fixing roller 101. The temperature sensor 105 may be formed by any type of sensor or detector, such as a radiation thermometer and a thermocouple, that can detect the surface temperature of the fixing roller 101, and may be a contact type which makes contact with the outer peripheral surface of the fixing roller 101 or a non-contact type.

The fixing roller 101 is normally formed by a hollow cylindrical roller, but may be formed by an endless belt. The pressure roller 102 is normally formed by a hollow cylindrical roller having an outer surface that is made of a resilient material such as silicone rubber.

FIG. 38 shows a case where the main and auxiliary heater elements 103 and 104 have a rod shape. The main heater element 103 generates heat when supplied with power from a main power supply unit 116 such as a commercial power supply capable of constantly supplying power. The fixing roller 101 is heated by the radiated heat from the main heater element 103. The auxiliary heater element 104 generates heat when supplied with power from an auxiliary power supply unit 117 such as a capacitor. The fixing roller 101 is heated by the radiated heat from the auxiliary heater element 104. The surface temperature of the fixing roller 101 is maintained to an appropriate temperature by turning the auxiliary power supply unit 117 0N and OFF by a power control unit or means.

When carrying out the image forming process in the image forming apparatus employing the electrophotography technique, the recording medium P formed with the toner image (or toner T) is supplied to the nip part between the fixing roller 101 and the pressure roller 102. The toner image is fixed on the recording medium P as the recording medium P passes between the fixing roller 101 and the pressure roller 102 due to the heat and pressure applied on the recording medium P.

Figure 39:
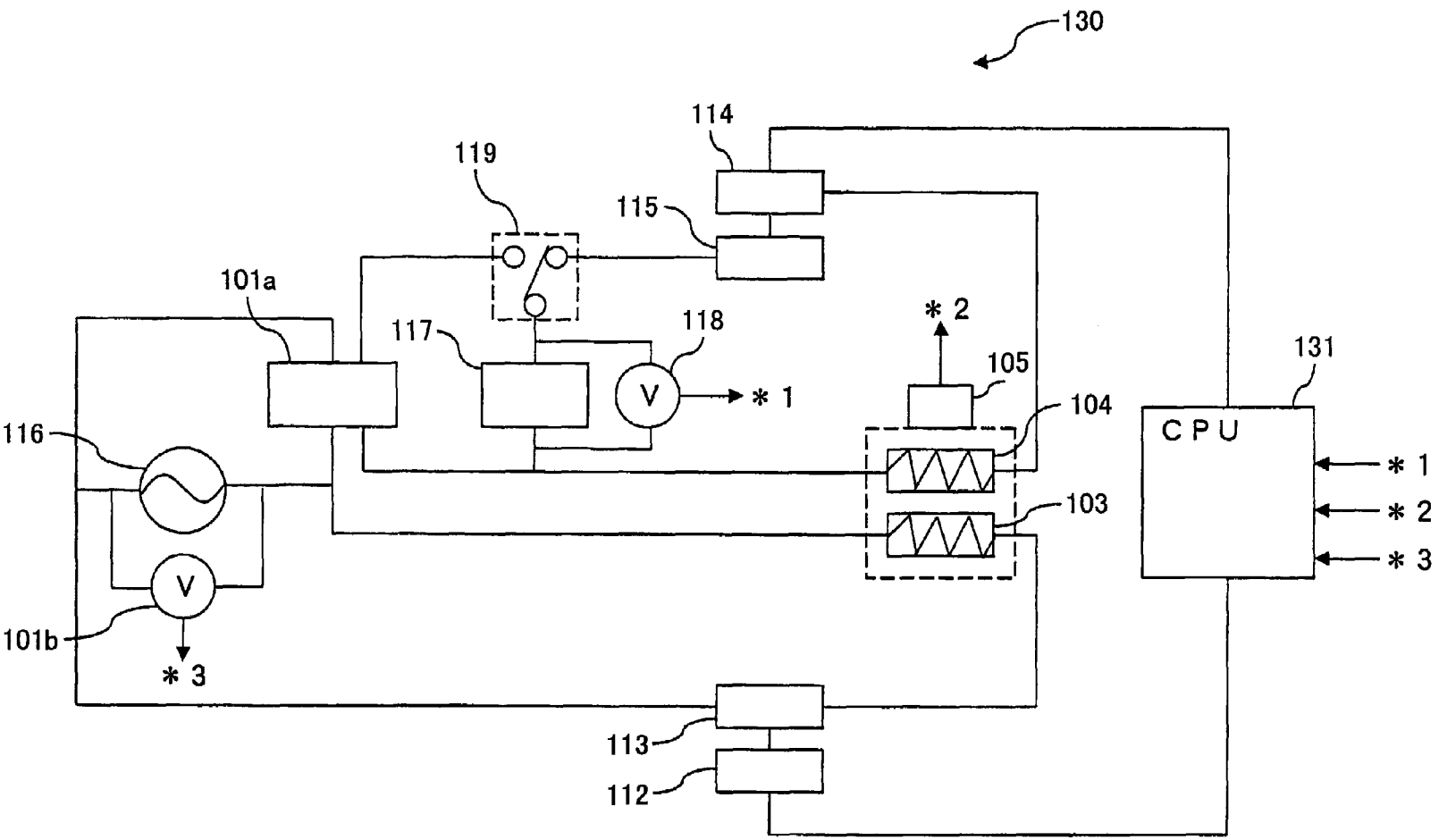
FIG. 39 is a circuit diagram showing a fixing unit system of the second modification of the fourth embodiment.

FIG. 39 is a circuit diagram showing a fixing unit system of this second modification of the fourth embodiment. In a fixing unit system 130 shown in FIG. 39, the main heater element 103 receives the power supplied from the main power supply unit 116, that is, an external power supply such as the commercial power supply. On the other hand, the auxiliary heater element 103 receives the power supplied from an auxiliary power supply unit 117 which is formed by a capacitor, for example. The auxiliary heater element 104 is desirably made up of a plurality of heater elements that are connected in parallel to the capacitor of the auxiliary power supply unit 117, so that at least one of these heater elements can be connected to the capacitor by controlling a switch part (not shown). For example, all of the heater elements of the auxiliary heater element 104 are connected to the capacitor when starting the image forming apparatus, and one or more selected heater elements (less than the total number of heater elements) are connected to the capacitor when carrying out the image forming process by supplying the recording medium P to the fixing unit.

A charged voltage detector 118 detects a capacitor voltage of the capacitor, indicating the charged energy (remaining amount of power) of the auxiliary power supply unit 117, and outputs a voltage detection signal *1 indicative of the detected capacitor voltage. The temperature sensor 105 detects the surface temperature of the fixing roller 101, and outputs a temperature detection signal *2 indicative of the detected surface temperature. A voltage detector 101*b* detects the output voltage of the main power supply unit 116, and outputs a voltage detection signal *3 indicative of the detected output voltage of the main power supply unit 116. The detection signals *1, *2 and *3 are supplied to a controller that is formed by a CPU 131 directly, or via an input circuit (not shown). The CPU 131 controls the supply of power via a triac 113 to the main heater element 103 via a controller 112, and controls the supply of power via a FET 115 to the auxiliary heater element 104 via a controller 114, based on the detection signals *1, *2 and *3, so that the surface temperature of the fixing roller 101 reaches a set temperature. The capacitor of the auxiliary power supply unit 117 is connected to a charger 101*a* and becomes chargeable by controlling a switch 119. The charged voltage detector 118 is connected to the capacitor of the auxiliary power supply unit 117. The capacitor of the auxiliary power supply unit 117 has an electrostatic capacitance on the F order or greater, and may be realized by an electric double layer capacitor. It is desirable that the cell capacitance of the capacitor forming the auxiliary power supply unit 117 is 500 F or greater.

Figure 40:
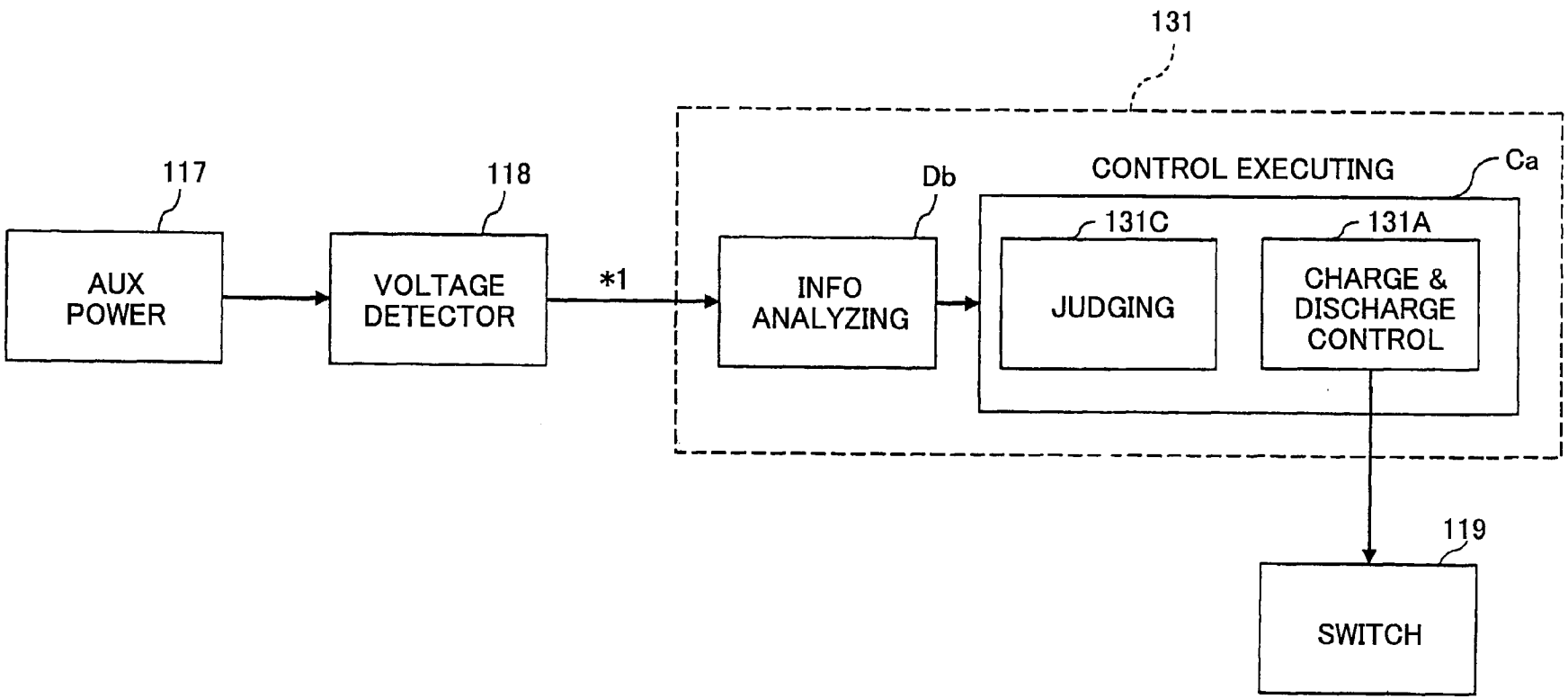
FIG. 40 is a system block diagram showing an important part of the fixing unit system of the second modification of the fourth embodiment.

FIG. 40 is a system block diagram showing an important part of the fixing unit system 130 of this second modification of the fourth embodiment, related to changing a target voltage based on a voltage drop of the commercial power supply, that is, the main power supply unit 116. The CPU 111 shown in FIG. 40 includes an information analyzing part Dd and a control executing part Ca. This control executing part Ca includes a judging part 131C and a charge and discharge control part 131A, as functional blocks.

The information analyzing part Dd receives the voltage detection signal (or charged energy information) *1 from the charged voltage detector 118.

The judging part 131C has a function of judging whether or not the capacitor voltage of the auxiliary power supply unit 117 has reached a target voltage to which the capacitor of the auxiliary power supply unit 117 is to be charged, based on the voltage detection signal *1. The judging part 131C holds a threshold value (target voltage threshold value) for judging whether or not the capacitor voltage of the auxiliary power supply unit 117 has reached the target voltage. It is desirable that this threshold value is set to approximately 80% of the cell rated voltage of the cells forming the capacitor.

The charging and discharging voltage control part 131A has a function of controlling the charging of the capacitor of the auxiliary power supply unit 117 by controlling the switch 119 based on the judgement result of the judging part 131C related to the capacitor voltage of the auxiliary power supply unit 117. More particularly, the switch 119 is switched and connected to the auxiliary heater element 104 so as to put the capacitor of the auxiliary power supply unit 117 in the discharge standby state if the capacitor voltage is greater than or equal to the target voltage, and the switch 119 is switched and connected to the charger 101*a* so as to charge the capacitor of the auxiliary power supply unit 117 if the capacitor voltage is less than the target voltage.

A description will be given of an operation of the fixing unit system 130 of this second modification of the fourth embodiment. For the sake of convenience, it is assumed that the fixing unit system 130 operates under the following preconditions when carrying out steps s41 through s46.

Capacitor of auxiliary power supply unit 117: Electric double layer capacitor

Cell Specifications:

Cell capacitance: 500 F

Cell rated voltage: 2.5 V

Target voltage threshold value (capacitor charging target voltage): 40 V

Initial capacitor voltage: 35 V

Step s41: The judging part 131C receives, via the information analyzing part Dd within the CPU 131, the voltage detection signal *1 from the charged voltage detector 118 indicating the capacitor voltage of the auxiliary power supply unit 117 is 35 V.

Step s42: The judging part 131C judges that the capacitor voltage of the auxiliary power supply unit 117 indicated by the voltage detection signal *1 is less than the target voltage of 40 V.

Step s43: The charging and discharging voltage control part 131A switches and connects the switch 119 to the charger 101*a*, based on the judgement result of the judging part 131C indicating that the capacitor voltage is less than the target voltage of 40 V, so as to start charging the capacitor of the auxiliary power supply unit 117.

Step s44: When the capacitor voltage reaches 40 V, the judging part 131C receives, via the information analyzing part Dd within the CPU 131, the voltage detection signal *1 from the charged voltage detector 118 indicating that the capacitor voltage is 40 V.

Step s45: The judging part 131C judges that the capacitor voltage of the auxiliary power supply unit 117 is greater than or equal to the target voltage of 40 V, based on the voltage detection signal *1.

Step s46: The charging and discharging voltage control part 131A switches and connects the switch 119 to the auxiliary heater element 104 so as to put the capacitor of the auxiliary power supply unit 117 in the discharge standby state, based on the judgement result of the judging part 131C indicating that the capacitor voltage is greater than or equal to the target voltage of 40 V.

When a continuous copy instruction is issued in response to a copy key (or button) of the operation part that is pushed by a user, for example, after the capacitor assumes the discharge standby state in the step s36, the operation of the fixing unit system 130 is started. More particularly, when starting the fixing unit system 130 or when carrying out the continuous image forming process, the power from the main power supply unit 116 is supplied to the main heater element 103, and the power from the auxiliary power supply unit 117 is supplied to the auxiliary heater element 104. The fixing roller 101 is thus heated by the heater elements 103 and 104 to a temperature greater than or equal to the reload temperature, and the toner image (toner T) on each recording medium P is fixed as the recording media P successively pass through the nip part between the fixing roller 101 and the pressure roller 102. The surface temperature of the fixing roller 101 is maintained to the reload temperature or greater up to the last recording medium P, and a satisfactory fixing process can be carried out with respect to each of the successively supplied recording media P. Since the capacitor voltage of the auxiliary power supply unit 117 becomes less than the target voltage after the above discharge, the charging operation of the steps s41 through s46 is carried out again in the standby state of the fixing unit system 130.

Figure 41:
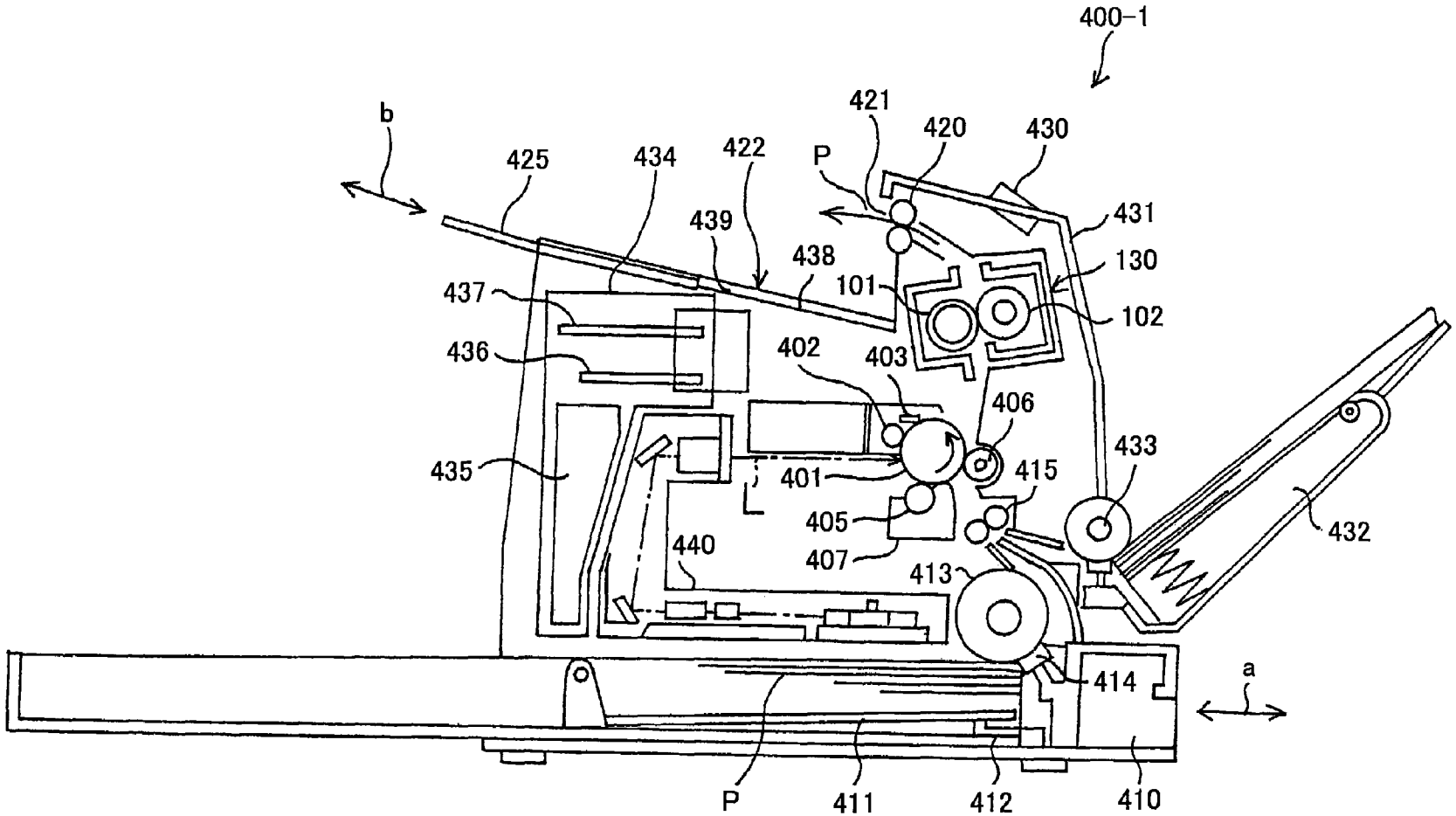
FIG. 41 is a cross sectional view showing an image forming apparatus of the second modification of fourth embodiment.

FIG. 41 is a cross sectional view showing the image forming apparatus of this second modification of the fourth embodiment having the fixing unit system 130 described above.

An image forming apparatus 400-1 shown in FIG. 41 employs the electrophotography technique and includes a drum-shaped photoconductive body 401 that is provided as an image bearing member, a charging unit 402 that uniformly charges the outer peripheral surface of the photoconductive body 401, a laser optical system 440 that irradiates a laser beam L on the charged surface of the photoconductive body 401 to expose and form an electrostatic latent image, and a developing unit 407. The developing unit 407 includes a developing sleeve 405 that develops the electrostatic latent image on the surface of the photoconductive body 401 into a toner image. A transfer unit 406 transfers the toner image that is formed on the surface of the photoconductive body 401 onto the recording medium P which is supplied from a media supply cassette 410, and transports the recording medium P to the fixing unit system 130. In the fixing unit system 130, heat and pressure are applied on the toner image by the fixing roller 101 and the pressure roller 102, so as to fix the toner image on the recording medium P. A cleaning unit 403 cleans the surface of the photoconductive body 401.

The recording media P are supported on a plate 411 within the media supply cassette 410 which is detachable in a direction a. A spring (not shown) urges the plate 111 upwards via an arm 412, so that the recording media P are pushed against a media supply roller 413. Of the stacked recording media P, the top recording medium P is supplied from the media supply cassette 410 by the media supply roller 413 which rotates in response to an instruction from a controller (not shown), and a separating pad 414 prevents more than one recording medium P from being supplied at one time. The supplied recording medium P is transported to a resist roller pair 415.

An operation panel 430 is provided in a slightly projecting manner on an upper front surface (top right portion in FIG. 41) of a housing 431. A media supply tray 432 is pivotally supported on the housing 431. Of the stacked recording media P, the top recording medium P is supplied from the media supply tray 432 by a media supply roller 433 which rotates in response to an instruction from the controller (not shown), and a separating pad prevents more than one recording medium P from being supplied at one time. The supplied recording medium P is transported to the resist roller pair 415. The recording medium P is supplied from the selected one of the media supply cassette 410 and the media supply tray 432.

The resist roller pair 415 transports the recording medium P towards the transfer unit 406 at a timing synchronized to the toner image on the photoconductive body 401. The transfer unit 406 transfers the toner image on the photoconductive body 401 onto the recording medium P supplied by the resist roller pair 514, and the fixing unit system 130 fixes the toner image on the recording medium P.

When the main power supply unit 116 of the image forming apparatus 400-1 is turned ON, each part of the image forming apparatus 400-1 is started, and thus, the fixing unit system 130 is also started at the same time. As a result, the supply of power from the capacitor of the auxiliary power supply unit 117 to the auxiliary heater element 104 is also started, to thereby heat the fixing roller 101 and put the fixing unit into the standby state. Then, the power supply control of this fourth embodiment described above is carried out. In other words, the target voltage to which the capacitor of the auxiliary power supply unit 117 is to be charged is increased if the voltage drop occurs in the output voltage of the main power supply unit 116, so as to charge the capacitor to the target voltage. When the copy instruction is received, the capacitor voltage which is higher than normal is supplied from the capacitor of the auxiliary power supply unit 117 so as to compensate for the voltage drop of the output voltage of the main power supply unit 116, so that the continuous image forming process can be carried out while maintaining the satisfactory image quality up to the last recording medium P of the successively supplied recording media P.

The recording medium P having the toner image that is fixed is ejected by an eject roller pair 420 onto an eject tray 422 via a media eject opening 421. The ejected recording media P are stacked on the eject tray 422. In order to cope with various sizes of the recording media P, the eject tray 422 is provided with an auxiliary tray 425 which is slidable in a direction b.

A power supply circuit 435, a printed circuit board 436 such as an engine driver board, a controller board 437 and various other electronic and control units are accommodated within a casing part 434.

Next, a description will be given of the reasons why the cell capacitance of the capacitor of the auxiliary power supply unit 117 is set to 500 F or greater and the capacitor charging target voltage is set to 80% of the cell rated voltage of the cells forming the capacitor or greater, in the image forming apparatus 400-1 of this second modification of the fourth embodiment.

Figure 42:
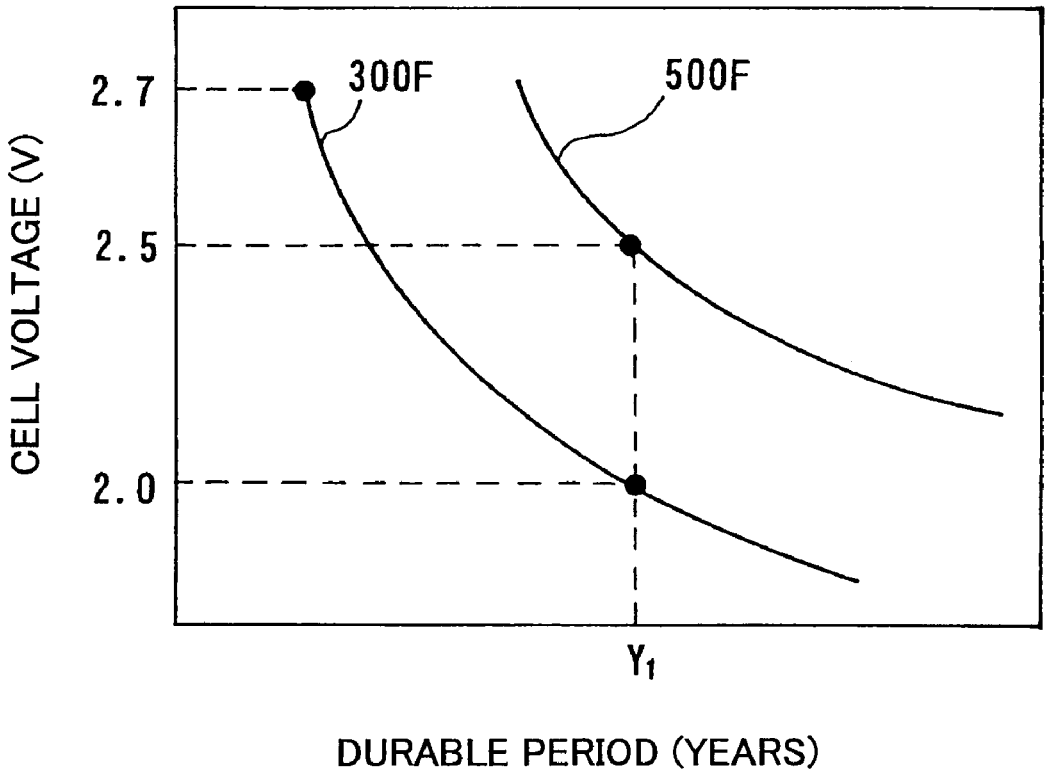
FIG. 42 is a diagram showing a relationship between a serviceable life and a cell voltage for cells forming a capacitor and having capacitances of 300 F and 500 F.

FIG. 42 is a diagram showing a relationship between a serviceable life and a cell voltage for cells forming the capacitor and having capacitances of 300 F and 500 F. The cells forming the capacitor have a tendency of more quickly deteriorating and having a shorter serviceable life when the cell voltage to which the charging is made is higher, and having a longer serviceable life when the cell voltage to which the charging is made is lower.

In the image forming apparatus 400-1, the capacitor of the auxiliary power supply unit 117 must have a certain durable period (or serviceable life) $Y_1$ or greater. In order to satisfy the durable period $Y_1$ in FIG. 42, it may be seen that the cell voltage of the 300 F cell must be 2.0 V or less, and the cell voltage of the 500 F cell must be 2.5 V or less.

On the other hand, it is desirable that the power supplied to the heater elements which heat the fixing roller 101 in the image forming apparatus 400-1 is as large as possible. But since the maximum current that can be supplied from the capacitor of the auxiliary power supply unit 117 to the heater element 104 is determined, it is desirable that the capacitor voltage is as large as possible.

If the required capacitor voltage is 50 V, for example, the capacitor can be formed by 20 cells if the cell voltage is 2.5 V, but 25 cells are required to form the capacitor if the cell voltage is 2.0 V. Hence, if the cell voltage is low, the size, weight and cost of the capacitor increase. On the other hand, if the capacitor is formed by 20 cells having the cell voltage of 2.0 V, the power supplied to the auxiliary heater element 104 will be insufficient, to thereby cause a temperature decrease in the fixing roller 101 and generate an incomplete or unstable fixing.

The present inventors conducted experiments on the image forming apparatus 400-1 based on the following conditions, by taking into consideration the above described relationship of the cell capacitance and the cell voltage of the cells forming the capacitor of the auxiliary power supply unit 117.

1) Capacitor Specifications: Electric Double Layer Capacitor

Bank structure made up of 20 cells

Cell Specifications:

Cell rated voltage: 2.5 V

Cell capacitance: Two levels of 300 F & 500 F

2) Target Voltage Threshold Value:

Two levels of 30 V and 40V (60% & 80% of cell rated voltage) for cell capacitance of 300 F One level of 40 V (80% of cell rated voltage) for cell capacitance of 500 F 3) Evaluating Items:

Fixing characteristic was evaluated by forming an image on the recording medium P by the image forming apparatus 400-1 and checking the fixed state of the image on the recording medium P. A symbol "O" was used to indicate a satisfactory fixing characteristic, and a symbol "X" was used to indicate a unsatisfactory fixing characteristic.

Serviceable life was evaluated by repeating the image forming process that causes the charging and discharging of the capacitor of the auxiliary power supply unit 117 in the image forming apparatus 400-1, and checking the deteriorated state of the capacitor. A symbol "O" was used to indicate a satisfactory state of the capacitor, and a symbol "X" was used to indicate a deteriorated state of the capacitor.

FIG. 43 is a diagram showing the evaluation result for samples SA1 through SA3 of the image forming apparatus 400-1 of the second modification of the fourth embodiment. It was confirmed that the satisfactory fixing characteristic and the long serviceable life can be achieved when the cell capacitance of the capacitor of the auxiliary power supply unit 117 is 500 F or greater and the target voltage of the capacitor is 80% of the cell rated voltage or greater.

Further, the present invention is not limited to these embodiments, but various variations and modifications may be made without departing from the scope of the present invention.

What is claimed is:

1. An image forming apparatus comprising:

a main power supply unit;

a chargeable auxiliary power supply unit;

a fixing unit including a heater part configured to receive power from at least one of the main power supply unit and the auxiliary power supply unit; and a voltage detecting part configured to detect a voltage input to the main power supply unit from a commercial power supply, wherein energy accumulated in the auxiliary power supply unit is not supplied to the fixing unit at a time of starting the fixing unit if the voltage detected by the voltage detecting part is a predetermined voltage or less.

2. The image forming apparatus as claimed in claim 1, wherein energy accumulated in the auxiliary power supply unit is supplied to the fixing unit at a time of carrying out an image forming process with respect to successively supplied recording media if the voltage detected by the voltage detecting part is the predetermined voltage or less.

3. The image forming apparatus as claimed in claim 1, wherein the heater part comprises a plurality of halogen heaters.

4. The image forming apparatus as claimed in claim 1, wherein the heater part comprises a plurality of ceramic heaters.

5. The image forming apparatus as claimed in claim 1, wherein the heater part comprises a plurality of induction heaters.

6. The image forming apparatus as claimed in claim 1, wherein the heater part comprises a single heater.

7. The image forming apparatus as claimed in claim 1, wherein the auxiliary power supply unit comprises a capacitor.

8. The image forming apparatus as claimed in claim 1, further comprising:

a control part configured to prohibit energy accumulated in the auxiliary power supply unit from being supplied to the fixing unit at the time of starting the fixing unit if the voltage detected by the voltage detecting part is the predetermined voltage or less.

9. An image forming apparatus comprising:

a main power supply unit;

a chargeable auxiliary power supply unit;

a fixing unit including a heater part configured to receive power from at least one of the main power supply unit and the auxiliary power supply unit; and a temperature detecting part configured to detect an environment temperature, wherein energy accumulated in the auxiliary power supply unit is not supplied to the fixing unit at a time of starting the fixing unit if the environment temperature detected by the temperature detecting part is a predetermined temperature or less.

10. The image forming apparatus as claimed in claim 9, wherein energy accumulated in the auxiliary power supply unit is supplied to the fixing unit at a time of carrying out an image forming process with respect to successively supplied recording media if the environment temperature detected by the temperature detecting part is the predetermined temperature or less.

11. The image forming apparatus as claimed in claim 9, wherein the heater part comprises a plurality of heaters selected from a group consisting of halogen heaters, ceramic heaters, and induction heaters.

12. The image forming apparatus as claimed in claim 9, wherein the heater part comprises a single heater.

13. The image forming apparatus as claimed in claim 9, wherein the auxiliary power supply unit comprises a capacitor.

14. The image forming apparatus as claimed in claim 9, further comprising:

a control part configured to prohibit energy accumulated in the auxiliary power supply unit from being supplied to the fixing unit at the time of starting the fixing unit if the environment temperature detected by the temperature detecting part is the predetermined temperature or less.

15. An image forming apparatus comprising:

a main power supply unit;

a chargeable auxiliary power supply unit;

a fixing unit including a heater part configured to receive power from at least one of the main power supply unit and the auxiliary power supply unit; and a voltage detecting part configured to detect a voltage of the auxiliary power supply unit, wherein energy accumulated in the auxiliary power supply unit is not supplied to the fixing unit at a time of starting the fixing unit if the voltage detected by the voltage detecting part is a predetermined voltage or less, wherein energy accumulated in the auxiliary power supply unit is supplied to the fixing unit at a time of carrying out an image forming process with respect to successively supplied recording media if the voltage detected by the voltage detecting part is the predetermined voltage or less.

16. The image forming apparatus as claimed in claim 15, wherein the heater part comprises a plurality of heaters selected from a group consisting of halogen heaters, ceramic heaters, and induction heaters.

17. The image forming apparatus as claimed in claim 15, wherein the heater part comprises a single heater.

18. The image forming apparatus as claimed in claim 15, wherein the auxiliary power supply unit comprises a capacitor.

19. The image forming apparatus as claimed in claim 15, further comprising:

a control part configured to prohibit energy accumulated in the auxiliary power supply unit from being supplied to the fixing unit at the time of starting the fixing unit if the voltage detected by the voltage detecting part is the predetermined voltage or less.

* * * * *